US010539287B2

(12) United States Patent
Suwa et al.

(10) Patent No.: US 10,539,287 B2
(45) Date of Patent: Jan. 21, 2020

(54) HEADLIGHT MODULE AND HEADLIGHT DEVICE

(71) Applicant: MITSUBISHI ELECTRIC CORPORATION, Tokyo (JP)

(72) Inventors: Masashige Suwa, Tokyo (JP); Ritsuya Oshima, Tokyo (JP); Keiji Nakamura, Tokyo (JP); Kuniko Kojima, Tokyo (JP); Muneharu Kuwata, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 21 days.

(21) Appl. No.: 16/068,618

(22) PCT Filed: Jan. 10, 2017

(86) PCT No.: PCT/JP2017/000460

§ 371 (c)(1),
(2) Date: Jul. 6, 2018

(87) PCT Pub. No.: WO2017/122630

PCT Pub. Date: Jul. 20, 2017

(65) Prior Publication Data

US 2019/0017675 A1 Jan. 17, 2019

(30) Foreign Application Priority Data

Jan. 13, 2016 (JP) ..... 2016-004086

(51) Int. Cl.
*F21S 41/67* (2018.01)
*F21S 41/147* (2018.01)
(Continued)

(52) U.S. Cl.
CPC ..... *F21S 41/67* (2018.01); *F21S 41/147* (2018.01); *F21S 41/24* (2018.01); *F21S 41/275* (2018.01)

(58) Field of Classification Search
CPC ..... F21S 41/67; F21S 41/24; F21S 41/275; F21S 41/247
See application file for complete search history.

(56) References Cited

U.S. PATENT DOCUMENTS

2004/0156209 A1* 8/2004 Ishida ..... F21S 41/143 362/516
2005/0225995 A1 10/2005 Komatsu et al.
(Continued)

FOREIGN PATENT DOCUMENTS

CN 106471309 A 3/2017
JP 2004-241349 A 8/2004
(Continued)

OTHER PUBLICATIONS

U.S. Appl. No. 15/315,327, filed Nov. 30, 2016.
(Continued)

*Primary Examiner* — Anh T Mai
*Assistant Examiner* — Nathaniel J Lee
(74) *Attorney, Agent, or Firm* — Birch, Stewart, Kolasch & Birch, LLP

(57) ABSTRACT

A headlight module for projecting a light distribution pattern includes: a light source for emitting light; and an optical element including a first reflecting surface for reflecting the light as first reflected light, a second reflecting surface for reflecting, as second reflected light, light passing through a traveling direction side of an edge portion of the first reflecting surface, a first emitting surface for emitting the first reflected light, and a second emitting surface for emitting the second reflected light, the traveling direction side being a side toward which the first reflected light travels. The edge portion is an edge portion on the traveling direction side. The first reflecting surface forms a high luminous intensity region of the light distribution pattern by superposing the first reflected light and light that has not been reflected by the first reflecting surface, and forms a cutoff line of the light distribution pattern.

13 Claims, 18 Drawing Sheets

(51) Int. Cl.
*F21S 41/24* (2018.01)
*F21S 41/275* (2018.01)

(56) References Cited

U.S. PATENT DOCUMENTS

| | | | | |
|---|---|---|---|---|
| 2009/0257240 | A1 | 10/2009 | Koike | |
| 2010/0046243 | A1 | 2/2010 | Yatsuda | |
| 2014/0362596 | A1* | 12/2014 | Nakaya | G02B 19/0028 362/511 |
| 2017/0198877 | A1 | 7/2017 | Suwa et al. | |
| 2017/0343175 | A1* | 11/2017 | Owada | B62J 6/02 |

FOREIGN PATENT DOCUMENTS

| | | | |
|---|---|---|---|
| JP | 2005-251435 | A | 9/2005 |
| JP | 2008-41271 | A | 2/2008 |
| JP | 2009-199938 | A | 9/2009 |
| JP | 2010-49886 | A | 3/2010 |
| JP | 2010-170836 | A | 8/2010 |

OTHER PUBLICATIONS

International Search Report for PCT/JP2017/000460 (PCT/ISA/210) dated Apr. 11, 2017.
Japanese Office Action issued in Japanese Patent Application No. 2017-546739 dated Oct. 31, 2017.

* cited by examiner

HEADLIGHT MODULE AND HEADLIGHT DEVICE

TECHNICAL FIELD

The present invention relates to a headlight module and a headlight device for providing illumination ahead of a vehicle body.

BACKGROUND ART

A headlight device needs to satisfy a predetermined light distribution pattern specified by road traffic rules or the like.

As one of the road traffic rules, for example, a predetermined light distribution pattern for an automobile low beam has a horizontally long shape narrow in an up-down direction. To prevent an oncoming vehicle from being dazzled, a boundary (cutoff line) of light on the upper side of the light distribution pattern is required to be sharp. A sharp cutoff line with a dark area above the cutoff line (outside the light distribution pattern) and a bright area below the cutoff line (inside the light distribution pattern) is required.

The illuminance is required to be highest at a region on the lower side of the cutoff line (inside the light distribution pattern). The region of highest illuminance is referred to as the "high illuminance region." Here, "region on the lower side of the cutoff line" refers to an upper part of the light distribution pattern, and corresponds to a part for irradiating a distant area, in a headlight device. To achieve such a sharp cutoff line, large chromatic aberration, blur, or the like must not occur on the cutoff line. "Blur occurs on the cutoff line" indicates that the cutoff line is unclear.

To provide such a complicated light distribution pattern, an optical system configuration using the combination of a reflector, a light blocking plate, and a projection lens is commonly used (e.g., Patent Literature 1). The light blocking plate is disposed at a focal position of the projection lens.

In a headlight disclosed in Patent Literature 1, a semiconductor light source is disposed at a first focal point of a reflector with an ellipsoid of revolution. Light emitted from the semiconductor light source converges at a second focal point. The headlight disclosed in Patent Literature 1 blocks part of the light by a shade (light blocking plate) and then emits it through a projection lens ahead.

CITATION LIST

Patent Literature

Patent Literature 1: Japanese Patent Application Publication No. 2009-199938

SUMMARY OF INVENTION

Technical Problem

However, in the optical system configuration of Patent Literature 1, since the cutoff line is formed by using the light blocking plate, the light use efficiency is low. Part of the light emitted from the light source is blocked by the light blocking plate and is not used as projection light. "Light use efficiency" refers to use efficiency of light.

The present invention has been made in consideration of the problem of the prior art, and is intended to provide a headlight device that reduces reduction in the light use efficiency.

Solution to Problem

A headlight module is a headlight module for a vehicle for forming a light distribution pattern and projecting the light distribution pattern, the headlight module including: a light source for emitting light; and an optical element including a first reflecting surface for reflecting the light as first reflected light, and a second reflecting surface for reflecting, as second reflected light, light passing through a traveling direction side of an edge portion of the first reflecting surface, the traveling direction side being a side toward which the first reflected light travels. The edge portion is an edge portion on the traveling direction side. The first reflecting surface forms a high luminous intensity region of the light distribution pattern by superposing the first reflected light and light that has not been reflected by the first reflecting surface, and forms a cutoff line of the light distribution pattern.

Advantageous Effects of Invention

According to the present invention, it is possible to provide a headlight module and a headlight device in which reduction in the light use efficiency is reduced.

DESCRIPTION OF EMBODIMENTS

Figure 1A:
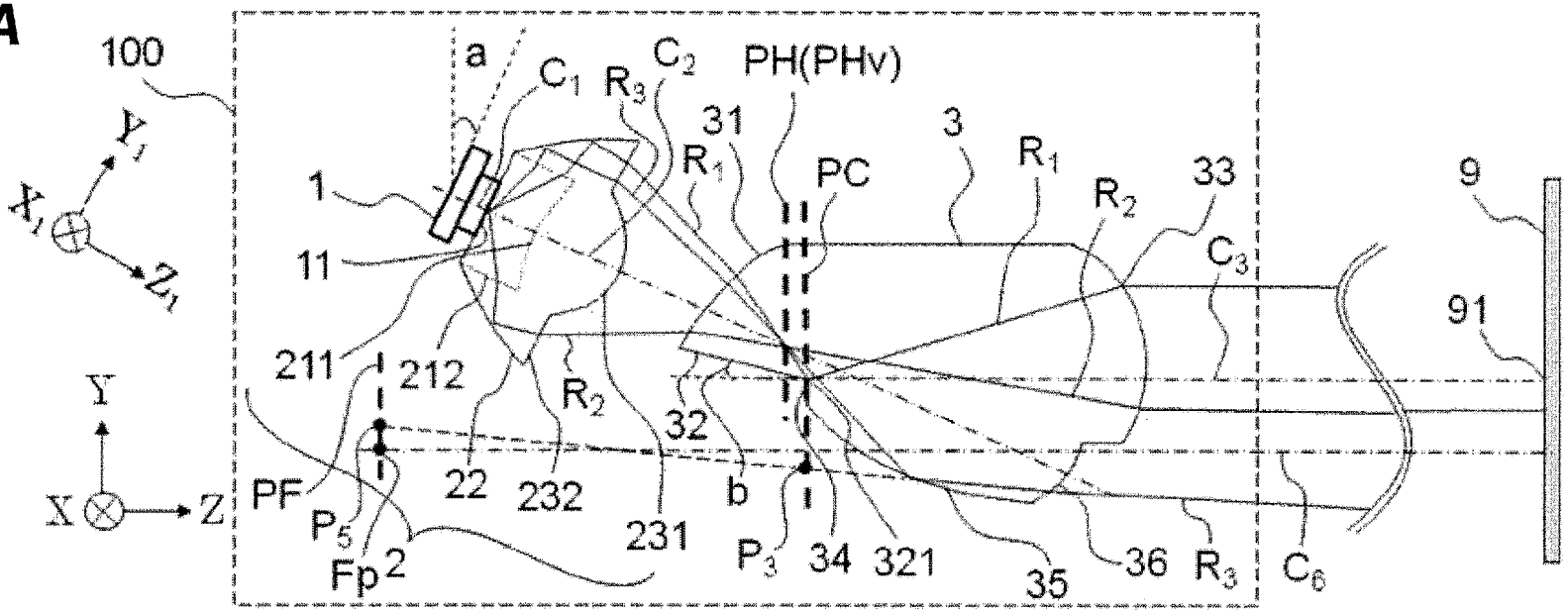
FIGS. 1A and 1B are configuration diagrams illustrating a configuration of a headlight module 100 according to a first embodiment.

"Light distribution" refers to a luminous intensity distribution of a light source with respect to space. That is, it refers to a spatial distribution of light emitted from a light source. "Luminous intensity" indicates the degree of intensity of light emitted by a luminous body and is obtained by dividing a luminous flux passing through a small solid angle in a given direction by the small solid angle.

"Cutoff line" refers to a light/dark borderline formed when a wall or screen is irradiated with light from a headlight, and a borderline on the upper side of the light distribution pattern. It refers to a light/dark borderline on the upper side of the light distribution pattern. "Cutoff line" refers to a borderline between a bright area (inside of the light distribution pattern) and a dark area (outside of the light distribution pattern) on the upper side of the light distribution pattern. "Cutoff line" is a borderline portion between a bright portion and a dark portion that is formed in an outline portion of the light distribution pattern. Thus, the upper side of the cutoff line (outside of the light distribution pattern) is dark, and the lower side of the cutoff line (inside of the light distribution pattern) is bright. Cutoff line is a term used when an irradiating direction of a passing headlight is adjusted. The passing headlight is also referred to as a low beam.

To form a light distribution pattern complying with road traffic rules or the like, a light blocking plate needs to be disposed with high accuracy relative to a focal position of a projection lens. In the optical system configuration of Patent Literature 1, to form the cutoff line, high accuracy of placement of the light blocking plate relative to the projection lens is required. Typically, downsizing the optical system increases the accuracy required for placement of the reflector, light blocking plate, and projection lens. These reduce the manufacturability of the headlight device. Downsizing the headlight device further reduces the manufacturability.

Thus, the optical system configuration of Patent Literature 1 has a problem in that the manufacturability is low. For this problem, the present application can improve manufacturability.

"Headlight device" refers to an illuminating device that is mounted on a transportation machine or the like and used to improve visibility for an operator and conspicuity to the outside. A vehicle headlight device is also referred to as a headlamp or headlight.

Further, recently, from the viewpoint of reducing the burden on the environment, such as reducing emission of carbon dioxide (CM and consumption of fuel, it is desired to improve the energy efficiency of vehicles, for example. Accordingly, in vehicle headlight devices, downsizing, weight reduction, and improvement in power efficiency are required. Thus, it is desired to employ, as a light source of a vehicle headlight device, a semiconductor light source having higher luminous efficiency than conventional halogen bulbs (lamp light sources).

"Semiconductor light source" refers to, for example, a light emitting diode (LED), laser diode (LD), or the like.

Conventional lamp light sources (bulb light sources) are light sources having lower directivity than semiconductor light sources. Lamp light sources include an incandescent lamp, a halogen lamp, a fluorescent lamp, and the like. Thus, a lamp light source uses a reflector (e.g., a reflecting mirror) to provide directivity to the emitted light. On the other hand, a semiconductor light source has at least one light emitting surface and emits light to the light emitting surface side.

As such, a semiconductor light source is different from a lamp light source in light emitting characteristics, and thus it is desirable to use an optical system suitable for a semiconductor light source instead of a conventional optical system using a reflecting mirror.

The above-described semiconductor light source is a type of solid-state light sources. Solid-state light sources include, for example, an organic electroluminescence (organic EL) light source, a light source that irradiates phosphor applied on a plane with excitation light to cause the phosphor to emit light, and the like. Also, for these solid-state light sources, it is desirable to use optical systems similar to those for the semiconductor light sources.

Excluding bulb light sources, light sources having directivity are referred to as "solid-state light sources."

"Directivity" refers to a property that the intensity of light or the like emitted into space depends on direction. "Having directivity" here indicates that light travels to the light emitting surface side and does not travel to the side opposite to the light emitting surface, as described above. It indicates that the divergence angle of light emitted from the light source is 180 degrees or less.

Light sources described in the following embodiments are described as light sources (solid-state light sources) having directivity. As described above, the main examples thereof are semiconductor light sources, such as light emitting diodes or laser diodes. The light sources also include organic electroluminescence light sources, light sources that irradiate phosphor applied on planes with excitation light to cause the phosphor to emit light, and the like.

The reason why solid-state light sources are exemplarily employed in the embodiments is because the use of a bulb light source makes it difficult to meet the demand for improvement in energy efficiency or the demand for downsizing of the device. However, if there is no demand for improvement in energy efficiency, the light sources may be bulb light sources.

Thus, bulb light sources, such as incandescent lamps, halogen lamps, or fluorescent lamps may be used as light sources of the present invention. Also, semiconductor light sources, such as light emitting diodes (LEDs) or laser diodes (LDs) may be used as the light sources of the present invention. The light sources of the present invention are not limited to specific ones and may be any light sources.

However, from the viewpoint of reducing the burden on the environment, such as reducing emission of carbon dioxide ($CO_2$) and consumption of fuel, it is desirable to employ a semiconductor light source as a light source of a headlight device. It is desirable to employ a solid-state light source as a light source of a headlight device. A semiconductor light source has higher luminous efficiency than a conventional halogen bulb (lamp light source).

Also, from the viewpoint of downsizing or weight reduction, it is desirable to employ a semiconductor light source. A semiconductor light source has higher directivity than a conventional halogen bulb (lamp light source), and allows downsizing or weight reduction of the optical system. Likewise, it is desirable to employ a solid-state light source as a light source of a headlight device.

Thus, in the following description of the present invention, the light sources are described as LEDs, which are a type of semiconductor light sources.

In a light emitting diode, the shape of a light emitting surface is typically a square shape or a circular shape. Thus, if a light source image is formed by a convex lens, the boundary of the shape of the light emitting surface is directly projected by the projection lens, and light distribution unevenness occurs when the light distribution pattern is formed.

As described later, for example, the light distribution unevenness can be reduced by folding and superposing part of a light source image by means of a reflecting surface or the like. Also, the light distribution unevenness can be reduced by displacing a focal point of a lens surface for projecting a light source image, from the light source image in an optical axis direction.

"Light distribution" refers to a luminous intensity distribution of a light source with respect to space. It refers to a spatial distribution of light emitted from a light source. The light distribution indicates in which direction and how strongly light is emitted from a light source.

"Light distribution pattern" refers to the shape of a light beam and an intensity distribution (luminous intensity distribution) of light due to the direction of light emitted from a light source. "Light distribution pattern" will also be used to mean an illuminance pattern on an irradiated surface 9 to be described below. Thus, it indicates the shape of an area irradiated with light on the irradiated surface 9 and an illuminance distribution. "Light distribution" refers to an intensity distribution (luminous intensity distribution) of light emitted from a light source with respect to the direction of the light. "Light distribution" will also be used to mean an illuminance distribution on the irradiated surface 9 to be described below.

When a light distribution pattern is described as an illuminance distribution, the brightest region is referred to as the "high illuminance region." On the other hand, when a light distribution pattern is considered as a luminous intensity distribution, the brightest region in the light distribution pattern is the "high luminous intensity region."

"Luminous intensity" indicates the degree of intensity of light emitted by a luminous body and is obtained by dividing a luminous flux passing through a small solid angle in a given direction by the small solid angle. "Luminous intensity" refers to a physical quantity indicating how strong light emitted from a light source is.

"Illuminance" refers to a physical quantity indicating the brightness of light radiated to a planar object. It is equal to a luminous flux radiated per unit area.

The irradiated surface 9 is a virtual surface defined at a predetermined position in front of a vehicle. The irradiated surface 9 is, for example, a surface parallel to an X-Y plane to be described later. The predetermined position in front of the vehicle is a position at which the luminous intensity or illuminance of a headlight device is measured, and is specified in road traffic rules or the like. For example, in Europe, United Nations Economic Commission for Europe (UN-ECE) specifies a position 25 m from a light source as the position at which the luminous intensity of an automobile headlight device is measured. In Japan, Japanese Industrial Standards Committee (JIS) specifies a position 10 m from a light source as the position at which the luminous intensity is measured.

The present invention is applicable to the low beam and high beam or the like of a headlight device for a vehicle. The present invention is also applicable to the low beam and high beam or the like of a motorcycle headlight device. The present invention is also applicable to headlight devices for other vehicles, such as three-wheelers, four-wheelers. The present invention is also applicable to the low beam of a headlight device for a motor tricycle or the low beam of a headlight device for a four-wheeled automobile.

However, in the following description, a case where a light distribution pattern of the low beam of a headlight device for a motorcycle is formed will be described as an example. The light distribution pattern of the low beam of the headlight device for a motorcycle has a cutoff line that is a straight line parallel to the left-right direction (X axis direction) of the vehicle. Further, it is brightest at a region on the lower side of the cutoff line (inside the light distribution pattern).

The four-wheelers are, for example, typical four-wheeled automobiles or the like. The three-wheelers include, for example, a motor tricycle called a gyro. "Motor tricycle called a gyro" refers to a scooter with three wheels including one front wheel and two rear wheels about one axis. In Japan, the motor tricycle corresponds to, for example, a motorbike. The motor tricycle has a rotational axis near the center of the vehicle body and allows most of the vehicle body including the front wheel and a driver seat to be tilted in the left-right direction, for example. With this mechanism, the motor tricycle can move the center of gravity inward during turning, similarly to a motorcycle, for example.

Examples of embodiments of the present invention will be described below with reference to the drawings. In the following description of the embodiments, XYZ coordinates will be used to facilitate explanation.

It will be assumed that a left-right direction of a vehicle is the X axis direction; the left direction with respect to a forward direction of the vehicle is the +X axis direction; the right direction with respect to the forward direction of the vehicle is the −X axis direction. Here, "forward direction" refers to a traveling direction of the vehicle. Thus, "forward direction" refers to a direction in which the headlight device radiates light.

It will be assumed that an up-down direction of the vehicle is the Y axis direction; the upward direction is the +Y axis direction; the downward direction is the −Y axis direction. The "upward direction" is a direction toward the sky; the "downward direction" is a direction toward the ground (road surface or the like).

It will be assumed that the traveling direction of the vehicle is the Z axis direction; the traveling direction is the +Z axis direction; the opposite direction is the −Z axis direction. The +Z axis direction will be referred to as the "forward direction"; the −Z axis direction will be referred to as the "backward direction." Thus, the +Z axis direction is the direction in which the headlight device radiates light.

As described above, in the following embodiments, a Z-X plane is a plane parallel to a road surface. This is because the road surface is usually considered to be a "horizontal plane."

Thus, a Z-X plane is considered as a "horizontal plane." "Horizontal plane" refers to a plane perpendicular to the direction of gravity.

However, the road surface may be inclined with respect to the traveling direction of the vehicle. Specifically, it is an uphill, a downhill, or the like. In these cases, the "horizontal plane" is considered as a plane parallel to the road surface. Thus, the "horizontal plane" is not a plane perpendicular to the direction of gravity.

On the other hand, a typical road surface is seldom inclined in the left-right direction with respect to the traveling direction of the vehicle. "Left-right direction" refers to a width direction of a road. In these cases, the "horizontal plane" is considered as a plane perpendicular to the direction of gravity. For example, even if a road surface is inclined in the left-right direction and the vehicle is upright with respect to the left-right direction of the road surface, this is considered to be equivalent to a state in which the vehicle is tilted with respect to the "horizontal plane" in the left-right direction.

To simplify explanation, the following description will be made on the assumption that the "horizontal plane" is a plane perpendicular to the direction of gravity. That is, the description will be made on the assumption that a Z-X plane is a plane perpendicular to the direction of gravity.

First Embodiment

Figure 1B:
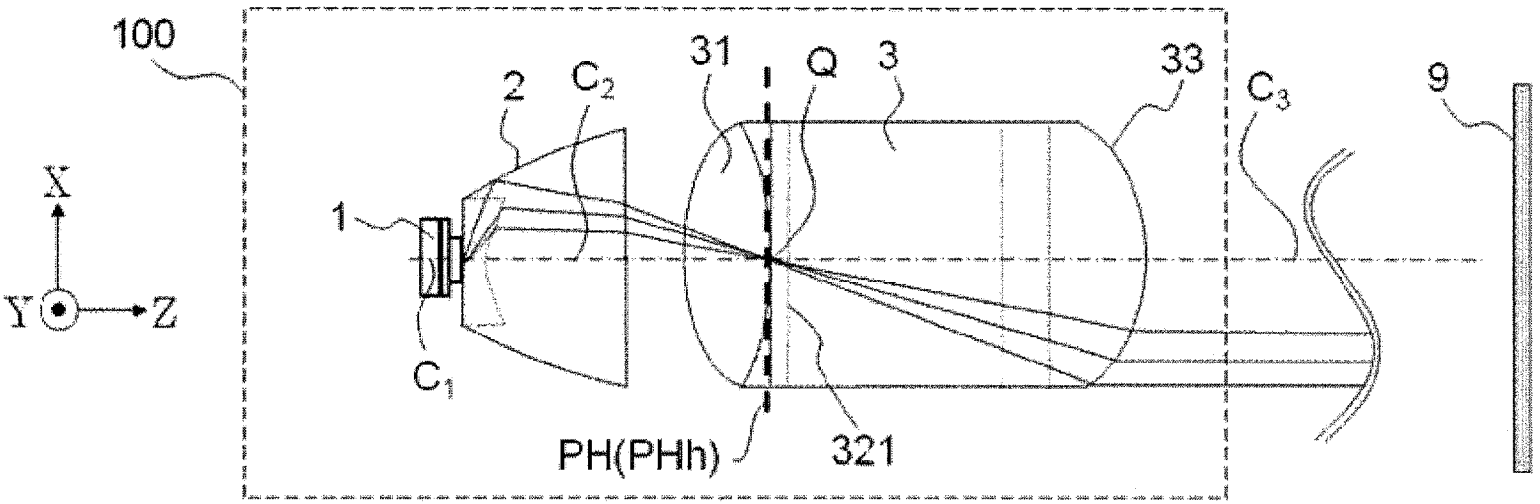

FIGS. 1A and 1B are configuration diagrams illustrating a configuration of a headlight module 100 according to a first embodiment. FIG. 1A is a view from the right side (−X axis direction) with respect to the forward direction of the vehicle. FIG. 1B is a view from the top (+Y axis direction).

As illustrated in FIGS. 1A and 1B, the headlight module 100 according to the first embodiment includes a light source 1 and a light guide projection optical element 3. The headlight module 100 according to the first embodiment may include a condensing optical element 2. In the headlight module 100, the condensing optical element 2 may be mounted to the light source 1 to form a unit.

The light source 1 and condensing optical element 2 are disposed with their optical axes $C_1$ and $C_2$ inclined in the −Y axis direction by an angle a. "With their optical axes inclined in the −Y axis direction" indicates that when viewed from the −X axis direction, the optical axes parallel to the Z axis are rotated clockwise about the X axis.

To facilitate explanation of the light source 1 and condensing optical element 2, $X_1Y_1Z_1$ coordinates will be used as a new coordinate system. The $X_1Y_1Z_1$ coordinates are coordinates obtained by rotating the XYZ coordinates clockwise about the X axis by the angle a as viewed from the −X axis direction.

In the first embodiment, the optical axis $C_1$ of the light source 1 is parallel to the $Z_1$ axis. The optical axis $C_2$ of the condensing optical element 2 is also parallel to the $Z_1$ axis. The optical axis $C_2$ of the condensing optical element 2 also coincides with the optical axis $C_1$ of the light source 1.

<Light Source 1>

The light source 1 has a light emitting surface 11. The light source 1 emits light for providing illumination ahead of the vehicle from the light emitting surface 11. The light source 1 emits light from the light emitting surface 11.

The light source 1 is located on the $-Z_1$ axis side of the condensing optical element 2. The light source 1 is located on the −Z axis side (in back) of the light guide projection optical element 3. The light source 1 is located on the +Y axis side (upper side) of the light guide projection optical element 3.

In FIGS. 1A and 1B, the light source 1 emits the light in the $+Z_1$ axis direction. The light source 1 may be of any type, but the following description will be made on the assumption that the light source 1 is an LED, as described above.

The optical axis $C_1$ of the light source 1 extends perpendicular to the light emitting surface 11 from a center of the light emitting surface 11.

<Condensing Optical Element 2>

The condensing optical element 2 is located on the $+Z_1$ axis side of the light source 1. The condensing optical element 2 is also located on the $-Z_1$ axis side of the light guide projection optical element 3. The condensing optical element 2 is located on the −Z axis side (in back) of the light guide projection optical element 3. The condensing optical element 2 is located on the +Y axis side (upper side) of the light guide projection optical element 3.

The condensing optical element 2 receives the light emitted from the light source 1. The condensing optical element 2 concentrates the light at an arbitrary position in the forward direction ($+Z_1$ axis direction). The condensing optical element 2 concentrates the light. The condensing optical element 2 is an optical element having a condensing function. The light concentration position of the condensing optical element 2 will be described with reference to FIGS. 3 and 44A and 4B.

In the following embodiments, as an example, the condensing optical element 2 is a lens. This lens concentrates the light using refraction and reflection. The same applies to a condensing optical element 5 to be described later.

When an incident surface 31, to be described later, of the light guide projection optical element 3 has a condensing function, the condensing optical element 2 may be omitted. When the headlight module 100 is not provided with the condensing optical element 32, the light guide projection optical element 3 receives the light emitted from the light source 1. The light emitted from the light source 1 enters through the incident surface 31.

In FIGS. 1A and 1B, the condensing optical element 2 is illustrated as an optical element having positive power.

The inside of the condensing optical element 2 described in the first embodiment is filled with refractive material, for example.

In FIGS. 1A and 1B, the condensing optical element 2 consists of a single optical element, but may use multiple optical elements. However, use of multiple optical elements reduces the manufacturability due to reasons, such as ensuring the accuracy of positioning of each optical element.

The light source 1 and condensing optical element 2 are disposed above (on the +Y axis direction side of) the light guide projection optical element 3. The light source 1 and condensing optical element 2 are also disposed in back (−Z axis direction side) of the light guide projection optical element 3.

With respect to a reflecting surface 32, the light source 1 and condensing optical element 2 are located on a light reflecting side of the reflecting surface 32. That is, with respect to the reflecting surface 32, the light source 1 and condensing optical element 2 are located on a front surface side of the reflecting surface 32.

The "front surface of the reflecting surface" is a surface for reflecting light. A "back surface of the reflecting surface" is a surface opposite the front surface and is, for example, a surface that does not reflect light.

With respect to the reflecting surface 32, the light source 1 and condensing lens 2 are located in a normal direction of the reflecting surface 32 and on the front surface side of the reflecting surface 32. The condensing optical element 2 is disposed to face the reflecting surface 32. The reflecting surface 32 is a surface provided in the light guide projection optical element 3.

In FIGS. 1A and 1B, the optical axis $C_1$ of the light source 1 coincides with the optical axis $C_2$ of the condensing optical element 2. The optical axes $C_1$ and $C_2$ of the light source 1 and condensing optical element 2 have an intersection on the reflecting surface 32. When light is refracted at the incident surface 31, a central light ray emitted from the condensing optical element 2 reaches the reflecting surface 32. That is, the optical axis or central light ray of the condensing optical element 2 has an intersection on the reflecting surface 32.

The central right ray emitted from the condensing optical element 2 is a light ray on the optical axis $C_2$ of the condensing optical element 2.

The condensing optical element 2 has, for example, incident surfaces 211 and 212, a reflecting surface 22, emitting surfaces 231 and 232.

The condensing optical element 2 is disposed immediately after the light source 1. "After" here refers to a side toward which the light emitted from the light source 1 travels. Here, "immediately after" indicates that the light emitted from the light emitting surface 11 is directly incident on the condensing optical element 2.

A light emitting diode emits light with a Lambertian light distribution. "Lambertian light distribution" refers to a light distribution in which the luminance of a light emitting surface is constant regardless of the viewing direction. The directivity of light distribution of a light emitting diode is wide. Thus, by reducing the distance between the light source 1 and the condensing optical element 2, it is possible to increase the amount of light incident on the condensing optical element 2.

The condensing optical element 2 is made of, for example, transparent resin, glass, or silicone. The material of the condensing optical element 2 may be any material having transparency, and may be transparent resin or the like. "Transparency" refers to the property of being transparent. However, from the viewpoint of light use efficiency, materials having high transparency are appropriate as the material of the condensing optical element 2. Further, since the condensing optical element 2 is disposed immediately after the light source 1, the material of the condensing optical element 2 preferably has excellent heat resistance.

The incident surface 211 is an incident surface formed at a central part of the condensing optical element 2. "A central part of the condensing lens 2" indicates that the optical axis $C_2$ of the condensing optical element 2 has an intersection on the incident surface 211.

The incident surface 211 has, for example, positive power. The incident surface 211 has, for example, a convex shape. The convex shape of the incident surface 211 is a shape projecting in the $-Z_1$ axis direction. The power is also referred to as the "refractive power." The incident surface 211 has, for example, a shape rotationally symmetric about the optical axis $C_2$.

The incident surface 212 has, for example, a shape that is a part of the surface shape of a solid of revolution obtained by rotating an ellipse about its major or minor axis. A solid of revolution obtained by rotating an ellipse about its major or minor axis is referred to as a "spheroid." The rotational axis of the spheroid coincides with the optical axis $C_2$. The incident surface 212 has a surface shape obtained by cutting off both ends of the spheroid in the direction of the rotational axis. Thus, the incident surface 212 has a tubular shape.

The incident surface 212 need not necessarily be rotationally symmetric, as described later. For example, the incident surface 212 has, for example, an ellipsoidal shape. The incident surface 212 has an elliptical surface shape. An elliptical surface is a quadric surface whose section taken in any plane parallel to any of three coordinate planes is an ellipse.

One end (end on the $+Z_1$ axis direction side) of the tubular shape of the incident surface 212 is connected to the outer periphery of the incident surface 211. The tubular shape of the incident surface 212 is formed on the light source 1 side ($-Z_1$ axis side) of the incident surface 211. The tubular shape of the incident surface 212 is formed on the light source 1 side of the incident surface 211.

The reflecting surface 22 has a tubular shape whose cross-sectional shape in an $X_1$-$Y_1$ plane is, for example, a circular shape centered on the optical axis $C_2$. In the tubular shape of the reflecting surface 22, the diameter of the circular shape in the $X_1$-$Y_1$ plane at the end on the $-Z_1$ axis direction side is smaller than the diameter of the circular shape in the $X_1$-$Y_1$ plane at the end on the $+Z_1$ axis direction side. The diameter of the reflecting surface 22 increases in the $+Z_1$ axis direction.

The reflecting surface 22 has, for example, the shape of the side surface of a circular truncated cone. The shape of the side surface of the circular truncated cone in a plane including a central axis is a linear shape. However, the shape of the reflecting surface 22 in a plane including the optical axis $C_2$ may be a curved line shape. "Plane including the optical axis $C_2$" indicates that the line of the optical axis $C_2$ can be drawn on the plane.

One end (end on the $-Z_1$ axis direction side) of the tubular shape of the reflecting surface 22 is connected to the other end (end on the $-Z_1$ axis direction side) of the tubular shape of the incident surface 212. The reflecting surface 22 is located on the outer peripheral side of the incident surface 212.

The emitting surface 231 is located on the +Z axis direction side of the incident surface 211. The emitting surface 231 has, for example, positive power. The emitting surface 231 has, for example, a convex shape. The convex shape of the emitting surface 231 is a shape projecting in the +Z axis direction. The optical axis $C_2$ of the condensing optical element 2 has an intersection on the emitting surface 231. The emitting surface 231 has, for example, a shape rotationally symmetric about the optical axis $C_2$.

The emitting surface 231 may be a toroidal surface. Also, the incident surface 211 may be a toroidal surface. Toroidal surfaces include cylindrical surfaces.

The emitting surface 232 is located on the outer peripheral side of the emitting surface 231. The emitting surface 232 has, for example, a planar shape parallel to an $X_1$-$Y_1$ plane. An inner periphery and an outer periphery of the emitting surface 232 have circular shapes.

The inner periphery of the emitting surface 232 is connected to an outer periphery of the emitting surface 231. The outer periphery of the emitting surface 232 is connected to the other end (end on the $+Z_1$ axis direction side) of the tubular shape of the reflecting surface 22.

In the light emitted from the light emitting surface 11, light rays having small emission angles are incident on the incident surface 211. The light rays having small emission angles have, for example, a divergence angle of 60 degrees or less. The light rays having small emission angles enter through the incident surface 211 and are emitted from the emitting surface 231.

The light rays with small emission angles emitted from the emitting surface 231 are concentrated at an arbitrary position in front ($+Z_1$ axis direction) of the condensing optical element 2. The light rays emitted from the emitting surface 231 are concentrated. The light rays emitted from the light source 1 at small emission angles are concentrated by refractions at the incident surface 211 and emitting surface 231. Refraction of light is used for concentration of the light rays emitted from the light source 1 at small emission angles. As described above, the light concentration position will be described later.

In the light emitted from the light emitting surface 11, light rays having large emission angles are incident on the incident surface 212. The light rays having large emission angles have, for example, a divergence angle greater than 60 degrees. The light rays incident on the incident surface 212 are reflected by the reflecting surface 22. The light rays reflected by the reflecting surface 22 travel in the $+Z_1$ axis direction. The light rays reflected by the reflecting surface 22 are emitted from the emitting surface 232.

The light rays with large emission angles emitted from the emitting surface 232 are concentrated at an arbitrary position in front ($+Z_1$ axis direction) of the condensing optical element 2. The light rays emitted from the emitting surface 232 are concentrated. The light rays emitted from the light source 1 at large emission angles are concentrated by reflection at the reflecting surface 22. Reflection of light is used for concentration of light rays emitted from the light source 1 at large emission angles. As described above, the light concentration position will be described later.

In each of the following embodiments, as an example, the condensing optical element 2 will be described as an optical element having the following functions. The condensing optical element 2 concentrates, due to refraction, light rays emitted from the light source 1 at small emission angles. The condensing optical element 2 concentrates, due to reflection, light rays emitted from the light source 1 at large emission angles.

For example, at the light concentration position of the light emitted from the emitting surface 231, an image similar to a pattern of the light source 1 (the shape of the light emitting surface 11) is formed. Thus, projection of the shape of the light emitting surface 11 of the light source 1 by an emitting surface 33 may cause light distribution unevenness.

In such a case, by making the light concentration position of the light emitted from the emitting surface 232 different from the light concentration position of the light emitted from the emitting surface 231 as described above, it becomes possible to reduce the light distribution unevenness due to the light emitted from the emitting surface 231.

The light concentration position of the light rays emitted from the emitting surface 232 and the light concentration position of the light rays emitted from the emitting surface 231 need not coincide with each other. For example, the light concentration position of the light emitted from the emitting surface 232 may be closer to the condensing optical element 2 than the light concentration position of the light emitted from the emitting surface 231.

Further, by making the position of a conjugate plane PC different from a light concentration position PH of light emitted from the condensing optical element 2, it becomes possible to reduce the light distribution unevenness due to the light emitted from the emitting surface 231.

Further, for example, the light emitting surface 11 of the LED typically has a rectangle shape or a circular shape. The light distribution pattern has a horizontally long shape narrow in the up-down direction, as described above. A high beam for a vehicle may have a light distribution pattern having a circular shape. Thus, it is possible to form a light distribution pattern using the shape of the light emitting surface 11 of the light source 1.

For example, it is possible to form an intermediate image based on the shape of the light emitting surface 11 by means of the condensing optical element 2 and project the intermediate image. In FIGS. 1A and 1B, an image of the light emitting surface 11 is formed at the light concentration position PH. In the image of the light emitting surface 11 formed at the light concentration position PH, an image on the $+Y_1$ axis direction side of a center of the light emitting surface 11 is folded by the reflecting surface 32 and superposed on an image on the $-Y_1$ axis direction side of the center of the light emitting surface 11. As such, the image of the light emitting surface 11 includes an image obtained by performing deformation or the like on the shape of the light emitting surface 11.

Further, by making the position of the conjugate plane PC different from the position of the image of the light emitting surface 11 formed in this manner, it becomes possible to reduce the light distribution unevenness due to the light emitted from the emitting surface 231.

In the first embodiment, each of the incident surfaces 211 and 212, reflecting surface 22, and emitting surfaces 231 and 232 of the condensing optical element 2 has a shape rotationally symmetric about the optical axis $C_2$. However, the shapes are not limited to rotationally symmetric shapes as long as the condensing optical element 2 can concentrate the light emitted from the light source 1.

For example, by changing the cross-sectional shape of the reflecting surface 22 in an $X_1$-$Y_1$ plane to an elliptical shape, it is possible to form a light concentration spot at the light concentration position into an elliptical shape. This facilitates formation of a wide light distribution pattern by the headlight module 100.

Also when the shape of the light emitting surface 11 of the light source 1 is a rectangular shape, the condensing optical element 2 can be downsized by changing the cross-sectional shape of the reflecting surface 22 in an $X_1$-$Y_1$ plane to an elliptical shape, for example.

Further, it is sufficient that the condensing optical element 2 totally have positive power. Each of the incident surfaces 211 and 212, reflecting surface 22, and emitting surfaces 231 and 232 may have any power.

When the light is concentrated by the combination of the condensing optical element 2 and incident surface 31, it is sufficient that the condensing optical element 2 and incident surface 31 have positive power in total.

As described above, when a bulb light source is employed as the light source 1, a reflector or the like may be used as a condensing optical element. The reflector is, for example, a reflecting mirror or the like.

In the description of the shape of the condensing optical element 2, as an example, it has been described that the incident surface 211, 212, reflecting surface 22, or emitting surface 231, 232 is connected to the adjacent surface or surfaces. However, the surfaces need not necessarily be connected to each other. For example, "one end (end on the $+Z_1$ axis direction side) of the tubular shape of the incident surface 212 is connected to the outer periphery of the incident surface 211" can be replaced with "one end (end on the $+Z_1$ axis direction side) of the tubular shape of the incident surface 212 is located on the outer peripheral side of the incident surface 211." It is sufficient that the incident light be guided to the light guide projection optical element 3 due to the positional relationship between the surfaces.

<Light Guide Projection Optical Element 3>

The light guide projection optical element 3 is located on the $+Z_1$ axis side of the condensing optical element 2. The light guide projection optical element 3 is located on the +Z axis side of the condensing optical element 2. The light guide projection optical element 3 is located on the −Y axis side of the condensing optical element 2.

The light guide projection optical element 3 receives light emitted from the condensing optical element 2. The light guide projection optical element 3 emits the light in the forward direction (+Z axis direction).

When the headlight module 100 is not provided with the condensing optical element 2, the light guide projection optical element 3 receives light emitted from the light source 1. The light guide projection optical element 3 emits the light in the forward direction (+Z axis direction).

The light guide projection optical element 3 is an example of an optical element. The light guide projection optical element 3 has a function of guiding light by means of the reflecting surface 32 and a reflecting surface 35. The light guide projection optical element 3 also has a function of projecting light from the emitting surface 33 and an emitting surface 36. To facilitate understanding, the optical element 3 will be described as the light guide projection optical element 3.

"Project" refers to emitting light. "Project" also refers to causing an image to appear. When the light guide projection optical element 3 projects a light distribution pattern to be described later, the light guide projection optical element 3 can also be referred to as the light guide projection optical element. Projection optical elements 350 to be described later can also be referred to as projection optical elements since they project light distribution patterns.

In FIGS. 1A and 1B, the emitting surface 33 projects a light distribution pattern. The emitting surface 33 is a projection optical portion for projecting a light distribution pattern. The emitting surface 33 can also be referred to as a projection optical portion for projecting a light distribution pattern. When a projection optical element 350 is provided as described later, the projection optical element 350 is a projection optical portion (projection optical portion) for projecting a light distribution pattern. When the light distribution pattern is projected by the emitting surface 33 and projection optical element 350, the emitting surface 33 and projection optical element 350 are a projection optical portion (projection optical portion) for projecting a light distribution pattern. The projection optical portion is also referred to as a projection portion.

Figure 2:
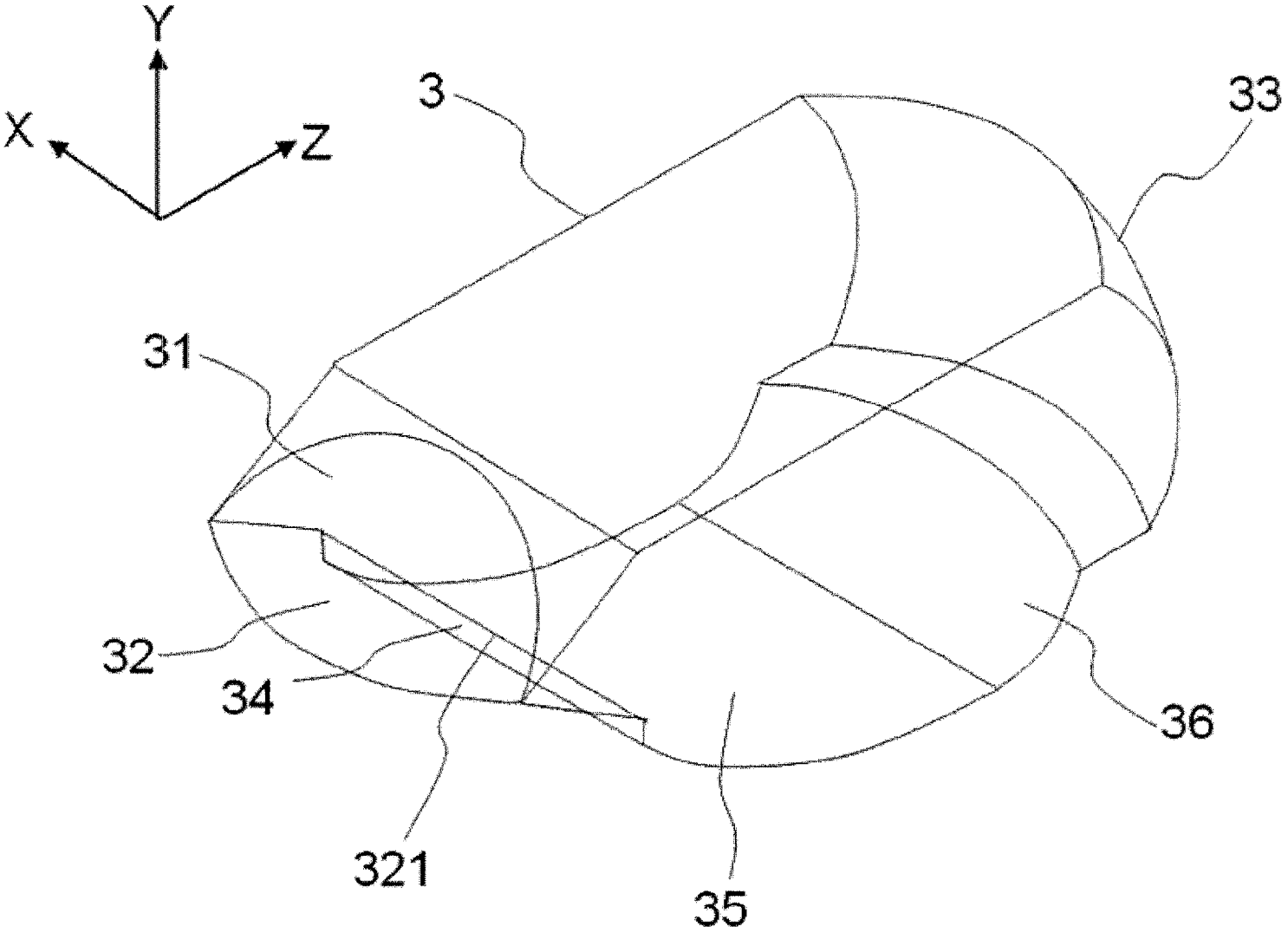
FIG. 2 is a perspective view of a light guide projection optical element 3 of the headlight module 100 according to the first embodiment.

FIG. 2 is a perspective view of the light guide projection optical element 3. The light guide projection optical element 3 includes the reflecting surfaces 32 and 35. The light guide projection optical element 3 may include the emitting surface 33. The light guide projection optical element 3 may include the emitting surface 36. The light guide projection optical element 3 may include the incident surface 31. The light guide projection optical element 3 may include an incident surface 34.

The light guide projection optical element 3 is made of, for example, transparent resin, glass, silicone, or the like.

The inside of the light guide projection optical element 3 described in the first embodiment is filled with refractive material, for example.

The incident surface 31 is provided at an end portion on the −Z axis direction side of the light guide projection optical element 3. The incident surface 31 is provided on a portion on the +Y axis direction side of the light guide projection optical element 3.

In FIGS. 1A, 1B, and 2, the incident surface 31 of the light guide projection optical element 3 has a curved surface shape. The curved surface shape of the incident surface 31 is, for example, a convex shape having positive power in both the horizontal direction (X axis direction) and vertical direction (Y axis direction).

In the horizontal direction (X axis direction), the incident surface 31 has positive power. In the horizontal direction (X axis direction), the incident surface 31 has a convex shape. In the vertical direction (Y axis direction), the incident surface 31 has positive power. In the vertical direction (Y axis direction), the incident surface 31 has a convex shape.

When light is concentrated by the combination of the condensing optical element 2 and incident surface 31 as described above, the curved surface shape of the incident surface 31 may be a concave shape.

By setting the curvature of the incident surface 31 in the Y axis direction and the curvature of the incident surface 31 in the X axis direction to different values, it is possible to locate a focal position of the incident surface 31 on a Y-Z plane and a focal position of the incident surface 31 on a Z-X plane at different positions.

Further, it is possible that the power of the incident surface 31 in the Y axis direction is positive, and the power of the incident surface 31 in the X axis direction is negative.

When light is incident on the incident surface 31 having the curved surface shape, the divergence angle of the light changes. The incident surface 31 can form a light distribution pattern by changing the divergence angle of the light. The incident surface 31 has a function of forming the shape of the light distribution pattern. The incident surface 31 functions as a light distribution pattern shape forming portion.

Further, for example, by providing the incident surface 31 with a light condensing function, the condensing optical element 2 can be omitted. The incident surface 31 functions as a light condensing portion.

The incident surface 31 can be considered as an example of a light distribution pattern shape forming portion. The incident surface 31 can also be considered as an example of a light condensing portion.

However, the shape of the incident surface 31 is not limited to a curved surface shape, and may be, for example, a planar shape.

The first embodiment first describes a case where the shape of the incident surface 31 of the light guide projection optical element 3 is a convex shape having positive power.

The reflecting surface 32 is disposed at an end portion on the −Y axis direction side of the incident surface 31. The reflecting surface 32 is located on the −Y axis direction side of the incident surface 31. The reflecting surface 32 is located on the +Z axis direction side of the incident surface 31. In the first embodiment, an end portion on the −Z axis direction side of the reflecting surface 32 is connected to an end portion on the −Y axis direction side of the incident surface 31.

The reflecting surface 32 reflects light reaching the reflecting surface 32. The reflecting surface 32 has a function of reflecting light. The reflecting surface 32 functions as a light reflecting portion. The reflecting surface 32 is an example of the light reflecting portion.

The reflecting surface 32 is a surface facing in the +Y axis direction. A front surface of the reflecting surface 32 is a surface facing in the +Y axis direction. The front surface of the reflecting surface 32 is a surface for reflecting light. A back surface of the reflecting surface 32 is a surface facing in the −Y axis direction. In the first embodiment, for example, the back surface of the reflecting surface 32 does not reflect light.

The reflecting surface 32 is a surface rotated clockwise about an axis parallel to the X axis with respect to a Z-X plane, as viewed from the −X axis direction. In FIGS. 1A and 1B, the reflecting surface 32 is a surface rotated by an angle b with respect to the Z-X plane.

However, the reflecting surface 32 may be a surface parallel to a Z-X plane.

In FIGS. 1A and 1B, the reflecting surface 32 is illustrated as a flat surface. However, the reflecting surface 32 need not be a flat surface. The reflecting surface 32 may have a curved surface shape. The reflecting surface 32 may be a curved surface having curvature only in the Y axis direction. The reflecting surface 32 may be a curved surface having curvature only in the Z axis direction. The reflecting surface 32 may be a curved surface having curvature only in the X axis direction. The reflecting surface 32 may be a curved surface having curvature in both the X axis direction and the Y axis direction. The reflecting surface 32 may be a curved surface having curvature in both the X axis direction and the Z axis direction.

For example, when a plane perpendicular to the reflecting surface 32 having a curved surface shape is considered, the reflecting surface 32 can be considered as a flat surface approximating the curved surface. A plane parallel to an optical axis $C_3$ and perpendicular to the reflecting surface 32 is, for example, a plane parallel to the optical axis $C_3$ and perpendicular to a flat surface approximating the curved surface of the reflecting surface 32. For example, the least squares method or the like may be used for approximation of the curved surface.

In FIGS. 1A and 1B, the reflecting surface 32 is illustrated as a flat surface. Thus, a plane parallel to the optical axis $C_3$ and perpendicular to the reflecting surface 32 is a Y-Z plane. A plane including the optical axis $C_3$ and perpendicular to the reflecting surface 32 is parallel to a Y-Z plane. A plane perpendicular to this plane (the Y-Z plane) and parallel to the optical axis $C_3$ is a Z-X plane. A plane including the optical axis $C_3$ and perpendicular to this plane (the Y-Z plane) is parallel to a Z-X plane.

For example, when the reflecting surface 32 is a cylindrical surface having curvature only in a Y-Z plane, a Y-Z plane, which is a plane perpendicular to the X axis, is the plane parallel to the optical axis $C_3$ and perpendicular to the reflecting surface 32.

"Having curvature only in a Y-Z plane" refers to having curvature in the Z axis direction; or "having curvature only in a Y-Z plane" refers to having curvature in the Y axis direction.

For example, when the reflecting surface 32 is a cylindrical surface having curvature only in an X-Y plane, the reflecting surface 32 is considered as a flat surface approximating the curved surface. A plane parallel to the optical axis $C_3$ and perpendicular to the reflecting surface 32 is a plane parallel to the optical axis $C_3$ and perpendicular to the flat surface approximating the curved surface of the reflecting surface 32.

Also, when the reflecting surface 32 is a toroidal surface, the reflecting surface 32 is considered as a flat surface approximating the curved surface. A toroidal surface is a surface having different curvatures in two orthogonal axial directions, like a surface of a barrel or a surface of a doughnut. Toroidal surfaces include cylindrical surfaces.

"Having curvature in a Y-Z plane" refers to, for example, viewing the shape of a section of the reflecting surface 32 taken in a plane parallel to a Y-Z plane. "Having curvature in a Y-Z plane" also refers to, for example, viewing the shape of the reflecting surface 32 with a Y-Z plane as a projection plane. The same applies to "having curvature only in an X-Y plane."

The reflecting surface 32 may be a mirror surface obtained by mirror deposition. However, the reflecting surface 32 desirably functions as a total reflection surface, without mirror deposition. This is because a total reflection surface is higher in reflectance than a mirror surface, contributing to improvement in light use efficiency. Further, elimination of the step of mirror deposition can simplify the manufacturing process of the light guide projection optical element 3, contributing to reduction in the manufacturing cost of the light guide projection optical element 3. In particular, the configuration illustrated in the first embodiment has the feature that the incident angles of light rays on the reflecting surface 32 are shallow, thus allowing the reflecting surface 32 to be used as a total reflection surface, without mirror deposition. "Incident angles are shallow" indicates that the incident angles are great. The "incident angles" are angles formed by the incident directions of the incident light rays and the normal to the boundary surface.

The incident surface 34 is, for example, a surface parallel to an X-Y plane. However, the incident surface 34 may have a curved surface shape. By changing the shape of the incident surface 34 to a curved surface shape, it is possible to change the light distribution of incident light. The incident surface 34 may be, for example, a surface inclined with respect to an X-Y plane.

The incident surface 34 is located on the −Y axis direction side of the reflecting surface 32. The incident surface 34 is located on the back surface side of the reflecting surface 32. In FIGS. 1A and 1B, an end portion on the +Y axis direction side of the incident surface 34 is connected to an end portion on the +Z axis direction side of the reflecting surface 32. However, the end portion on the +Y axis direction side of the incident surface 34 need not necessarily be connected to the end portion on the +Z axis direction side of the reflecting surface 32.

In FIGS. 1A and 1B, the incident surface 34 is located at a position optically conjugate to the irradiated surface 9. "Optically conjugate" refers to a relation in which light emitted from one point is imaged at another point. The shape of light on the incident surface 34 and conjugate plane PC extending from the incident surface 34 is projected onto the irradiated surface 9. In FIGS. 1A and 1B, no light enters through the incident surface 34. Thus, the shape of light entering through the incident surface 31 on the conjugate plane PC is projected onto the irradiated surface 9.

The image (light distribution pattern) of light on the conjugate plane PC is formed on a part of the conjugate plane PC in the light guide projection optical element 3. A light distribution pattern can be formed within the conjugate plane PC in the light guide projection optical element 3 into a shape appropriate for the headlight module 100. In particular, when a single light distribution pattern is formed by using multiple headlight modules, as described later, light distribution patterns corresponding to the roles of the respective headlight modules are formed.

For example, another light source (not illustrated in FIGS. 1A and 1B) different from the light source 1 is disposed on the −Y axis direction side of the light source 1. Light emitted from the other light source enters the light guide projection optical element 3 through the incident surface 34. The light incident on the incident surface 34 is refracted at the incident surface 34. The light incident on the incident surface 34 is emitted from the emitting surface 33.

Figure 3:
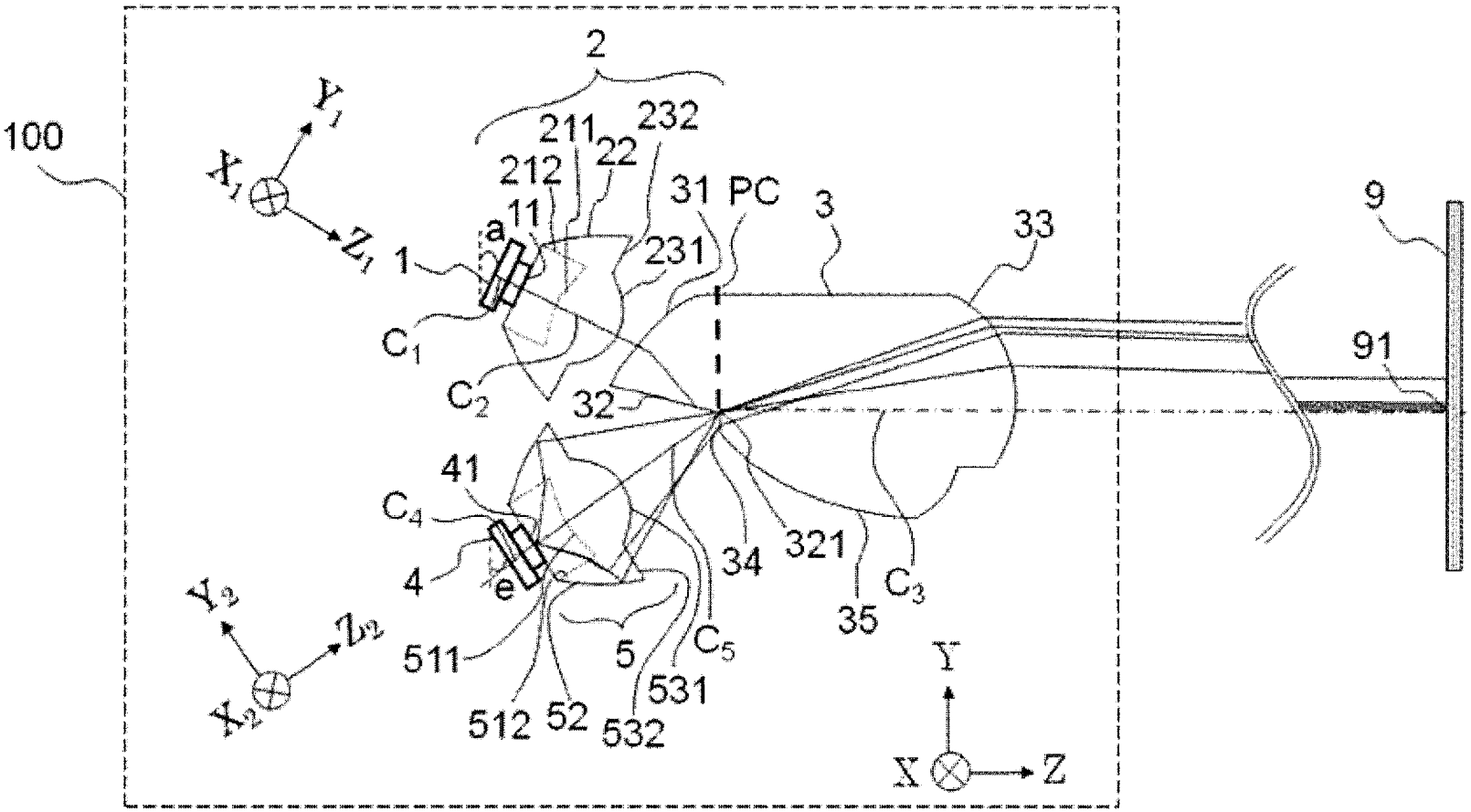
FIG. 3 is a configuration diagram illustrating a configuration of the headlight module 100 according to the first embodiment.

A configuration provided with another light source 4 is illustrated in FIG. 3.

The light source 4 and a condensing optical element 5 are arranged so that their optical axes $C_4$ and $C_5$ are inclined in the +Y axis direction by an angle e. "Their optical axes are inclined in the +Y axis direction" indicates that when viewed from the −X axis direction, their optical axes are rotated counterclockwise about the X axis.

To facilitate explanation of the light source 4 and condensing optical element 5, $X_2Y_2Z_2$ coordinates will be used as a new coordinate system. The $X_2Y_2Z_2$ coordinates are coordinates obtained by rotating the XYZ coordinates counterclockwise about the X axis by the angle e when viewed from the −X axis direction.

<Light Source 4>

The light source 4 includes a light emitting surface 41. The light source 4 emits light for providing illumination ahead of the vehicle from the light emitting surface 41. The light source 4 emits light from the light emitting surface 41.

The light source 4 is located on the $-Z_2$ axis side of the condensing optical element 5. The light source 4 is located on the −Z axis side (in back) of the light guide projection optical element 3. The light source 4 is located on the −Y axis side (lower side) of the light guide projection optical element 3.

In FIG. 3, the light source 4 emits light in the $+Z_2$ axis direction. The light source 4 may be of any type, but the following description will be made on the assumption that the light source 4 is an LED, as described above.

<Condensing Optical Element 5>

The condensing optical element 5 is located on the $+Z_2$ axis side of the light source 4. The condensing optical element 5 is also located on the $-Z_2$ axis side of the light guide projection optical element 3. The condensing optical element 5 is located on the −Z axis side (in back) of the light guide projection optical element 3. The condensing optical element 5 is located on the −Y axis side (lower side) of the light guide projection optical element 3.

The condensing optical element 5 receives light emitted from the light source 4. The condensing optical element 5 concentrates the light in the forward direction ($+Z_2$ axis direction). In FIG. 3, the condensing optical element 5 is illustrated as a condensing optical element 5 having positive power.

For example, in a case where the incident surface 34 of the light guide projection optical element 3 is provided with a light condensing function, or in other cases, the condensing optical element 5 may be omitted. When the headlight module 100 is not provided with the condensing optical element 5, the light guide projection optical element 3 receives light emitted from the light source 4. Light emitted from the light source 4 enters through the incident surface 34.

The inside of the condensing optical element 5 is filled with refractive material, for example.

In FIG. 3, the condensing optical element 5 consists of the single condensing optical element 5, but may use multiple optical elements. However, use of multiple optical elements reduces manufacturability due to reasons, such as ensuring the accuracy of positioning of each optical element.

The condensing optical element 5 includes, for example, incident surfaces 511 and 512, a reflecting surface 52, and emitting surfaces 531 and 532.

In FIG. 3, the optical axis $C_5$ of the condensing optical element 5 is parallel to the $Z_2$ axis. The optical axis $C_5$ of the condensing optical element 5 also coincides with the optical axis $C_4$ of the light source 4. Thus, the optical axis $C_4$ of the light source 4 is parallel to the $Z_2$ axis.

The detailed configuration and function of the condensing optical element 5 are the same as those of the condensing optical element 2. Thus, the description of the condensing optical element 2 applies to the condensing optical element 5. However, optical properties, such as a focal length, of the condensing optical element 5 may be different from those of the condensing optical element 2.

The incident surface 511 of the condensing optical element 5 corresponds to the incident surface 211 of the condensing optical element 2. The incident surface 512 of the condensing optical element 5 corresponds to the incident surface 212 of the condensing optical element 2. The emitting surface 531 of the condensing optical element 5 corresponds to the emitting surface 231 of the condensing optical element 2. The emitting surface 532 of the condensing optical element 5 corresponds to the emitting surface 232 of the condensing optical element 2. The reflecting surface 52 of the condensing optical element 5 corresponds to the reflecting surface 22 of the condensing optical element 2.

The light source 4 and condensing optical element 5 are disposed on the lower side (−Y axis direction side) of the light guide projection optical element 3. The light source 4 and condensing optical element 5 are also disposed in back (on the −Z axis direction side) of the light guide projection optical element 3. As illustrated in FIG. 3, the condensing optical element 5 is disposed on the lower side (−Y axis direction side) of the condensing optical element 2. Further, in the headlight module 100, the light source 4 is disposed on the lower side (−Y axis direction side) of the light source 1.

As illustrated in FIG. 3, light concentrated by the condensing optical element 5 reaches the incident surface 34 of the light guide projection optical element 3. The incident surface 34 is a refractive surface. In FIG. 3, the incident surface 34 has a planar shape. Light entering through the incident surface 34 is refracted at the incident surface 34. Light incident on the incident surface 34 is emitted from the emitting surface 33.

The inside of the light guide projection optical element 3 illustrated in FIG. 3 is filled with refractive material, for example.

The incident surface 34 is in a conjugate relation with the irradiated surface 9. That is, the incident surface 34 is located at a position optically conjugate to the irradiated surface 9. Thus, an image of a light distribution pattern formed on the incident surface 34 by the condensing optical element 5 is magnified and projected by the light guide projection optical element 3 onto the irradiated surface 9 in front of the vehicle. The light distribution pattern formed on the incident surface 34 by the condensing optical element 5 is magnified and projected by the light guide projection optical element 3 onto the irradiated surface 9 in front of the vehicle.

The incident surface 34 is located on the lower side (−Y axis direction side) of a ridge line portion 321. Thus, the image of the light distribution pattern formed on the incident surface 34 is projected on the upper side (+Y axis direction side) of a cutoff line 91 on the irradiated surface 9. The light distribution pattern formed on the incident surface 34 is projected on the upper side (+Y axis direction side) of the cutoff line 91 on the irradiated surface 9. Thus, the light source 4 and condensing optical element 5 can illuminate an area to be illuminated by the high beam.

By adjusting a light concentration position of the light emitted from the condensing optical element 5 as illustrated in FIG. 3, the light distribution of the high beam can be changed. Further, by adjusting the geometric relationship between the condensing optical element 5 and the light guide projection optical element 3, the light distribution of the high beam can be changed.

"Adjusting the geometric relationship" refers to, for example, adjusting the positional relationship between the condensing optical element 5 and the light guide projection optical element 3 in the direction (Z axis direction) of the optical axis $C_3$. Depending on the positional relationship between the condensing optical element 5 and the light guide projection optical element 3 in the direction of the optical axis $C_3$, the size of a light concentration spot of light concentrated by the condensing optical element 5 on the incident surface 34 varies. The light beam diameter of light concentrated by the condensing optical element 5 on the incident surface 34 varies. Accordingly, the light distribution on the irradiated surface 9 varies.

In the above example, the incident surface 34 is located on the conjugate plane PC. However, the incident surface 34 may be located on the −Z axis direction side of the conjugate plane PC. That is, the conjugate plane PC is located on the +Z axis side of the incident surface 34. The conjugate plane PC is located inside the light guide projection optical element 3.

In such a configuration, an image of a light distribution pattern formed on the conjugate plane PC on the lower side (−Y axis direction side) of the ridge line portion 321 can be controlled with the shape of the incident surface 34. The light distribution pattern can be controlled with the shape of the incident surface 34.

For example, the incident surface 34 has a curved surface shape having positive power. Light emitted from the condensing optical element 5 is concentrated at the ridge line portion 321. In such a case, a light distribution pattern in which a region on the upper side (+Y axis side) of the cutoff line 91 is illuminated most brightly is obtained.

As such, by changing the shape of the incident surface 34, it is possible to easily control the light distribution pattern of the high beam.

Such a control of the light distribution pattern can be performed by the condensing optical element 5. However, even when the condensing optical element 5 is not provided, the light distribution pattern can be controlled by changing the shape of the incident surface 34. Also, the light distribution pattern can be controlled by the total power of the combination of the condensing optical element 5 and incident surface 34.

As above, with the headlight module 100 illustrated in FIG. 3, both the light distribution pattern of the low beam and the light distribution pattern of the high beam can be easily formed by the single headlight module. Thus, it is not necessary to separately provide a headlight module for the high beam and a headlight module for the low beam. This makes it possible to provide a headlight device smaller than a conventional headlight device.

Further, it is possible to prevent the light emitting region from varying between when only the low beam is lighted and when both the low beam and high beam are simultaneously lighted. This can improve the design when the headlight device is lighted.

The ridge line portion 321 is an edge on the −Y axis direction side of the reflecting surface 32. The ridge line portion 321 is an edge on the +Z axis direction side of the reflecting surface 32. The ridge line portion 321 is an edge on the +Y axis direction side of the incident surface 34. The ridge line portion 321 is located at a position optically conjugate to the irradiated surface 9.

In general, "ridge line" refers to a boundary between one surface and another surface. However, "ridge line" here includes an end portion of a surface. In the first embodiment, the ridge line portion 321 is a portion joining the reflecting surface 32 and the incident surface 34. That is, a portion where the reflecting surface 32 and the incident surface 34 are connected to each other is the ridge line portion 321.

However, for example, when the light guide projection optical element 3 is hollow and the incident surface 34 is an opening portion, the ridge line portion 321 is an end portion of the reflecting surface 32. The ridge line portion 321 includes a boundary between one surface and another surface. The ridge line portion 321 also includes an end portion of a surface. As described above, in the first embodiment, the inside of the light guide projection optical element 3 is filled with refractive material.

The ridge line portion 321 forms the shape of the cutoff line 91 of the light distribution pattern. This is because the ridge line portion 321 is located at a position optically conjugate to the irradiated surface 9. The light distribution pattern on the irradiated surface 9 has a shape similar to that of the light distribution pattern on the conjugate plane PC including the ridge line portion 321. Thus, the ridge line portion 321 is preferably formed into the shape of the cutoff line 91.

"Ridge line" is not limited to a straight line, and includes a curved line or the like. For example, the ridge line may have a "rising line" shape to be described later.

This makes it possible to easily form a "rising line" along which the irradiation on a walkway side (left side) rises for identification of pedestrians and signs. This description is based on the assumption that the vehicle travels on the left side of a road.

In the first embodiment, as an example, the ridge line portion 321 has a straight line shape. In the first embodiment, the ridge line portion 321 has a straight line shape parallel to the X axis.

Further, in the first embodiment, the ridge line portion 321 is an edge on the +Y axis direction side of the incident surface 34. Since the ridge line portion 321 is on the incident surface 34, it is also located at a position optically conjugate to the irradiated surface 9.

Further, in the first embodiment, the ridge line portion 321 intersects with the optical axis $C_3$ of the light guide projection optical element 3. The ridge line portion 321 intersects at a right angle with the optical axis $C_3$ of the emitting surface 33.

The ridge line portion 321 need not necessarily intersect with the optical axis $C_3$ of the emitting surface 33. The ridge line portion 321 may be non-parallel to and non-intersecting with the optical axis $C_3$.

The ridge line portion 321 forms the shape of the cutoff line 91 of the light distribution pattern. This is because the ridge line portion 321 is located at a position optically conjugate to the irradiated surface 9. Thus, the light distribution pattern on the irradiated surface 9 is similar to the light distribution pattern on the conjugate plane PC including the ridge line portion 321. Thus, the ridge line portion 321 preferably has the shape of the cutoff line 91.

The emitting surface 33 is disposed at an end portion on the +Z axis direction side of the light guide projection optical element 3. As described later, the emitting surface 33 mainly emits light reflected by the reflecting surface 32. The emitting surface 33 emits light reflected by the reflecting surface 32.

The emitting surface 33 is disposed at the end portion on the +Z axis direction side of the light guide projection optical element 3. The emitting surface 33 has a curved surface shape having positive power. The emitting surface 33 has a convex shape projecting in the +Z axis direction. The emitting surface 33 has positive power.

The optical axis $C_3$ is a normal passing through a surface apex of the emitting surface 33. In the case of FIGS. 1A and 1B, the optical axis $C_3$ is an axis passing through the surface apex of the emitting surface 33 and being parallel to the Z axis. When the surface apex of the emitting surface 33 moves parallel to the X axis direction or Y axis direction in an X-Y plane, the optical axis $C_3$ also moves parallel to the X axis direction or Y axis direction similarly. Further, when the emitting surface 33 tilts with respect to an X-Y plane, the normal at the surface apex of the emitting surface 33 also tilts with respect to an X-Y plane and thus the optical axis $C_3$ also tilts with respect to an X-Y plane.

The reflecting surface 35 is provided on the −Y axis side end portion side of the incident surface 34. That is, the reflecting surface 35 is located on the −Y axis direction side of the incident surface 34. The reflecting surface 35 is located on the +Z axis direction side of the incident surface 34. The reflecting surface 35 is formed from the −Y axis direction side of the incident surface 34 to the emitting surface 33 side. The reflecting surface 35 is formed between the conjugate plane PC and the emitting surface 33. In the first embodiment, an end portion on the −Z axis direction side of the reflecting surface 35 is connected to an end portion on the −Y axis direction side of the incident surface 34.

The incident surface 34 is provided to receive light from the light source 4 different from the light source 1. When there is no need to use the light source 4 different from the light source 1, the end portion on the −Z axis direction side of the reflecting surface 35 can be connected to the end portion on the +Z axis direction side of the reflecting surface 32.

In this case, the reflecting surface 35 is provided on the −Y axis side end portion side of the reflecting surface 32. That is, the reflecting surface 35 is located on the −Y axis direction side of the reflecting surface 32. The reflecting surface 35 is located on the +Z axis direction side of the reflecting surface 32. The reflecting surface 35 is formed from the +Z axis direction side of the reflecting surface 32 to the emitting surface 33 side.

The reflecting surface 35 reflects light reaching the reflecting surface 35. The reflecting surface 35 has a function of reflecting light. The reflecting surface 35 functions as a light reflecting portion. The reflecting surface 35 is considered as an example of the light reflecting portion.

The reflecting surface 35 reflects, as reflected light (a light ray $R_3$), light emitted from the light source 1 and passing through a traveling direction side of the edge portion 321 of the reflecting surface 32, the traveling direction side being a side toward which the reflected light (a light ray $R_1$) from the reflecting surface 32 travels. The edge portion 321 is an edge portion on the traveling direction side toward which the reflected light (light ray $R_1$) from the reflecting surface 32 travels. For example, the light ray $R_3$ is a light ray that has not been reflected by the reflecting surface 32.

The reflecting surface 35 is a surface facing in the +Y axis direction. A front surface of the reflecting surface 35 is a surface facing in the +Y axis direction. The front surface of the reflecting surface 35 is a surface for reflecting light. A back surface of the reflecting surface 35 is a surface facing in the −Y axis direction. In the first embodiment, for example, the back surface of the reflecting surface 35 does not reflect light.

In FIGS. 1A and 1B, the reflecting surface 35 is illustrated as a curved surface having curvature only in the Y axis direction. The reflecting surface 35 is, for example, a cylindrical surface having curvature only in the Y axis direction. The reflecting surface 35 has, for example, a side surface shape of a cylinder with an axis parallel to the X axis.

The reflecting surface 35 is formed so that an optical path becomes wider in a traveling direction of a light ray. The front surface of the reflecting surface 35 can be seen from the +Z axis direction. Here, the traveling direction of the light ray is the +Z axis direction. It is a direction from the incident surface 31 toward the emitting surface 33. The reflecting surface 35 is inclined in a direction such that an optical path in the light guide projection optical element 3 becomes wider.

The reflecting surface 35 need not be a curved surface having curvature only in the Y axis direction. The reflecting surface 35 may be a curved surface having curvature in both the X axis direction and Y axis direction. For example, the reflecting surface 35 is a toroidal surface. The reflecting surface 35 may be a flat surface.

As described for the reflecting surface 32, the reflecting surface 35 may be a mirror surface obtained by mirror deposition. However, the reflecting surface 35 desirably functions as a total reflection surface, without mirror deposition. To cause the reflecting surface 35 to function as a total reflection surface, it is effective that the reflecting surface 35 is inclined so that the optical path becomes wider in the traveling direction of the light ray.

The reflecting surface 35 may be a diffusing surface. The diffusing surface is, for example, an embossed or knurled surface that is finely roughened. It is possible to blur the periphery of a light distribution pattern formed by light reflected by the reflecting surface 35. It is also possible to reduce light distribution unevenness in the light distribution pattern.

The emitting surface 36 is located at an end portion on the +Z axis direction side of the light guide projection optical element 3. The emitting surface 36 is located on the −Y axis direction side of the emitting surface 33. As described later, the emitting surface 36 mainly emits light reflected by the reflecting surface 35. The emitting surface 36 emits light reflected by the reflecting surface 35. The emitting surface 36 emits light that has not been reflected by the reflecting surfaces 32 and 35. The emitting surface 36 is a projection optical portion for projecting a light distribution pattern.

The emitting surface 36 has, for example, a curved surface shape having positive power. The emitting surface 36 has, for example, positive power. The emitting surface 36 has a convex shape projecting in the +Z axis direction. For example, in FIGS. 1A and 1B, the emitting surface 36 has a cylindrical shape that has curvature when projected onto a Y-Z plane. The emitting surface 36 has, for example, a side surface shape of a cylinder with an axis parallel to the X axis. The emitting surface 36 has, for example, positive power only in the Y axis direction. Here, a Y-Z plane is a projection plane.

<Behavior of Light Rays>

As illustrated in FIGS. 1A and 1B, light concentrated by the condensing optical element 2 enters the light guide projection optical element 3 through the incident surface 31. As described above, when the condensing optical element 2 is not provided, light emitted from the light source 1 enters the light guide projection optical element 3 through the incident surface 31.

The incident surface 31 is a refractive surface. Light incident on the incident surface 31 is refracted at the incident surface 31. The incident surface 31 has, for example, a convex shape projecting in the −Z axis direction. The incident surface 31 has, for example, positive power.

In the first embodiment, the curvature of the incident surface 31 in the X axis direction contributes to a "width of a light distribution" in a horizontal direction with respect to a road surface. The curvature of the incident surface 31 in the Y axis direction contributes to a "height of the light distribution" in a vertical direction with respect to the road surface. The X axis direction of the incident surface 31 corresponds to the horizontal direction of the vehicle. The X axis direction of the incident surface 31 corresponds to a horizontal direction of the light distribution pattern projected from the vehicle. The Y axis direction of the incident surface 31 corresponds to the vertical direction of the vehicle. The Y axis direction of the incident surface 31 corresponds to a vertical direction of the light distribution pattern projected from the vehicle.

<Behavior of Light Rays in Z-X Plane>

When viewed in a Z-X plane, the incident surface 31 has a convex shape. The incident surface 31 has positive power with respect to a horizontal direction (the X axis direction). Thus, light incident on the incident surface 31 propagates while further concentrated by the incident surface 31 of the light guide projection optical element 3. Here, "propagate" refers to traveling of light in the light guide projection optical element 3.

Here, "when viewed in a Z-X plane" refers to being viewed from the Y axis direction. It refers to being projected onto a Z-X plane and viewed. Here, the Z-X plane is a projection plane.

When viewed in a Z-X plane, the light propagating in the light guide projection optical element 3 is concentrated at the arbitrary light concentration position PH in the light guide projection optical element 3 by the condensing optical element 2 and the incident surface 31 of the light guide projection optical element 3, as illustrated in FIG. 1B. The light concentration position PH is indicated by a dashed line in FIG. 1B. In FIG. 1B, the position of the ridge line portion 321 is the position of the conjugate plane PC.

The light propagating in the light guide projection optical element 3 is concentrated at the light concentration position PH by the condensing optical element 2 and the incident surface 31 of the light guide projection optical element 3. In FIGS. 1A and 1B, the light concentration position PH is located in the light guide projection optical element 3. When the condensing optical element 2 is not used, the light propagating in the light guide projection optical element 3 is concentrated at the light concentration position PH by the incident surface 31 of the light guide projection optical element 3.

As illustrated in FIG. 1A, the conjugate plane PC is located on the +Z axis direction side of the light concentration position PH. Thus, the light after passing through the light concentration position PH diverges. Thus, the conjugate plane PC emits light wide in the horizontal direction (X axis direction) as compared to the light concentration position PH. In FIG. 1B, the position of the ridge line portion 321 is the position of the conjugate plane PC.

The conjugate plane PC is located at a position conjugate to the irradiated surface 9. Thus, the width of the light on the conjugate plane PC in the horizontal direction corresponds to the "width of the light distribution" on the irradiated surface 9. By changing the curvature of the curved surface shape of the incident surface 31, it is possible to control the width of the light beam on the conjugate plane PC in the X axis direction. Thereby, it is possible to change the width of the light distribution pattern of light emitted by the headlight module 100.

Further, the headlight module 100 need not necessarily have the light concentration position PH before (on the Z axis side of) the ridge line portion 321 in the light guide projection optical element 3. FIGS. 4-4A and 4B and 5A and 5B are explanatory diagrams for explaining the light concentration position PH of the headlight module 100 according to the first embodiment. The explanation will be made on the assumption that a light concentration position PH in the vertical direction (Y axis direction) and a light concentration position PH in the horizontal direction (X axis direction) are the same.

However, the light concentration position PH in the vertical direction (Y axis direction) and the light concentration position PH in the horizontal direction (X axis direction) may be different from each other. In this case, the light concentration position PH in the vertical direction (Y axis direction) is a light concentration position PHv. The light concentration position PH in the horizontal direction (X axis direction) is a light concentration position PHh. Thereby, it is possible to change the light distribution pattern on the conjugate plane PC.

Figure 4A:
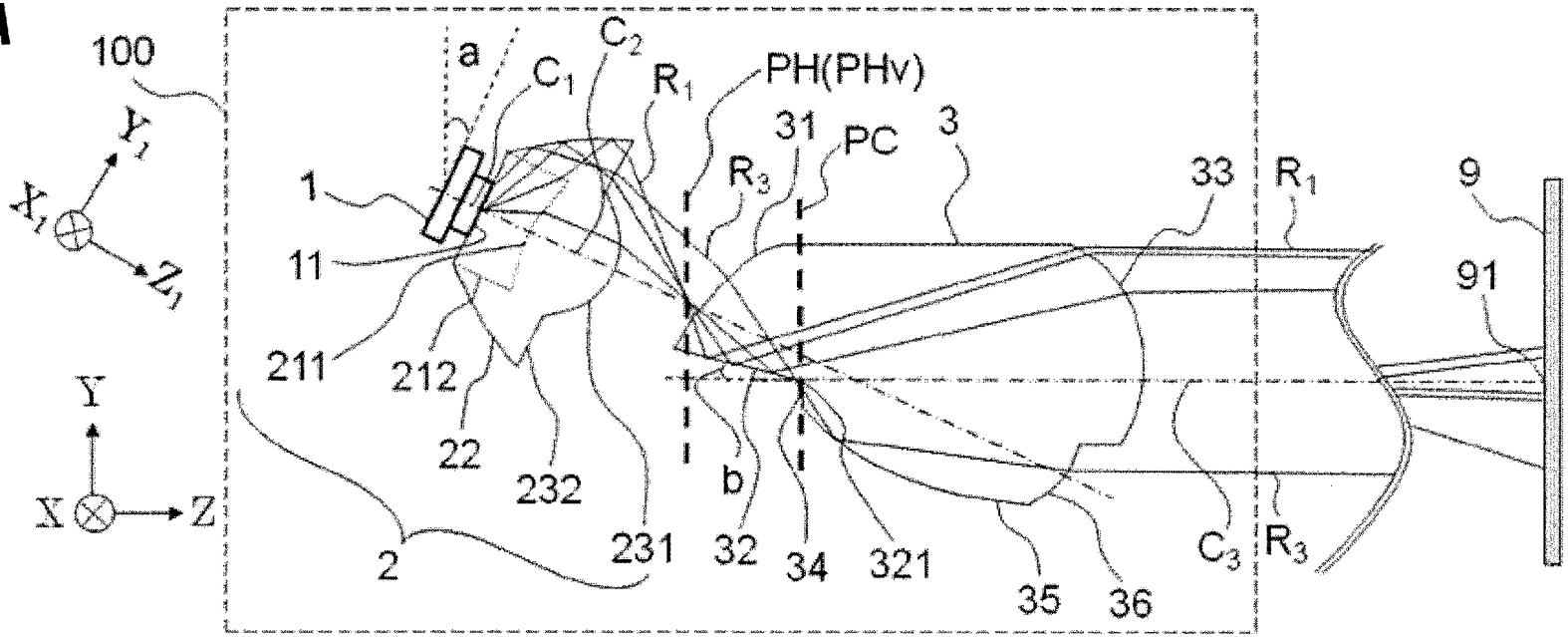
FIGS. 4A and 4B are explanatory diagrams for explaining a light concentration position PH of the headlight module 100 according to the first embodiment.
Figure 4B:
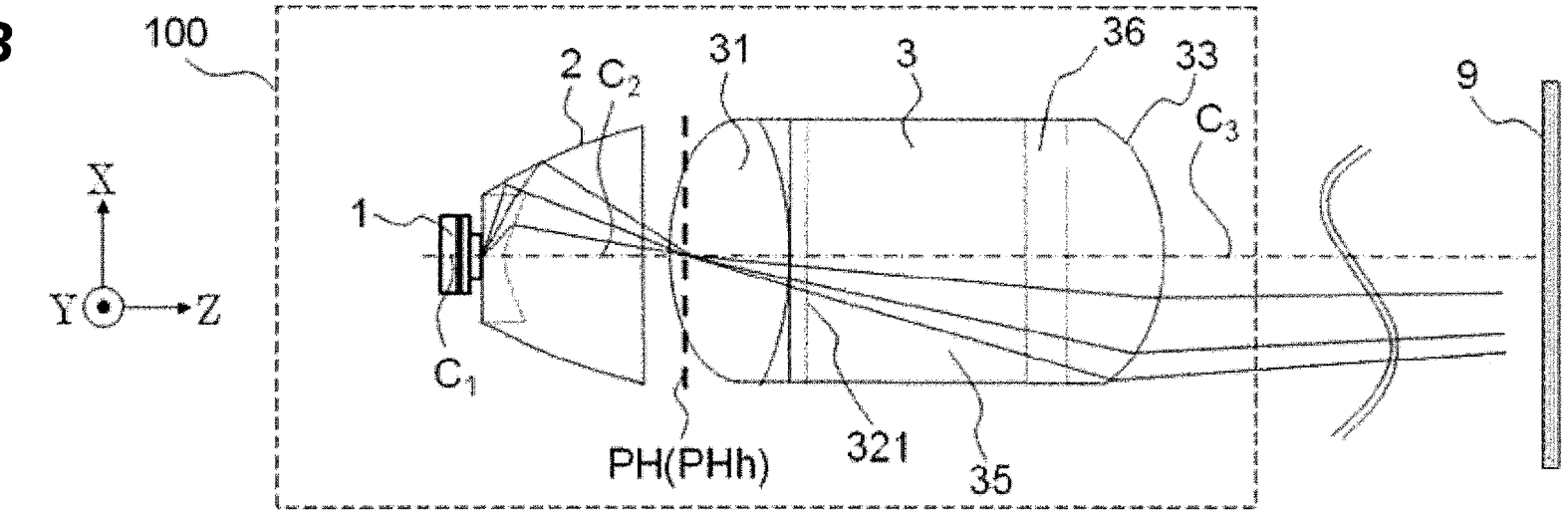

In FIGS. 4A and 4B, the light concentration position PH is located before (on the −Z axis direction side of) the incident surface 31. The light concentration position PH is located in a gap between the condensing optical element 2 and the light guide projection optical element 3. "Gap" refers to a space.

In the configuration of FIGS. 4A and 4B, as in the configuration of FIGS. 1A and 1B, light after passing through the light concentration position PH diverges. The divergence angle of the diverged light decreases at the incident surface 31. However, since the distance from the light concentration position PH to the conjugate plane PC can be made large, the width of the light beam on the conjugate plane PC in the x axis direction can be controlled. Thus, the conjugate plane PC emits light wide in the horizontal direction (x axis direction).

Figure 5A:
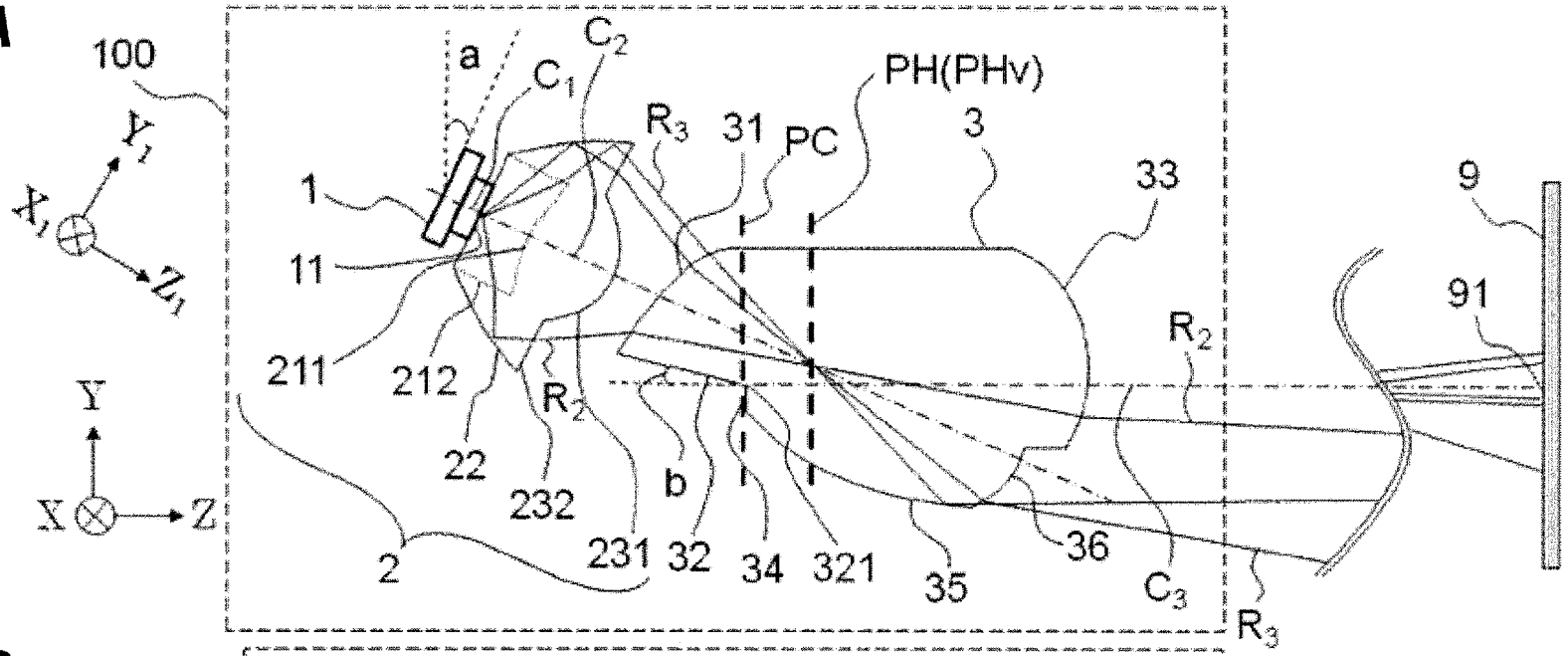
FIGS. 5A and 5B are explanatory diagrams for explaining the light concentration position PH of the headlight module 100 according to the first embodiment.
Figure 5B:
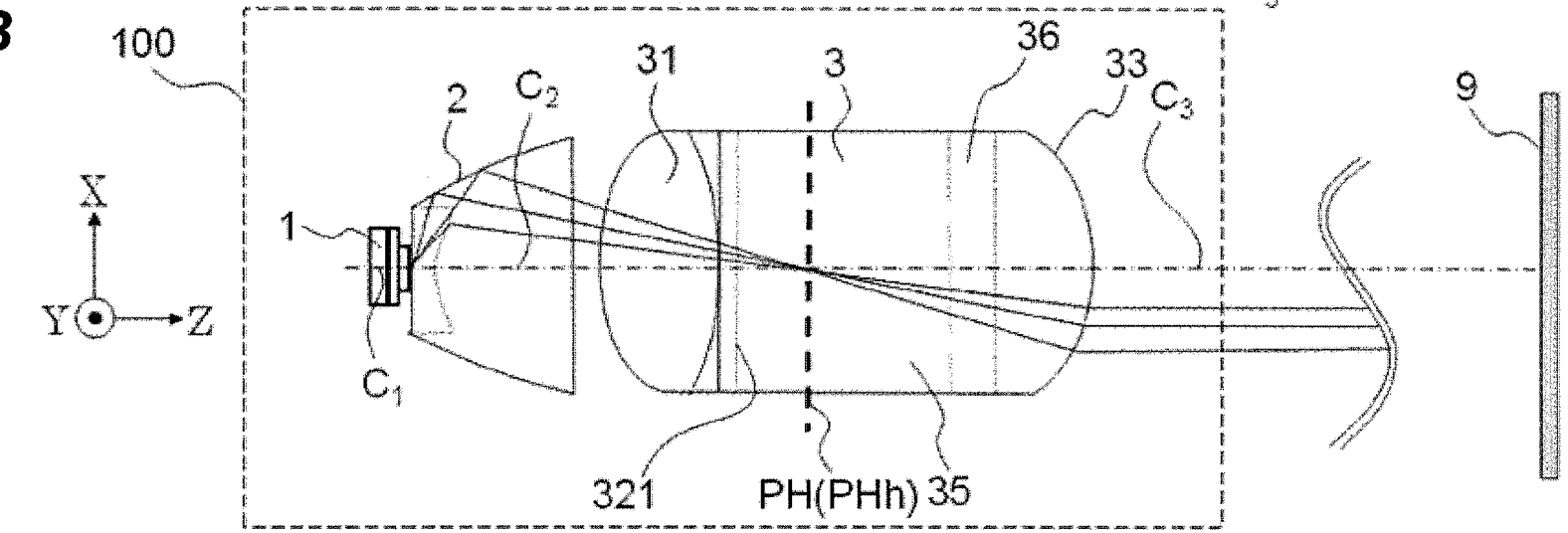

In FIGS. 5A and 5B, the light concentration position PH is located after (on the +Z axis direction side of) the ridge line portion 321. In FIGS. 5A and 5B, the conjugate plane PC is located on the −Z axis direction side of the light concentration position PH. The light concentration position PH is located between the ridge line portion 321 (conjugate plane PC) and the emitting surface 33.

Light passing through the conjugate plane PC concentrates at the light concentration position PH. By controlling the distance from the conjugate plane PC to the light concentration position PH, it is possible to control the width of the light beam on the conjugate plane PC in the X axis direction. Thus, the conjugate plane PC emits light having a width in the horizontal direction (X axis direction).

Figure 6:
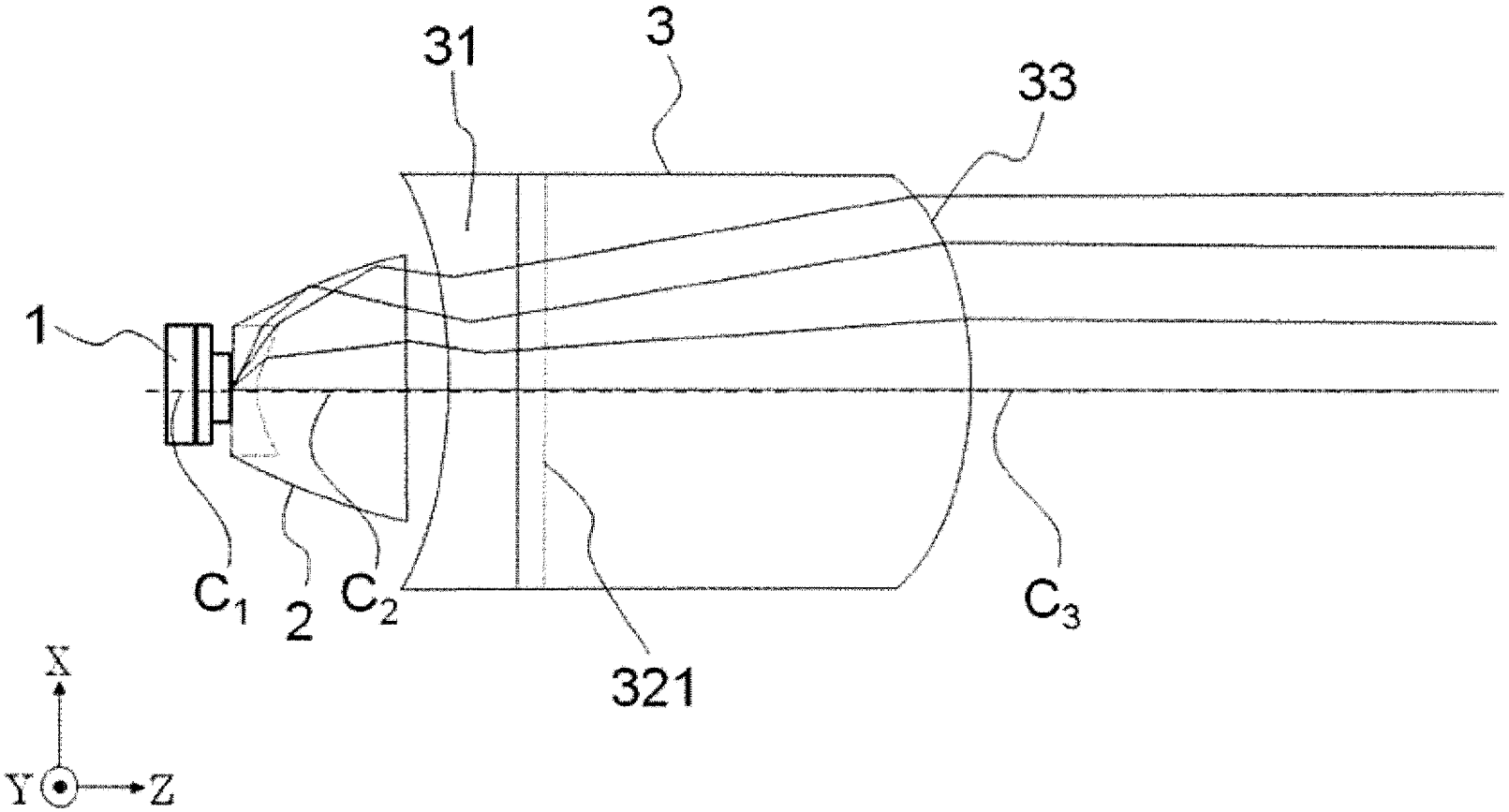
FIG. 6 is an explanatory diagram for explaining the light concentration position PH of the headlight module 100 according to the first embodiment.

FIG. 6 is an explanatory diagram for explaining the light concentration position PH of the headlight module 100 according to the first embodiment. However, as illustrated in FIG. 6, the headlight module 100 has no light concentration position PH.

In the headlight module 100 illustrated in FIG. 6, for example, the curved surface of the incident surface 31 in the horizontal direction (X axis direction) has a concave shape having negative power. This can widen light at the ridge line portion 321 in the horizontal direction. The headlight module 100 illustrated in FIG. 6 has no light concentration position PH.

Thus, the width of the light beam on the conjugate plane PC is larger than the width of the light beam on the incident surface 31. The concave incident surface 31 can control the width of the light beam on the conjugate plane PC in the X axis direction, providing a light distribution pattern wide in the horizontal direction at the irradiated surface 9.

Even when the incident surface 31 has a concave shape in the horizontal direction (X axis direction), the incident surface 31 has a convex shape in the vertical direction (Y axis direction).

The light concentration position PH indicates that light density per unit area on an X-Y plane is high. Thus, if the light concentration position PH coincides with the conjugate plane PC (position of the ridge line portion 321 in the Z axis direction), the width of the light distribution on the irradiated surface 9 is minimum, and the illuminance of the light distribution on the irradiated surface 9 is maximum.

Further, as the light concentration position PH separates from the conjugate plane PC (position of the ridge line portion 321 in the Z axis direction), the width of the light distribution on the irradiated surface 9 increases, and the illuminance of the light distribution on the irradiated surface 9 decreases.

<Behavior of Light Rays in Y-Z Plane>

On the other hand, when the light entering through the incident surface 31 is viewed in a Y-Z plane, most of the light refracted at the incident surface 31 travels in the light guide projection optical element 3 and is guided to the reflecting surface 32. The light entering through the incident surface 31 reaches the reflecting surface 32. Here, the Y-Z plane is a projection surface.

Light entering the light guide projection optical element 3 and reaching the reflecting surface 32 enters the light guide projection optical element 3 and directly reaches the reflecting surface 32. "Directly reaches" refers to reaching without being reflected by another surface or the like. Light entering the light guide projection optical element 3 and reaching the reflecting surface 32 reaches the reflecting surface 32 without being reflected by another surface or the like. That is, light reaching the reflecting surface 32 undergoes the first reflection in the light guide projection optical element 3.

Further, the light reflected by the reflecting surface 32 is directly emitted from the emitting surface 33. The light reflected by the reflecting surface 32 reaches the emitting surface 33 without being reflected by another surface or the like. That is, the light undergoing the first reflection at the reflecting surface 32 reaches the emitting surface 33 without undergoing further reflection.

In FIGS. 1A and 1B, light emitted from the part of the emitting surfaces 231 and 232 of the condensing optical element 2 on the $+Y_1$ axis direction side of the optical axis $C_2$ of the condensing optical element 2 as exemplified by the light ray $R_1$ is guided to the reflecting surface 32.

Light emitted from the part of the emitting surfaces 231 and 232 of the condensing optical element 2 on the $-Y_1$ axis direction side of the optical axis $C_2$ of the condensing optical element 2 as exemplified by the light ray $R_2$ is emitted from the emitting surface 33 without being reflected by the reflecting surface 32.

Thus, part of the light entering the light guide projection optical element 3 reaches the reflecting surface 32. The light reaching the reflecting surface 32 is reflected by the reflecting surface 32 and emitted from the emitting surface 33.

Light emitted from the part of the emitting surfaces 231 and 232 of the condensing optical element 2 on the $+Y_1$ axis direction side of the optical axis $C_2$ of the condensing optical element 2 as exemplified by the light ray $R_3$ is guided to the reflecting surface 35. Part of the light entering the light guide projection optical element 3 reaches the reflecting surface 35. The light reaching the reflecting surface 35 passes through the +Z axis side of the ridge line portion 321. The light reaching the reflecting surface 35 is reflected by the reflecting surface 35 and emitted from the emitting surface 36.

The light ray $R_3$, included in the light emitted by the light source 1, passes through a traveling direction (the +Z axis direction) side of the ridge line portion 321 of the reflecting surface 32, the traveling direction side being a side toward which the reflected light $R_1$ travels. The reflecting surface 35 reflects the light ray $R_3$.

The light ray $R_3$ is reflected by the reflecting surface 35 and thus is equivalent to a light ray emitted from a position $P_3$ (intersection $P_3$) on the conjugate plane PC as illustrated in FIGS. 1A and 1B. The position $P_3$ is a position at which a line extended from the light ray $R_3$ reflected by the reflecting surface 35 in the −Z axis direction intersects with the conjugate plane PC.

The position $P_3$ on the conjugate plane PC is located on the lower side (−Y axis side) of the ridge line portion 321. For example, if the light ray $R_3$ is emitted from the emitting surface 33, it reaches the upper side (+Y axis side) of the cutoff line 91 on the irradiated surface 9.

In this case, since the light ray $R_3$ is emitted to the upper side (+Y axis side) of the cutoff line 91, it may dazzle the driver of an oncoming vehicle. Further, in some cases, regulations, such as a road traffic law, cannot be satisfied.

Thus, the light reflected by the reflecting surface 35 is emitted from the emitting surface 36. The emitting surface 36 causes the light ray $R_3$ reflected by the reflecting surface 35 to reach the lower side (−Y axis side) of the cutoff line 91 on the irradiated surface 9.

The emitting surface 36 is a refractive surface. The emitting surface 36 may have a curved surface shape. The emitting surface 36 may have a planar shape. As described above, for example, in FIGS. 1A and 1B, the emitting surface 36 has a cylindrical shape having positive power only in the Y axis direction. It may be, for example, a toroidal surface having a power in the X axis direction and a power in the Y axis direction that are different from each other.

An optical axis of the emitting surface 36 will be referred to as the optical axis $C_6$. A plane including a focal point Fp of the emitting surface 36 and being perpendicular to the optical axis $C_6$ will be referred to as the plane PF. As illustrated in FIGS. 1A and 1B, the light ray $R_3$ is equivalent to a light ray emitted from a position $P_5$ (intersection $P_5$) on the plane PF. The position $P_5$ is a position at which a line extended from the light ray $R_3$ reflected by the reflecting surface 35 in the −Z axis direction intersects with the plane PF.

For example, if the position $P_5$ is located on the +Y axis side of the focal point Fp on the plane PF, the light ray $R_3$ reaches the lower side (−Y axis side) of the cutoff line 91 on the irradiated surface 9. If the position $P_5$ is located on the reflecting surface 32 side of the focal point Fp on the plane PF, the light ray $R_3$ illuminates the lower side (−Y axis side) of the cutoff line 91 on the irradiated surface 9. If the position $P_5$ is located in a direction from the emitting surface 36 toward the emitting surface 33, from the focal point Fp on the plane PF, the light ray $R_3$ is radiated to the lower side (−Y axis side) of the cutoff line 91 on the irradiated surface 9.

In this case, the light emitted from the emitting surface 36 is concentrated. Also, the light emitted from the emitting surface 36 illuminates the lower side (−Y axis side) of the cutoff line 91 on the irradiated surface 9.

As illustrated in FIGS. 1A and 1B, the intersection $P_3$ of the plane PC with a line segment extended from the light ray $R_3$ toward the reflecting surface 32 side is located on the back surface side of the reflecting surface 32. The plane PC is a plane including the focal point of the emitting surface 33 and being perpendicular to the optical axis $C_3$ of the emitting surface 33.

Further, as illustrated in FIGS. 1A and 1B, the intersection $P_5$ of the plane PF with a line segment extended from the light ray $R_3$ toward the reflecting surface 32 side is located on the reflecting surface 32 side of the focal point Fp of the emitting surface 36. The plane PF is a plane including the focal point Fp of the emitting surface 36 and being perpendicular to the optical axis $C_6$ of the emitting surface 36. If the position $P_5$ is located on the +Y axis side of the focal point Fp on the plane PF, the light ray $R_3$ reaches the lower side (−Y axis side) of the cutoff line 91 on the irradiated surface 9.

The intersection $P_5$ of the plane PF with the line segment extended from the light ray $R_3$ toward the reflecting surface 32 side may be located on a side opposite the reflecting surface 32 of the focal point Fp of the emitting surface 36. That is, on the plane PF, the intersection $P_5$ is located on the −Y axis side of the focal point Fp of the emitting surface 36. If the position $P_5$ is located on the −Y axis side of the focal point Fp on the plane PF, the light ray $R_3$ reaches the upper side (+Y axis side) of the cutoff line 91 on the irradiated surface 9.

The partial light emitted from the emitting surface 36 may illuminate the upper side (+Y axis side) of the cutoff line 91 as light for illuminating road signs or the like specified by regulations, such as a road traffic law. In this case, the light reflected by the reflecting surface 35 is emitted from either the emitting surface 33 or 36. Alternatively, the light reflected by the reflecting surface 35 may be emitted from both the emitting surfaces 33 and 36.

Figure 18:
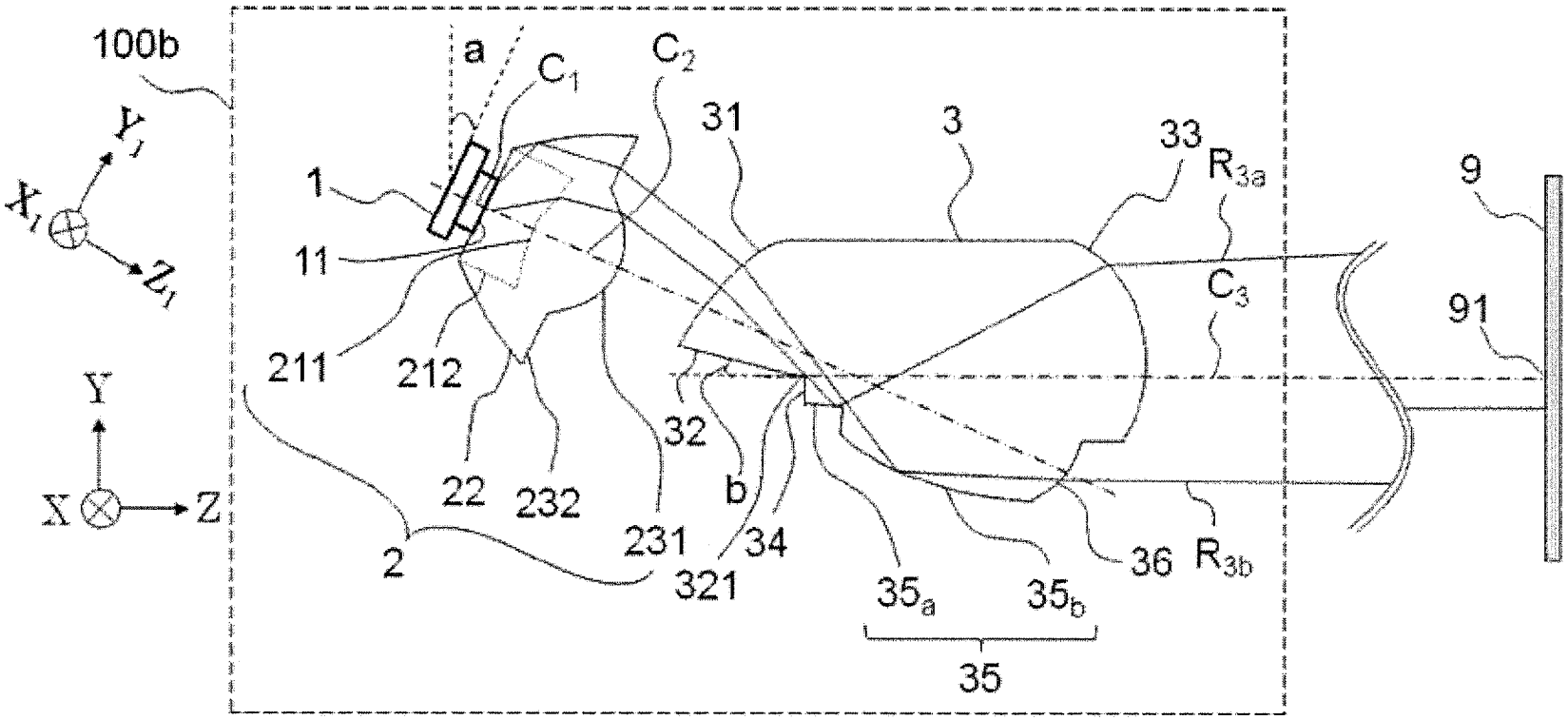
FIG. 18 is a configuration diagram illustrating a configuration of a headlight module 100*b* according to the first embodiment.

FIG. 18 is a configuration diagram illustrating a configuration of a headlight module 100*b*.

The reflecting surface 35 of the headlight module 100*b* includes a reflecting region 35*a* and a reflecting region 35*b*. For example, the reflecting region 35*a* is located on the −Z axis side of the reflecting region 35*b*. A light ray $R_3a$ reflected by the reflecting region 35*a* is directly emitted from the emitting surface 33. On the other hand, a light ray $R_3b$ reflected by the reflecting region 35*b* is emitted from the emitting surface 36.

In this case, the light ray $R_{3a}$ reaches the upper side (+Y axis side) of the cutoff line 91 on the irradiated surface 9. The light ray $R_{3b}$ reaches the upper side (+Y axis side) or the lower side (−Y axis side) of the cutoff line 91 on the irradiated surface 9 depending on setting of the position of the above-described intersection $P_5$ on the plane PF.

For example, the light guide projection optical element 3 illustrated in FIG. 18 may include a reflecting surface 37 illustrated in FIGS. 13A and 13B of a second embodiment to be described later. In this case, the light ray $R_{3a}$ reflected by the reflecting region 35*a* can be divided into the light ray $R_{3a}$ directly emitted from the emitting surface 33 and a light ray $R_4$ reflected by the reflecting surface 37 and emitted from the emitting surface 33. In this case, the light guide projection optical element 3 includes the reflecting surfaces 35 and 37, and the emitting surfaces 33 and 36. The reflecting surface 35 includes the reflecting regions 35*a* and 35*b*.

The number of types of reflecting regions is not limited to two. Three or more types of reflecting regions can be employed.

Figure 13A:
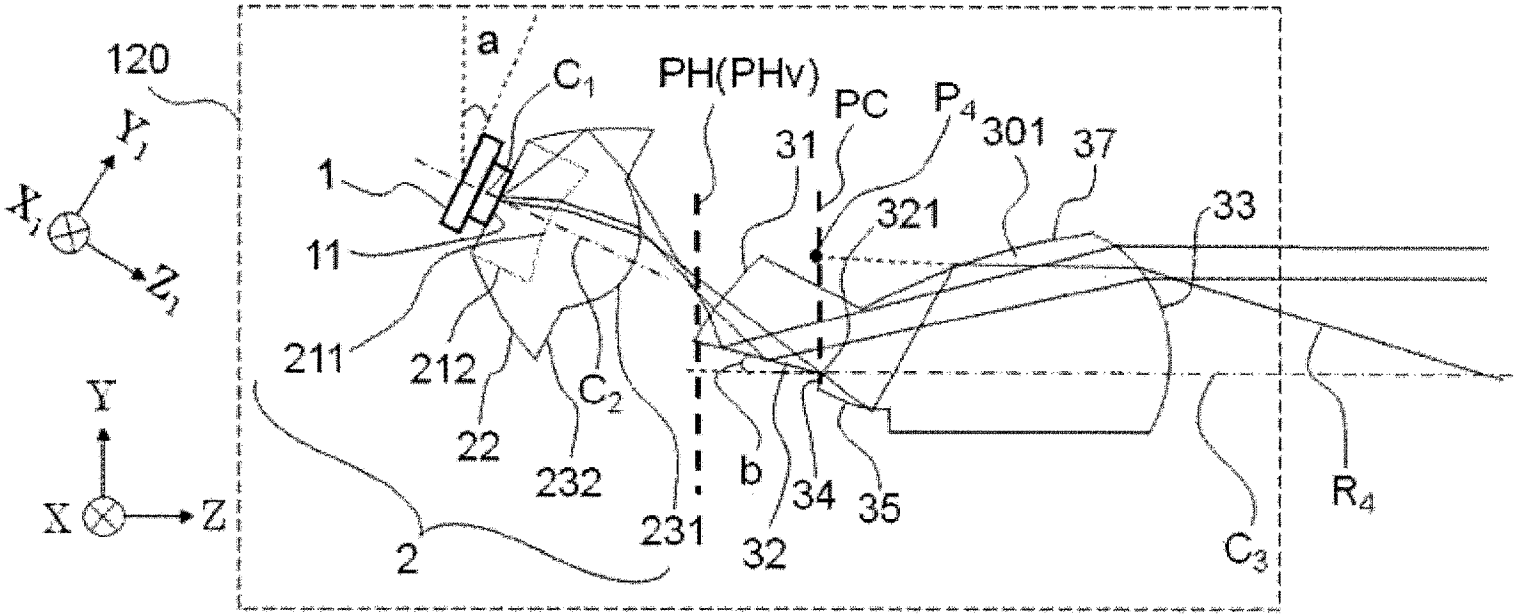
FIGS. 13A and 13B are configuration diagrams illustrating a configuration of a headlight module 120 according to a second embodiment.
Figure 13B:
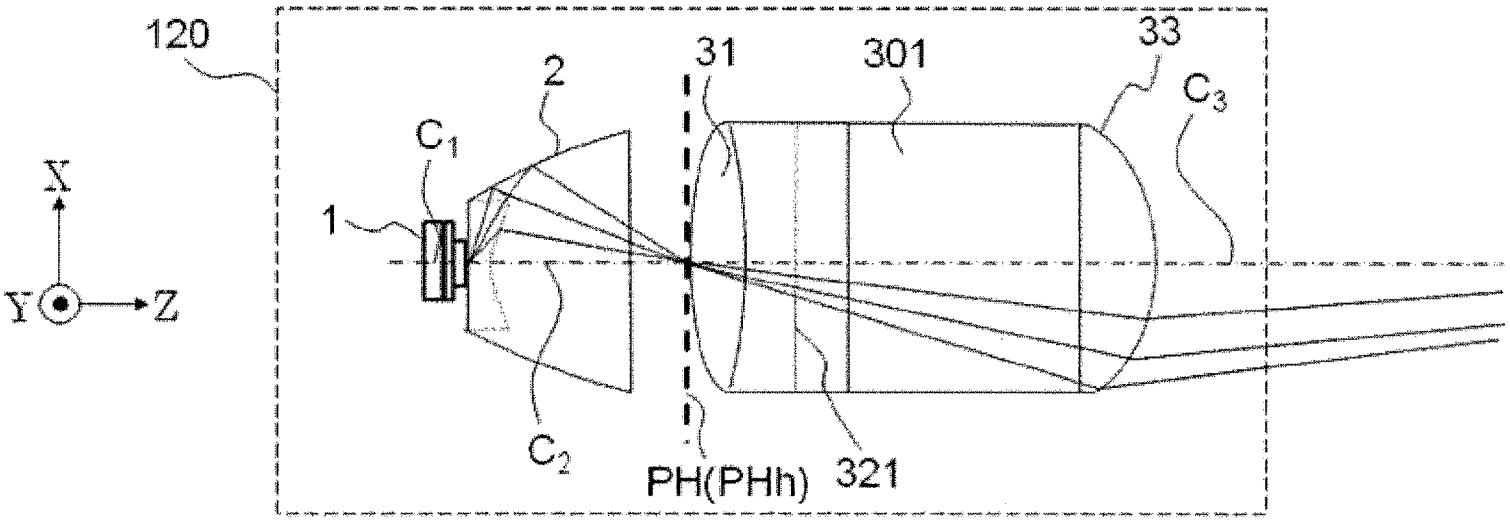

When the reflecting surface 37 illustrated in FIGS. 13A and 13B is applied to the light guide projection optical element 3 illustrated in FIG. 18, it is possible to form four light distribution patterns. The first is light reflected by the reflecting surface 32 and emitted from the emitting surface 33. The second is light reflected by the reflecting surface 35*a*, reflected by the reflecting surface 37, and emitted from the emitting surface 33. The third is light reflected by the reflecting surface 35*a* and directly emitted from the emitting surface 33. The fourth is light reflected by the reflecting surface 35*b* and emitted from the emitting surface 36.

When the reflecting surface 35 illustrated in FIG. 18 is applied to a light guide projection optical element 301 illustrated in FIGS. 13A and 13B, it is possible to form three light distribution patterns. The first is light reflected by the reflecting surface 32 and emitted from the emitting surface 33. The second is light reflected by the reflecting surface 35*a*, reflected by the reflecting surface 37, and emitted from the emitting surface 33. The third is light reflected by the reflecting surface 35*b* and directly emitted from the emitting surface 33.

The arrangement of the reflecting regions 35*a* and 35*b* is not limited to the one illustrated in FIG. 18. For example, it is possible to alternately arrange a plurality of the reflecting regions 35*a* and a plurality of the reflecting regions 35*b* on the reflecting surface 35.

In this manner, the light ray $R_3$ reflected by the reflecting surface 35 can reach the lower side (−Y axis side) of the cutoff line 91 on the irradiated surface 9 or the upper side (+Y axis side) of the cutoff line 91 on the irradiated surface 9. Depending on the setting of the reflecting surface 35, the light ray $R_3$ reflected by the reflecting surface 35 can be used not only as irradiation light for irradiating the lower side of the cutoff line but also for overhead signs.

Further, by setting the inclination angle a of the light source 1 and condensing optical element 2, it is possible to reduce the length of the light guide projection optical element 3 in the direction of the optical axis $C_3$ (Z axis direction), and shorten the depth (length in the Z axis direction) of an optical system. Here, "optical system" refers to, in the first embodiment, an optical system including, as its components, the condensing optical element 2 and light guide projection optical element 3. As described above, the condensing optical element 2 may be omitted.

Further, by setting the inclination angle a of the light source 1 and condensing optical element 2, it becomes easy to guide light emitted from the condensing optical element 2 to the reflecting surface 32. Thus, it becomes easy to efficiently concentrate light at a region on the inner side (+Y axis direction side) of the ridge line portion 321 on the conjugate plane PC.

By concentrating light emitted from the condensing optical element 2 on the conjugate plane PC side of the reflecting surface 32, it is possible to increase the emission amount of light emitted from a region on the +Y axis side of the ridge line portion 321. This is because light reaching the conjugate plane PC after being reflected by the reflecting surface 32 and light reaching the conjugate plane PC and emitted from the emitting surface 33 without being reflected by the reflecting surface 32 are superposed. In this case, an intersection of a central light ray emitted from the condensing optical element 2 with the reflecting surface 32 is located on the conjugate plane PC side of the reflecting surface 32.

Thus, it becomes easy to brighten a region on the lower side of the cutoff line 91 of the light distribution pattern projected on the irradiated surface 9. Further, the reduction in the length of the light guide projection optical element 3 in the direction (Z axis direction) of the optical axis $C_3$ reduces internal absorption of light in the light guide projection optical element 3, improving the light use efficiency.

"Internal absorption" refers to light loss inside the material except loss due to surface reflection when light passes through a light guide component (in the first embodiment, the light guide projection optical element 3). The internal absorption increases as a length of the light guide component increases.

A light ray that is not reflected by the reflecting surface 32 and does not directly reach the emitting surface 33 reaches the reflecting surface 35. The light ray reaching the reflecting surface 35 is reflected by the reflecting surface 35 and emitted from the emitting surface 33 or 36.

The headlight module 100 efficiently emits light from the emitting surfaces 33 and 36 without blocking light like the conventional headlight device, and thus can provide a headlight having high light use efficiency.

For a typical light guide element, light travels inside the light guide element while being repeatedly reflected by a side surface of the light guide element. Thereby, the intensity distribution of the light is equalized. In the first embodiment, light entering the light guide projection optical element 3 is reflected by the reflecting surface 32 or 35 once and emitted from the emitting surface 33 or 36. In this respect, the way of using the light guide projection optical element 3 in the first embodiment differs from the conventional way of using a light guide element.

In a light distribution pattern specified in road traffic rules or the like, a region on the lower side (−Y axis direction side) of the cutoff line 91 has the highest illuminance, for example. As described above, the ridge line portion 321 of the light guide projection optical element 3 is in a conjugate relation with the irradiated surface 9, through the emitting surface 33. Thus, to make a region on the lower side (−Y axis direction side) of the cutoff line 91 have the highest illuminance, it is required to make a region on the upper side (+Y axis direction side) of the ridge line portion 321 of the light guide projection optical element 3 have the highest luminous intensity.

When the ridge line portion 321 is not a straight line, a plane (conjugate plane PC) including a position (point Q) at which the ridge line portion 321 intersects with the optical axis $C_3$ and being parallel to an X-Y plane may be in a conjugate relation with the irradiated surface 9, for example. It is not always necessary that the ridge line portion 321 and the optical axis $C_3$ of the emitting surface 33 intersect with each other. The ridge line portion 321 may be displaced from the optical axis $C_3$ in the Y axis direction.

To produce a light distribution pattern in which a region on the lower side (−Y axis direction side) of the cutoff line 91 has the highest illuminance, it is effective that, when viewed in a Y-Z plane, part of the light entering through the incident surface 31 of the light guide projection optical element 3 is reflected by the reflecting surface 32, as illustrated in FIG. 1A.

This is because light entering through the incident surface 31 and reaching a region on the +Y axis direction side of the ridge line portion 321 without being reflected by the reflecting surface 32 and light entering through the incident surface 31 and reaching the region on the +Y axis direction side of the ridge line portion 321 after being reflected by the reflecting surface 32 are superposed on the conjugate plane PC.

The light reaching the conjugate plane PC without being reflected by the reflecting surface 32 and the light reaching the conjugate plane PC after being reflected by the reflecting surface 32 are superposed in a region on the conjugate plane PC corresponding to the high illuminance region on the irradiated surface 9. Such a configuration makes it possible to make a region on the upper side (+Y axis direction side) of the ridge line portion 321 have the highest luminous intensity on the conjugate plane PC.

The headlight module 100 forms a region having high luminous intensity by superposing, on the conjugate plane PC, light reaching the conjugate plane PC without being reflected by the reflecting surface 32 and emitted from the emitting surface 33 and light reaching the conjugate plane PC after being reflected by the reflecting surface 32. The position of the region having high luminous intensity on the conjugate plane PC can be changed by changing the reflection position of the light on the reflecting surface 32.

By setting the reflection position of the light on the reflecting surface 32 near the conjugate plane PC, it is possible to set the region having high luminous intensity near the ridge line portion 321 on the conjugate plane PC. Thus, it is possible to set a region having high illuminance on the lower side of the cutoff line 91 on the irradiated surface 9.

Further, the amount of the superposed light can be adjusted by changing the curvature of the incident surface 31 in the vertical direction (Y axis direction), as in the case of adjusting the width of the light distribution in the horizontal direction. "Amount of the superposed light" refers to the amount of light resulting from the superposition of the light reaching the region on the +Y axis direction side of the ridge line portion 321 (on the conjugate plane PC) without being reflected by the reflecting surface 32 and emitted from the emitting surface 33 and the light reaching the region on the +Y axis direction side of the ridge line portion 321 (on the conjugate plane PC) after being reflected by the reflecting surface 32. The superposition of the light is performed on the conjugate plane PC.

In this manner, by adjusting the curvature of the incident surface 31, the light distribution can be adjusted. By adjusting the curvature of the incident surface 31, a desired light distribution can be obtained.

Here, "desired light distribution" refers to, for example, a predetermined light distribution or the like specified in road traffic rules or the like. When a single light distribution pattern is formed by using multiple headlight modules, as described later, "desired light distribution" refers to a light distribution required for each headlight module.

Similarly to the incident surface 31, the light distribution of light reflected by the reflecting surface 35 can also be adjusted by changing the curvatures of the reflecting surface 35 and emitting surface 36 in the vertical direction (Y axis direction).

Further, by adjusting the geometric relationship between the condensing optical element 2 and the light guide projection optical element 3, the light distribution can be adjusted. By adjusting the geometric relationship between the condensing optical element 2 and the light guide projection optical element 3, a desired light distribution can be obtained.

Here, "desired light distribution" refers to, for example, a predetermined light distribution or the like specified in road traffic rules or the like. When a single light distribution pattern is formed by using multiple headlight modules, as described later, "desired light distribution" refers to a light distribution required for each headlight module.

"Geometric relationship" refers to, for example, the positional relationship between the condensing optical element 2 and the light guide projection optical element 3 in the direction of the optical axis $C_3$.

As the distance from the condensing optical element 2 to the light guide projection optical element 3 decreases, the amount of light reflected by the reflecting surface 32 decreases, and the dimension of the light distribution in the vertical direction (Y axis direction) decreases. Thus, the height of the light distribution pattern decreases.

Conversely, as the distance from the condensing optical element 2 to the light guide projection optical element 3 increases, the amount of light reflected by the reflecting surface 32 increases, and the dimension of the light distribution in the vertical direction (Y axis direction) increases. Thus, the height of the light distribution pattern increases.

Further, the position of the superposed light can be changed by adjusting the position of the light reflected by the reflecting surface 32.

"Position of the superposed light" refers to the position at which the light reaching the region on the +Y axis direction side of the ridge line portion 321 (on the conjugate plane PC) without being reflected by the reflecting surface 32 and emitted from the emitting surface 33 and the light reaching the region on the +Y axis direction side of the ridge line portion 321 (on the conjugate plane PC) after being reflected by the reflecting surface 32 are superposed on the conjugate plane PC. It refers to a high luminous intensity region on the conjugate plane PC. The high luminous intensity region is a region on the conjugate plane PC corresponding to the high illuminance region on the irradiated surface 9.

Further, by adjusting a light concentration position of the light reflected by the reflecting surface 32, the height of the high luminous intensity region on the conjugate plane PC can be adjusted. Specifically, when the light concentration position is near the conjugate plane PC, the dimension of the high luminous intensity region in the height direction is small. Conversely, when the light concentration position is far from the conjugate plane PC, the dimension of the high luminous intensity region in the height direction is large.

In the above description, the high illuminance region is described as a region on the lower side (−Y axis direction side) of the cutoff line 91. This is the position of the high illuminance region in the light distribution pattern on the irradiated surface 9.

As described later, for example, a single light distribution pattern may be formed on the irradiated surface 9 by using multiple headlight modules. In such a case, the high luminous intensity region on the conjugate plane PC of each headlight module is not necessarily a region on the +Y axis direction side of the ridge line portion 321. For each headlight module, a high luminous intensity region is formed, on the conjugate plane PC, at a position appropriate for the light distribution pattern of the headlight module.

As described above, the shape of the light distribution pattern can be changed by adjusting the light concentration position PH.

The light concentration position PHh in the horizontal direction and the light concentration position PHv in the vertical direction need not necessarily coincide with each other. For example, the light concentration position PHh in the horizontal direction (X axis direction) and the light concentration position PHv in the vertical direction (Y axis direction) may be different positions. In this case, for example, the incident surface 31 may be a toroidal surface.

By adjusting the light concentration position PHh in the horizontal direction, it is possible to control the width of the light distribution pattern. Also, by adjusting the light concentration position PHv in the vertical direction, it is possible to control the height of the high illuminance region.

As such, by independently setting the light concentration position PHh in the horizontal direction and the light concentration position PHv in the vertical direction, it is possible to control the shape of the light distribution pattern or the shape of the high illuminance region.

For example, by adjusting the curvature of the incident surface 31 of the light guide projection optical element 3 in a direction corresponding to the horizontal direction of the light distribution pattern, it is possible to control the width of the light distribution pattern or the width of the high illuminance region. Also, by adjusting the curvature of the incident surface 31 of the light guide projection optical element 3 in a direction corresponding to the vertical direction of the light distribution pattern, it is possible to control the height of the light distribution pattern or the height of the high illuminance region.

As described above, in the drawings of the first embodiment, the light concentration position PHh in the horizontal direction and the light concentration position PHv in the vertical direction are described as the same position, and thus they are described as the light concentration position PH.

By changing the shape of the ridge line portion 321 of the light guide projection optical element 3, it is possible to easily form the shape of the cutoff line 91. The cutoff line 91 can be easily formed by forming the ridge line portion 321 of the light guide projection optical element 3 into the shape of the cutoff line 91. Thus, there is an advantage that the light use efficiency is high compared to the conventional case of forming it by using the light blocking plate. This is because the cutoff line 91 can be formed without blocking light.

An image of the light distribution pattern formed on the conjugate plane PC is magnified and projected by the emitting surface 33 of the light guide projection optical element 3 onto the irradiated surface 9 in front of the vehicle. An image of the light distribution pattern formed on the conjugate plane PC is projected by the emitting surface 33 of the light guide projection optical element 3.

For example, the focal position of the emitting surface 33 in the direction of the optical axis $C_3$ coincides with the position of the ridge line portion 321 in the direction of the optical axis $C_3$. The ridge line portion 321 is located on a plane located at the focal position of the emitting surface 33 and perpendicular to the optical axis $C_3$. The position of the focal point of the emitting surface 33 in the Z axis direction (the direction of the optical axis $C_3$) coincides with the position of the ridge line portion 321 in the Z axis direction. A plane including the focal point of the emitting surface 33 and being perpendicular to the optical axis $C_3$ includes the ridge line portion 321.

In FIGS. 1A and 1B, the focal position of the emitting surface 33 coincides with the position (position in the Z axis direction) of the ridge line portion 321 on the optical axis $C_3$. The focal position of the emitting surface 33 is located, for example, at an intersection of the ridge line portion 321 with the optical axis $C_3$.

A light ray that does not directly reach the reflecting surface 32 or emitting surface 33 reaches the reflecting surface 35. If the reflecting surface 35 were not provided, the light ray reaching the reflecting surface 35 would form no light distribution pattern on the irradiated surface 9. However, the reflecting surface 35 is provided, and thereby a light ray reflected by the reflecting surface 35 is emitted from the emitting surface 33 or 36.

Thus, the headlight module 100 can effectively radiate a light ray reaching the reflecting surface 35, onto the irradiated surface 9.

In particular, a light ray reflected by the reflecting surface 35 and emitted from the emitting surface 36 can irradiate the lower side of the cutoff line 91 on the irradiated surface 9. A light ray reaching the reflecting surface 35 can be effectively radiated to a region of the light distribution pattern of the low beam on the irradiated surface 9. It is possible to effectively use light that was unusable, and to provide a headlight having high light use efficiency.

In the conventional headlight device, since the light blocking plate and projection lens are used, positional variation between the components causes variation, such as deformation of the cutoff line 91 or variation of light distribution.

However, for the light guide projection optical element 3, depending on the accuracy of the shape of the single component, it is possible to make the focal position of the emitting surface 33 coincide with the position of the ridge line portion 321 in the direction of the optical axis $C_3$.

Thereby, the headlight module 100 can reduce variation, such as deformation of the cutoff line 91 or variation of light distribution. This is because, in general, the accuracy of the shape of a single component can be improved more easily than the positional accuracy between two components.

Figure 7A:
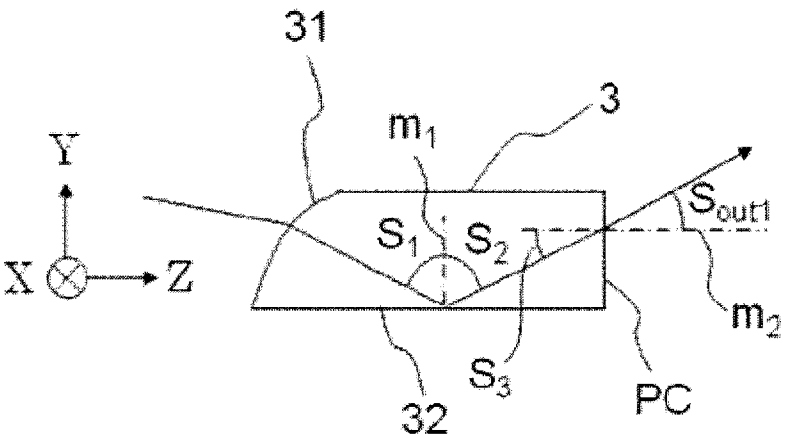
FIG. 7 is a FIGS. 7A and 7B are diagrams for explaining the shape of a reflecting surface 32 of the light guide projection optical element 3 of the headlight module 100 according to the first embodiment.
Figure 7B:
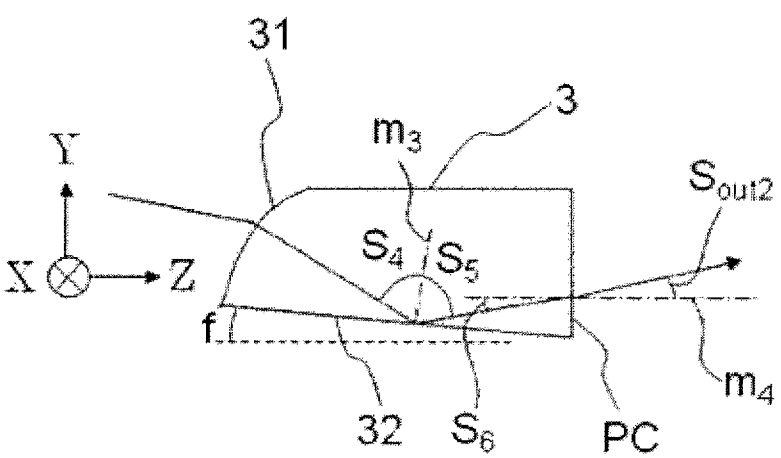

FIGS. 7A and 7B are diagrams for explaining the shape of the reflecting surface 32 of the light guide projection optical element 3 of the headlight module 100 according to the first embodiment. FIGS. 7A and 7B illustrate the part from the incident surface 31 to the conjugate plane PC of the light guide projection optical element 3.

FIG. 7A illustrates, for comparison, a case where the reflecting surface 32 is not inclined with respect to a Z-X plane. FIG. 7B illustrates the shape of the reflecting surface 32 of the light guide projection optical element 3.

The reflecting surface 32 of the light guide projection optical element 3 illustrated in FIG. 7B is not a surface parallel to a Z-X plane. For example, as illustrated in FIG. 7B, the reflecting surface 32 is a flat surface inclined about the X axis with respect to a Z-X plane.

The reflecting surface 32 of the light guide projection optical element 3 is a surface rotated clockwise about the X axis, as viewed from the −X axis direction. In FIG. 7B, the reflecting surface 32 is a surface rotated by an angle f with respect to a Z-X plane. The end portion on the incident surface 31 side of the reflecting surface 32 is located on the +Y axis side of the end portion on the conjugate plane PC side. The angle f in FIG. 7B is shown as the angle b in FIG. 1A.

The reflecting surface 32 of the light guide projection optical element 3 illustrated in FIG. 7A is a flat surface parallel to a Z-X plane. Light entering through the incident surface 31 is reflected by the reflecting surface 32 and reaches the conjugate plane PC.

The incident angle of light on the reflecting surface 32 is an incident angle $S_1$. The reflection angle of the light at the reflecting surface 32 is a reflection angle $S_2$. According to the law of reflection, the reflection angle $S_2$ is equal to the incident angle $S_1$. A perpendicular line $m_1$ to the reflecting surface 32 is indicated by a dot-and-dash line in FIG. 7A.

A perpendicular line is a straight line that intersects at a right angle with another straight line or a plane.

The light is incident on the conjugate plane PC at an incident angle $S_3$. The light is emitted from the conjugate plane PC at an emission angle $S_{out1}$. The emission angle $S_{out1}$ is equal to the incident angle $S_3$. A perpendicular line $m_2$ to the conjugate plane PC is indicated by a dot-and-dash line in FIG. 7A. The perpendicular line $m_2$ to the conjugate plane PC is parallel to the optical axis $C_3$.

Since the light is greatly refracted at the incident surface 31, the emission angle $S_{out1}$ of the light emitted from the conjugate plane PC is great. As the emission angle $S_{out1}$ becomes greater, the aperture of the emitting surface 33 becomes larger. This is because light having a great emission angle $S_{out1}$ reaches a position away from the optical axis $C_3$ on the emitting surface 33.

On the other hand, the reflecting surface 32 of the light guide projection optical element 3 illustrated in FIG. 7B is inclined with respect to an X-Z plane. The inclination direction of the reflecting surface 32 is the clockwise rotation direction with respect to an X-Z plane as viewed from the −X axis direction.

The reflecting surface 32 is inclined with respect to the traveling direction (+Z axis direction) of light in a direction such that an optical path in the light guide projection optical element 3 becomes wider. The reflecting surface 32 is inclined so that the optical path in the light guide projection optical element 3 becomes wider in the traveling direction (+Z axis direction) of light. Here, the traveling direction of light is the traveling direction of light in the light guide projection optical element 3. Thus, in the first embodiment, the traveling direction of light is a direction parallel to the optical axis $C_3$ of the light guide projection optical element 3. That is, in the first embodiment, the traveling direction of light is the +Z axis direction.

In the direction of the optical axis $C_3$ of the emitting surface 33, the reflecting surface 32 is inclined to face toward the emitting surface 33. "Face toward the emitting surface 33" indicates that the reflecting surface 32 can be seen from the emitting surface 33 side (+Z axis direction side).

Light entering through the incident surface 31 is reflected by the reflecting surface 32 and reaches the conjugate plane PC.

The incident angle of the light on the reflecting surface 32 is an incident angle $S_4$. The reflection angle of the light at the reflecting surface 32 is a reflection angle $S_5$. According to the law of reflection, the reflection angle $S_5$ is equal to the incident angle $S_4$. A perpendicular line $m_3$ to the reflecting surface 32 is indicated by a dot-and-dash line in FIG. 7B.

The light is incident on the conjugate plane PC at an incident angle $S_6$. The light is emitted from the conjugate plane PC at an emission angle $S_{out2}$. The emission angle $S_{out2}$ is equal to the incident angle $S_6$. A perpendicular line $m_4$ to the conjugate plane PC is indicated by a dot-and-dash line in FIG. 7B. The perpendicular line $m_4$ to the conjugate plane PC is parallel to the optical axis $C_3$.

The incident angle $S_4$ is greater than the incident angle $S_1$ because of the inclination of the reflecting surface 32.

Further, the reflection angle $S_5$ is greater than the reflection angle $S_2$. Thus, the incident angle $S_6$ is less than the incident angle $S_3$. When the inclination angles of light emitted from the conjugate planes PC with respect to the optical axes $C_3$ are compared, the emission angle $S_{out2}$ is less than the emission angle $S_{out1}$.

The reflecting surface 32 is inclined so that the optical path in the light guide projection optical element 3 becomes wider in the traveling direction (+Z axis direction), which can reduce the aperture of the emitting surface 33.

The reflecting surface 32 is inclined to face toward the emitting surface 33 in the direction of the optical axis $C_3$ of the emitting surface 33, which can reduce the aperture of the emitting surface 33.

To make the emission angle $S_{out2}$ less than the emission angle $S_{out1}$, it is also possible to form the reflecting surface 32 into a curved surface shape. Specifically, the reflecting surface 32 is formed by a curved surface such that the optical path becomes wider in the traveling direction (+Z axis direction) of light.

In the direction of the optical axis $C_3$ of the emitting surface 33, the reflecting surface 32 is formed by a curved surface facing toward the emitting surface 33.

The inclination of the reflecting surface 32 functions to decrease the emission angle $S_{out}$ at which light reflected by the reflecting surface 32 is emitted from the conjugate plane PC. Thus, the inclination of the reflecting surface 32 can reduce the aperture of the emitting surface 33, downsizing the headlight module 100. In particular, it contributes to thinning the headlight module 100 in the height direction (Y axis direction).

When there is no need to reduce the aperture of the emitting surface 33, the reflecting surface 32 may be parallel to a Z-X plane.

<Light Distribution Pattern>

In the light distribution pattern of the low beam of the motorcycle headlight device, the cutoff line 91 has a horizontal linear shape. The cutoff line 91 has a linear shape extending in the left-right direction (X axis direction) of the vehicle.

Further, the light distribution pattern of the low beam of the motorcycle headlight device is brightest in a region on the lower side of the cutoff line 91. The region on the lower side of the cutoff line 91 is a high illuminance region.

The conjugate plane PC of the light guide projection optical element 3 and the irradiated surface 9 are in an optically conjugate relation with each other, through the emitting surface 33. The ridge line portion 321 is located at the lowermost end (−Y axis direction side) of the region in the conjugate plane PC through which light passes. Thus, the ridge line portion 321 corresponds to the cutoff line 91 on the irradiated surface 9. The cutoff line 91 is located at the uppermost end (+Y axis direction side) of the light distribution pattern on the irradiated surface 9.

The headlight module 100 according to the first embodiment directly projects the light distribution pattern formed on the conjugate plane PC onto the irradiated surface 9 through the emitting surface 33. Thus, the light distribution on the conjugate plane PC is directly projected onto the irradiated surface 9.

Thus, to achieve a light distribution pattern that is brightest in a region on the lower side of the cutoff line 91, the luminous intensity is highest in a region on the +Y axis direction side of the ridge line portion 321 on the conjugate plane PC. The luminous intensity distribution is highest in a region on the +Y axis direction side of the ridge line portion 321 on the conjugate plane PC.

The light reflected by the reflecting surface 35 and emitted from the emitting surface 36 is radiated onto the irradiated surface 9. For example, the light reflected by the reflecting surface 35 and emitted from the emitting surface 36 can be superposed with the light distribution pattern formed on the conjugate plane PC. Also, the light reflected by the reflecting surface 35 and emitted from the emitting surface 36 can be radiated to the upper side (+Y axis side) of the cutoff line 91 to illuminate road signs or the like specified by regulations, such as a road traffic law.

Figure 8:
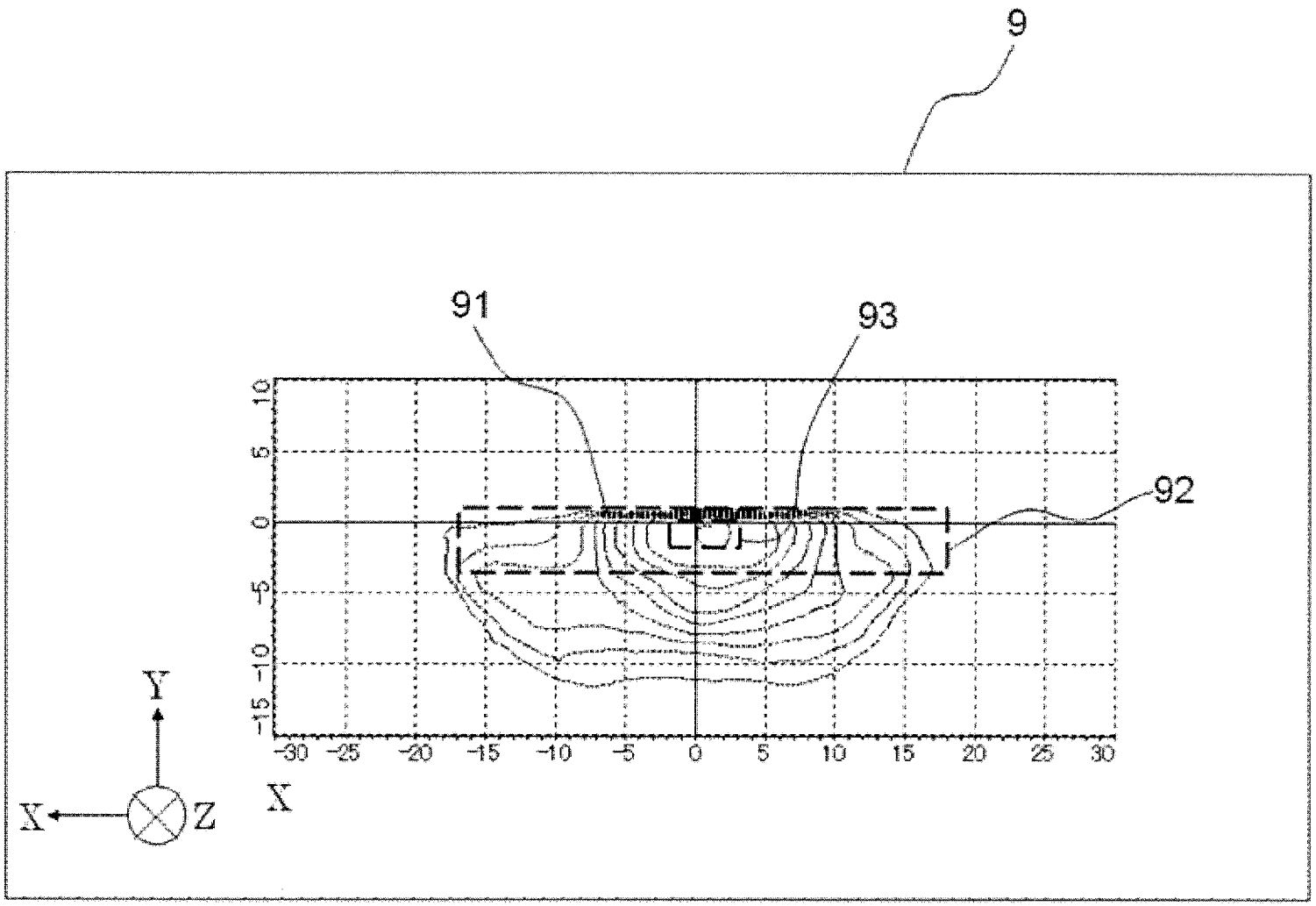
FIG. 8 is a diagram illustrating, in contour display, an illuminance distribution of the headlight module 100 according to the first embodiment.
Figure 9:
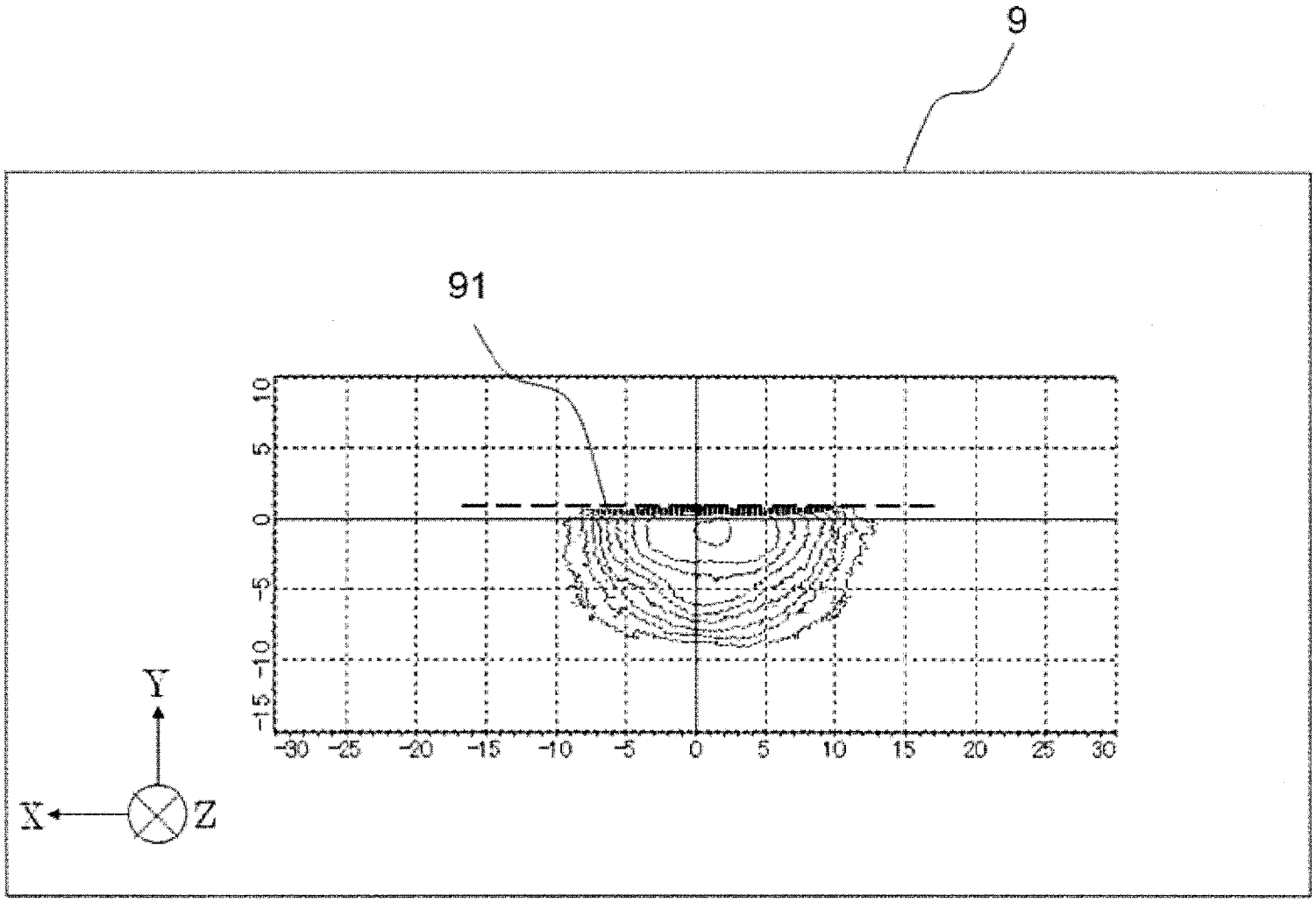
FIG. 9 is a diagram illustrating, in contour display, an illuminance distribution of the headlight module 100 according to the first embodiment.
Figure 10:
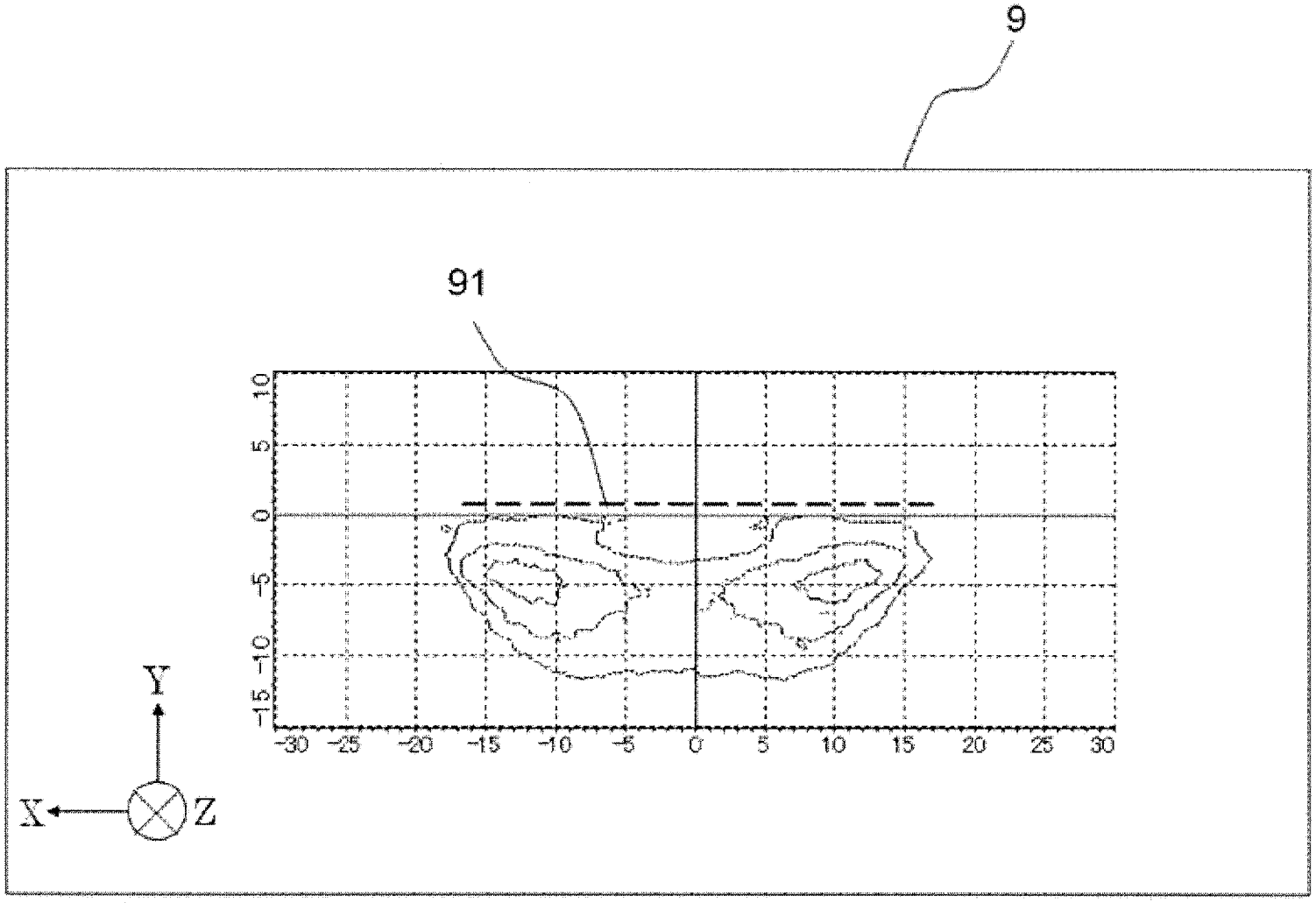
FIG. 10 is a diagram illustrating, in contour display, an illuminance distribution of the headlight module 100 according to the first embodiment.

FIGS. 8, 9, and 10 are diagrams illustrating, in contour display, illuminance distributions of the headlight module 100 according to the first embodiment. FIG. 8 is an illuminance distribution when the light guide projection optical element 3 illustrated in FIG. 2 is used. This illuminance distribution is an illuminance distribution projected on the irradiated surface 9 located 25 m ahead (+Z axis direction). Further, this illuminance distribution is obtained by simulation.

"Contour display" refers to displaying by means of a contour plot. "Contour plot" refers to a diagram depicting a line joining points of equal value.

As can be seen from FIG. 8, the cutoff line 91 of the light distribution pattern is a sharp straight line. Intervals between contour lines are small on the lower side of the cutoff line 91. The light distribution has a region having the highest illuminance (high illuminance region) 93 near the cutoff line 91.

In FIG. 8, a center of the high illuminance region 93 is located on the +Y axis direction side of a center of the light distribution pattern. In FIG. 8, the entire high illuminance region 93 is on the +Y axis direction side of the center of the light distribution pattern. The center of the light distribution pattern is a center of the light distribution pattern in its width direction and is a center of the light distribution pattern in its height direction.

It can be seen that a region 92 on the lower side (−Y axis direction side) of the cutoff line 91 in the light distribution pattern is brightest. The region 92 on the lower side of the cutoff line 91 in the light distribution pattern includes the brightest region 93 in the light distribution pattern.

In FIG. 8, the region 92 on the lower side of the cutoff line 91 is located between the center of the light distribution pattern and the cutoff line 91.

Thus, the headlight module 100 can easily form a complicated light distribution pattern. In particular, it is possible to make a region on the lower side of the cutoff line 91 brightest while keeping the cutoff line 91 sharp.

FIG. 9 is a diagram illustrating an illuminance distribution of only the light emitted from the emitting surface 33. The emitting surface 33 projects the light distribution pattern formed on the conjugate plane PC, onto the irradiated surface 9. It can be seen that the cutoff line 91 of the light distribution pattern projected onto the irradiated surface 9 is sharp. Further, in the light distribution pattern projected by the emitting surface 33, a region located at a center in the horizontal direction (X axis direction) and on the lower side of the cutoff line 91 is brightest.

FIG. 10 is a diagram illustrating an illuminance distribution of only the light emitted from the emitting surface 36. By adjusting the curvature of at least one of the incident surface 31, reflecting surface 35, and emitting surface 36, the light emitted from the emitting surface 36 is widely radiated to the lower side (−Y axis direction side) of the cutoff line 91.

In FIG. 10, the upper end portion (end portion on the +Y axis side) of the irradiation region of only the light emitted from the emitting surface 36 is located on the lower side (−Y axis direction side) of the cutoff line 91. Thus, the light emitted from the emitting surface 36 has no effect on the sharpness of the cutoff line 91.

The light emitted from the emitting surface 36 is radiated to the irradiation region of the low beam. In FIG. 8, the light emitted from the emitting surface 36 is superposed with the light emitted from the emitting surface 33 and forms the light distribution pattern of the low beam.

Light reaching the reflecting surface 35 was unable to be effectively used and was lost light. However, as illustrated in FIG. 10, it is possible to use light reaching the reflecting surface 35 as effective light. It is possible to use light reaching the reflecting surface 35 as effective light irradiating the region of the low beam. Thus, it is possible to provide a headlight module having high light use efficiency.

In FIG. 10, for example, the light emitted from the emitting surface 36 is radiated to the lower side of the cutoff line 91. However, it is easy that the light illuminates the upper side (+Y axis side) of the cutoff line 91, serving as light for illuminating road signs or the like specified by regulations, such as a road traffic law.

For example, the inclination angle of the reflecting surface 35 is adjusted by rotating the reflecting surface 35 about the X axis. The inclination angle of the emitting surface 36 is adjusted by rotating the emitting surface 36 about the X axis. With these adjustments, the light emitted from the emitting surface 36 irradiates the upper side of the cutoff line 91.

Further, by adjusting the curvature in the X axis direction of at least one of the incident surface 31, reflecting surface 35, and emitting surface 36, it is possible to easily adjust the width of the light distribution. Also, by adjusting the curvature in the Y axis direction of at least one of the incident surface 31, reflecting surface 35, and emitting surface 36, it is possible to easily adjust the height of the light distribution.

To form the cutoff line 91, the headlight module 100 need not use a light blocking plate, which causes reduction in the light use efficiency, as in the conventional headlight device. The headlight module 100 can use light efficiently by virtue of the reflecting surface 35.

Further, to provide the high illuminance region in the light distribution pattern, the headlight module 100 needs no complicated optical system. Thus, the headlight module 100 can provide a small and simple headlight device having improved light use efficiency.

The headlight module 100 according to the first embodiment of the present invention has been described by taking as an example the low beam of a headlight device for a motorcycle. However, this is not mandatory. For example, the headlight module 100 is also applicable to the low beam of a headlight device for a motor tricycle or the low beam of a headlight device for a four-wheeled automobile.

Figure 11:
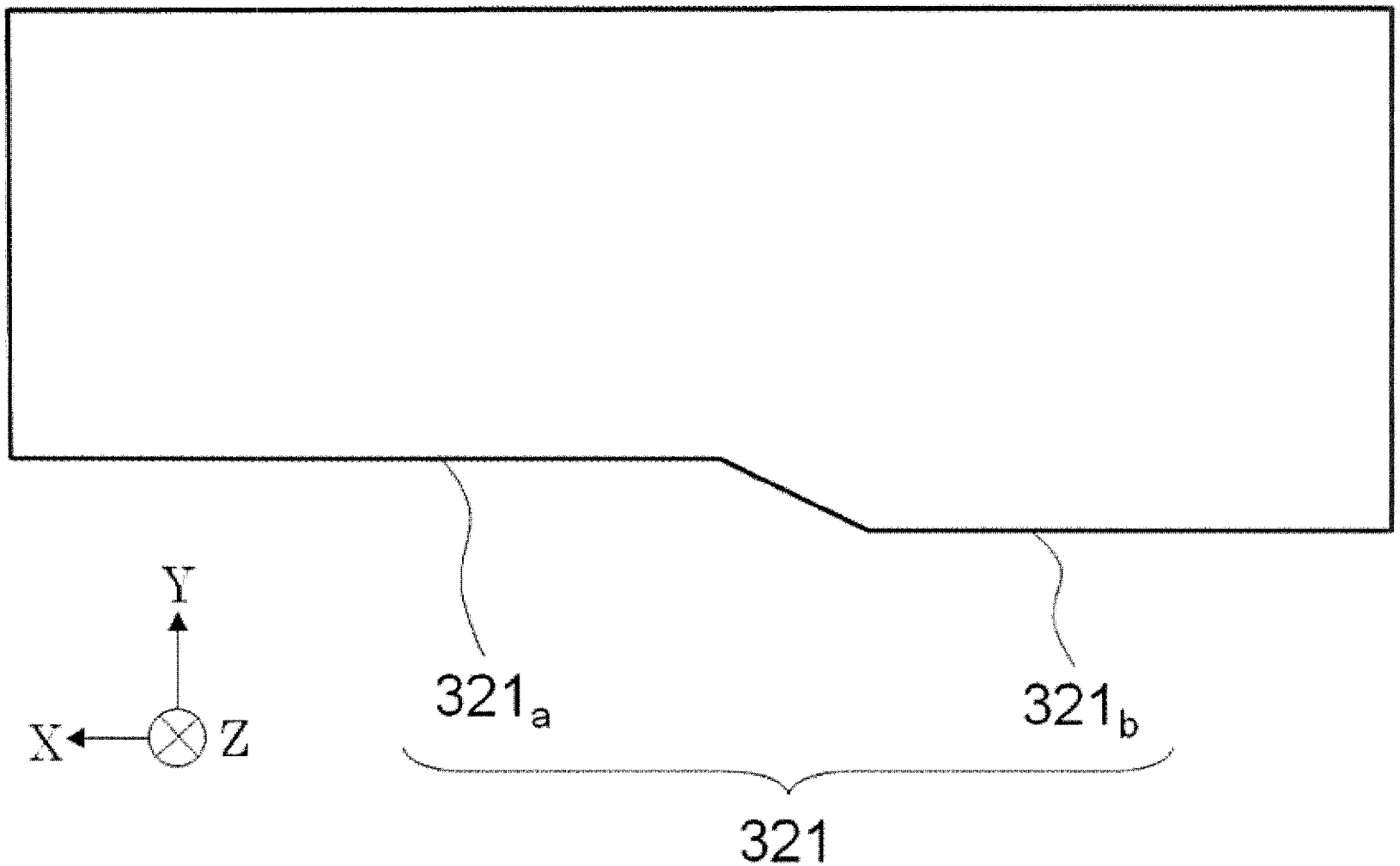
FIG. 11 is a schematic diagram illustrating an example of a cross-sectional shape in a conjugate plane PC of the light guide projection optical element 3 of the headlight module 100 according to the first embodiment.

FIG. 11 is a schematic diagram illustrating an example of the cross-sectional shape of the light guide projection optical element 3 in the conjugate plane PC. The shape of the ridge line portion 321 may be, for example, a stepped shape as illustrated in FIG. 11. The shape of the ridge line portion 321 illustrated in FIG. 11 is a bent line shape.

When viewed from the rear side (−Z axis direction), a ridge line portion $\mathbf{321}_a$ on the left side (+X axis direction side) is located above (+Y axis direction) a ridge line portion $\mathbf{321}_b$ on the right side (−X axis direction side).

The conjugate plane PC and the irradiated surface 9 are in optically conjugate relation with each other, through the emitting surface 33. Thus, the shape of the light distribution pattern on the conjugate plane PC is inverted in the up-down direction and left-right direction and projected on the irradiated surface 9. Thus, on the irradiated surface 9, a cutoff line on the left side in the traveling direction of the vehicle is high and a cutoff line on the right side is low.

This makes it possible to easily form a "rising line" along which the irradiation on a walkway side (left side) rises for identification of pedestrians and signs. This description assumes that the vehicle travels on the left side of a road.

The positions of the ridge line portions $\mathbf{321}_a$ and $\mathbf{321}_b$ in the Y axis direction are different from each other, so that the amounts of light reaching the reflecting surface 35 are also different from each other. Thereby, the amounts of light on the right side and left side of the vehicle can be adjusted.

Further, in some vehicles, multiple headlight modules are arranged, and the light distribution patterns of the respective modules are combined to form a light distribution pattern. A light distribution pattern may be formed by arranging multiple headlight modules and combining the light distribution patterns of the respective modules. Even in such a case, the headlight module 100 according to the first embodiment can be easily applied.

In the headlight module 100, by adjusting the curved surface shape of the incident surface 31 of the light guide projection optical element 3, it is possible to change the width and height of the light distribution pattern. It is also possible to change the light distribution.

Here, the horizontal direction of the incident surface 31 corresponds to the horizontal direction of the vehicle. The horizontal direction of the incident surface 31 corresponds to the horizontal direction of the light distribution pattern projected from the vehicle. The vertical direction of the incident surface 31 corresponds to the vertical direction of the vehicle. The vertical direction of the incident surface 31 corresponds to the vertical direction of the light distribution pattern projected from the vehicle.

Further, in the headlight module 100, by adjusting the optical positional relationship between the condensing optical element 2 and the light guide projection optical element 3 or the shape of the incident surface 31 of the light guide projection optical element 3, it is possible to change the width and height of the light distribution pattern. It is also possible to change the light distribution.

Further, by using the reflecting surface 32, it is possible to easily change the light distribution. For example, by changing the inclination angle b of the reflecting surface 32, it is possible to change the position of the high illuminance region.

Further, in the headlight module 100, by adjusting the inclination or curved surface shape of the reflecting surface 35 of the light guide projection optical element 3, it is possible to change the width and height of the light distribution pattern. It is also possible to change the light distribution.

Further, in the headlight module 100, by adjusting the curved surface shape of the emitting surfaces 33 and 36 of the light guide projection optical element 3, it is possible to change the width and height of the light distribution pattern. It is also possible to change the light distribution.

Further, in the headlight module 100, the shape of the cutoff line 91 can be set by the shape of the ridge line portion 321 of the light guide projection optical element 3. The light distribution pattern can be formed by the shape of the light guide projection optical element 3.

Thus, in particular, it is not necessary that the shapes or the like of the condensing optical elements 2 vary between multiple headlight modules. The condensing optical elements 2 can be common parts. This can reduce the number of types of parts, improving ease of assembly, and reducing manufacturing cost.

Further, the function of arbitrarily adjusting the width and height of the light distribution pattern and the function of arbitrarily adjusting the light distribution may be provided by the headlight module 100 as a whole. The optical components of the headlight module 100 include the condensing optical element 2 and light guide projection optical element 3. The functions can be shared by optical surfaces of the condensing optical element 2 and light guide projection optical element 3 constituting the headlight module 100.

For example, the reflecting surface 32 of the light guide projection optical element 3 may be formed into a curved surface shape to have power and form a light distribution.

However, regarding the reflecting surface 32, it is not necessarily required that all the light reach the reflecting surface 32. Thus, when the reflecting surface 32 is shaped, a limited amount of light contributes to the formation of the light distribution pattern. A limited amount of light is reflected by the reflecting surface 32 and gives the effect due to the shape of the reflecting surface 32 to the light distribution pattern. To optically affecting all the light and easily change the light distribution pattern, it is preferable to provide the incident surface 31 with power to form the light distribution.

In the first embodiment, the headlight module 100 includes the light source 1, condensing optical element 2, and light guide projection optical element 3. The light source 1 emits light. The condensing optical element 2 concentrates the light emitted from the light source 1. The light emitted from the condensing optical element 2 enters the light guide projection optical element 3 through the incident surface 31. Part or all of the light entering the light guide projection optical element 3 is reflected by the reflecting surface 32 or 35 of the light guide projection optical element 3. The light reflected by the reflecting surface 32 or 35 is emitted from the emitting surface 33 or 36 of the light guide projection optical element 3. The incident surface 31 is formed by a curved surface that changes the divergence angle of incident light.

The headlight module 100 includes the light source 1 and optical element 3. The light source 1 emits light. The optical element 3 includes the reflecting surface 32 for reflecting the light emitted from the light source 1. The optical element 3 includes emitting surfaces 33 and 36 for emitting the reflected light reflected by the reflecting surface 32 or 35. The emitting surface 33 has positive refractive power. In the direction of the optical axis $C_3$ of the reflecting surface 33, the edge portion 321 on the emitting surface 33 side of the reflecting surface 32 includes the point Q located at a focal position of the reflecting surface 33.

In the first embodiment, as an example, the optical element 3 is described as the light guide projection optical element 3. Further, as an example, the edge portion 321 is described as the ridge line portion 321.

In the direction of the optical axis $C_3$ of the emitting surface 33, the edge portion 321 of the reflecting surface 32 in the traveling direction of the reflected light includes the point Q located at the focal position of the emitting surface 33.

The reflected light reflected by the reflecting surface 32 undergoes no reflection after entering the optical element 3 and before being reflected by the reflecting surface 32.

The reflected light reflected by the reflecting surface 32 reaches the emitting surface 33 without undergoing further reflection.

The reflected light reflected by the reflecting surface 35 undergoes no reflection after entering the optical element 3 and before being reflected by the reflecting surface 35.

The reflected light reflected by the reflecting surface 35 reaches the emitting surface 33 or 36 without undergoing further reflection.

The reflected light that has entered the optical element 3 and has been reflected by the reflecting surface 32 and the light that has entered the optical element 3 and has not been reflected by the reflecting surface 32 are superposed on the plane PC passing through the point Q located at the focal position on the edge portion 321 and being perpendicular to the optical axis $C_3$ of the emitting surface 33. Thereby, the headlight module 100 forms a high luminous intensity region on the plane PC.

The reflected light that has entered the optical element 3 and has been reflected by the reflecting surface 32 and the light that has entered the optical element 3 and has not been reflected by the reflecting surface 32 are superposed on the plane PC including the focal point of the emitting surface 33 and being perpendicular to the optical axis $C_3$ of the emitting surface 33. Thereby, the headlight module 100 forms a high luminous intensity region on the plane PC.

In the direction of the optical axis $C_3$, the reflecting surface 32 is inclined to face toward the emitting surface 33.

The optical element 3 includes the incident portion 31 for receiving light emitted from the light source 1. The incident portion 31 has refractive power.

The incident portion 31 includes a refractive surface 31 having refractive power.

As an example, the incident portion 31 is described as the incident surface 31.

The reflected light reflected by the reflecting surface 32 directly reaches the emitting surface 33.

The reflecting surface 32 is a total reflection surface.

The reflected light reflected by the reflecting surface 35 directly reaches the emitting surface 33 or 36.

The reflecting surface 35 is a total reflection surface.

The incident portion 34 is connected to the edge portion 321.

As an example, the incident portion 34 is described as the incident surface 34.

The inside of the optical element 3 is filled with refractive material.

First Modification Example

Further, the first embodiment has described a case where the single headlight module 100 includes the single light source 1 and the single condensing optical element 2. However, the number of light sources 1 in the single headlight module is not limited to one. The number of condensing optical elements 2 in the single headlight module is also not limited to one. A light source 1 and a condensing optical element 2 will be collectively referred to as a light source module 15.

Figure 12:
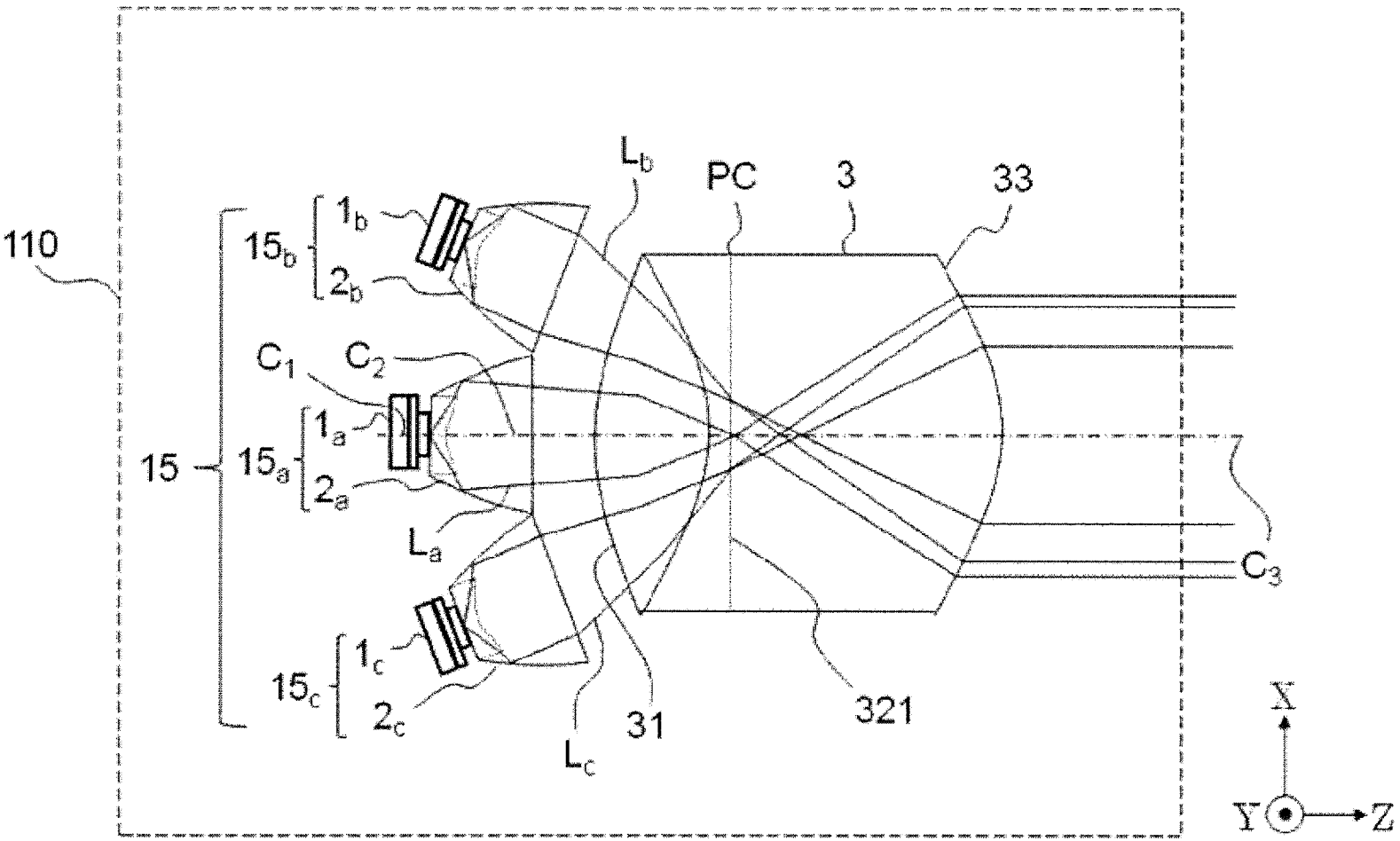
FIG. 12 is a configuration diagram illustrating a configuration of a headlight module 110 according to the first embodiment.

FIG. 12 is a configuration diagram illustrating a configuration of a headlight module 110 according to the first embodiment. FIG. 12 is a view of the headlight module 110 as viewed from the +Y axis direction.

For example, the headlight module 110 illustrated in FIG. 12 includes three light source modules 15. A light source module $\mathbf{15}_a$ includes a light source $\mathbf{1}_a$ and a condensing optical element $\mathbf{2}_a$. A light source module $\mathbf{15}_b$ includes a light source $\mathbf{1}_b$ and a condensing optical element $\mathbf{2}_b$. A light source module $\mathbf{15}_c$ includes a light source $\mathbf{1}_c$ and a condensing optical element $\mathbf{2}_c$.

The light source modules $15_a$, $15_b$, and $15_c$ will be collectively referred to as the light source modules 15. Also, when features common to the light source modules $15_a$, $15_b$, and $15_c$ are described, each of them will be referred to as the light source module 15.

When viewed from the Y axis direction, the light source $1_a$ and condensing optical element $2_a$ are disposed on the optical axis $C_3$ of the light guide projection optical element 3. When viewed from the X axis direction, an optical axis $C_2$ of the condensing optical element $2_a$ and an optical axis $C_1$ of the light source $1_a$ are inclined with respect to the optical axis $C_3$, so the light source $1_a$ and condensing optical element $2_a$ are not disposed on the optical axis $C_3$. The light source $1_a$ and condensing optical element $2_a$ constitute the light source module $15_a$.

The light source $1_b$ is disposed on the +X axis side of the light source $1_a$. The condensing optical element $2_b$ is disposed on the +X axis side of the condensing optical element $2_a$. The light source $1_b$ and condensing optical element $2_b$ constitute the light source module $15_b$. The light source module $15_b$ is disposed on the +X axis side of the light source module $15_a$.

The light source $1_c$ is disposed on the −X axis side of the light source $1_a$. The condensing optical element $2_c$ is disposed on the −X axis side of the condensing optical element $2_a$. The light source $1_c$ and condensing optical element $2_c$ constitute the light source module $15_c$. The light source module $15_c$ is disposed on the −X axis side of the light source module $15_a$.

Light $L_a$ emitted from the light source $1_a$ passes through the condensing optical element $2_a$ and enters the light guide projection optical element 3 through the incident surface 31. When viewed from the Y axis direction, a position in the X axis direction at which the light $L_a$ is incident on the incident surface 31 is located on the optical axis $C_3$ of the light guide projection optical element 3.

The light $L_a$ entering through the incident surface 31 is reflected by the reflecting surface 32 or 35. The light $L_a$ reflected by the reflecting surface 32 is emitted from the emitting surface 33. The light $L_a$ reflected by the reflecting surface 35 is emitted from the emitting surface 33 or 36. When viewed from the Y axis direction, positions in the X axis direction at which the light $L_a$ is emitted from the emitting surfaces 33 and 36 are located on the optical axis $C_3$ of the light guide projection optical element 3.

Light $L_b$ emitted from the light source $1_b$ passes through the condensing optical element $2_b$ and enters the light guide projection optical element 3 through the incident surface 31. When viewed from the Y axis direction, a position in the X axis direction at which the light $L_b$ is incident on the incident surface 31 is on the +X axis side of the optical axis $C_3$ of the light guide projection optical element 3.

The light $L_b$ entering through the incident surface 31 is reflected by the reflecting surface 32 or 35. The light $L_b$ reflected by the reflecting surface 32 is emitted from the emitting surface 33. The light $L_b$ reflected by the reflecting surface 35 is emitted from the emitting surface 33 or 36. When viewed from the Y axis direction, positions in the X axis direction at which the light $L_b$ is emitted from the emitting surfaces 33 and 36 are on the −X axis side of the optical axis $C_3$ of the light guide projection optical element 3.

Light $L_c$ emitted from the light source $1_c$ passes through the condensing optical element $2_c$ and enters the light guide projection optical element 3 through the incident surface 31. When viewed from the Y axis direction, a position in the X axis direction at which the light $L_c$ is incident on the incident surface 31 is on the −X axis side of the optical axis $C_3$ of the light guide projection optical element 3.

The light $L_c$ entering through the incident surface 31 is reflected by the reflecting surface 32 or 35. The light $L_c$ reflected by the reflecting surface 32 is emitted from the emitting surface 33. The light $L_c$ reflected by the reflecting surface 35 is emitted from the emitting surface 33 or 36. When viewed from the Y axis direction, positions in the X axis direction at which the light $L_c$ is emitted from the emitting surfaces 33 and 36 are on the +X axis side of the optical axis $C_3$ of the light guide projection optical element 3.

The configuration illustrated in FIG. 12 can widen the light beam passing through the conjugate plane PC, in the horizontal direction (X axis direction). Since the conjugate plane PC and irradiated surface 9 are in a conjugate relation with each other, the width of the light distribution pattern in the horizontal direction can be increased.

Such a configuration makes it possible to increase the amount of light without providing a plurality of the headlight modules 100. The headlight module 110 can downsize a headlight device 10. The headlight module 110 can also easily achieve a light distribution wide in the horizontal direction.

Further, in FIG. 12, the multiple light source modules 15 are arranged in the horizontal direction (X axis direction). However, the multiple light source modules 15 may be arranged in the vertical direction (Y axis direction). For example, light source modules 15 are arranged in two levels in the Y axis direction. This can increase the amount of light of the headlight module 110.

Further, by performing a control for individually turning on the light sources $1_a$, $1_b$, and $1_c$ or a control for individually turning off the light sources 1*a*, 1*b*, and 1*c*, it is possible to select an illuminated area in front of the vehicle. Thus, it is possible to provide the headlight module 110 with a light distribution change function. That is, the headlight module 110 can have a function of changing the light distribution.

For example, when a vehicle turns right or left at an intersection, a light distribution wider in the direction in which the vehicle turns than the light distribution of a normal low beam is required. In such a case, by performing a control for individually turning on or off the light sources $1_a$, $1_b$, and $1_c$, it is possible to obtain an optimum light distribution corresponding to the traveling situation. The driver can obtain better visibility in the traveling direction by changing the light distribution of the headlight module 110.

The light guide projection optical element 3 of the headlight module 110 can be replaced with a light guide projection optical element 301 to be described in a second embodiment.

Second Modification Example

Figure 16A:
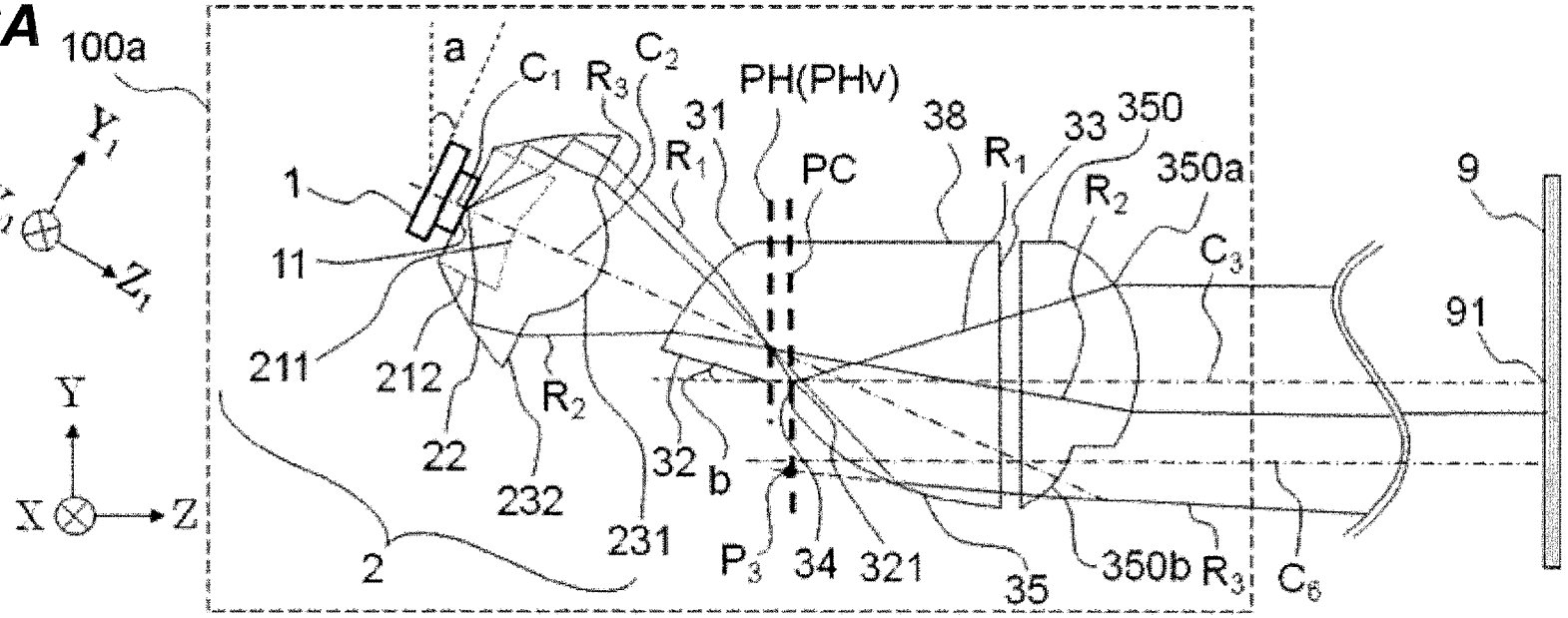
FIGS. 16A and 16B are configuration diagrams illustrating a configuration of a headlight module 100*a* according to the first embodiment.
Figure 16B:
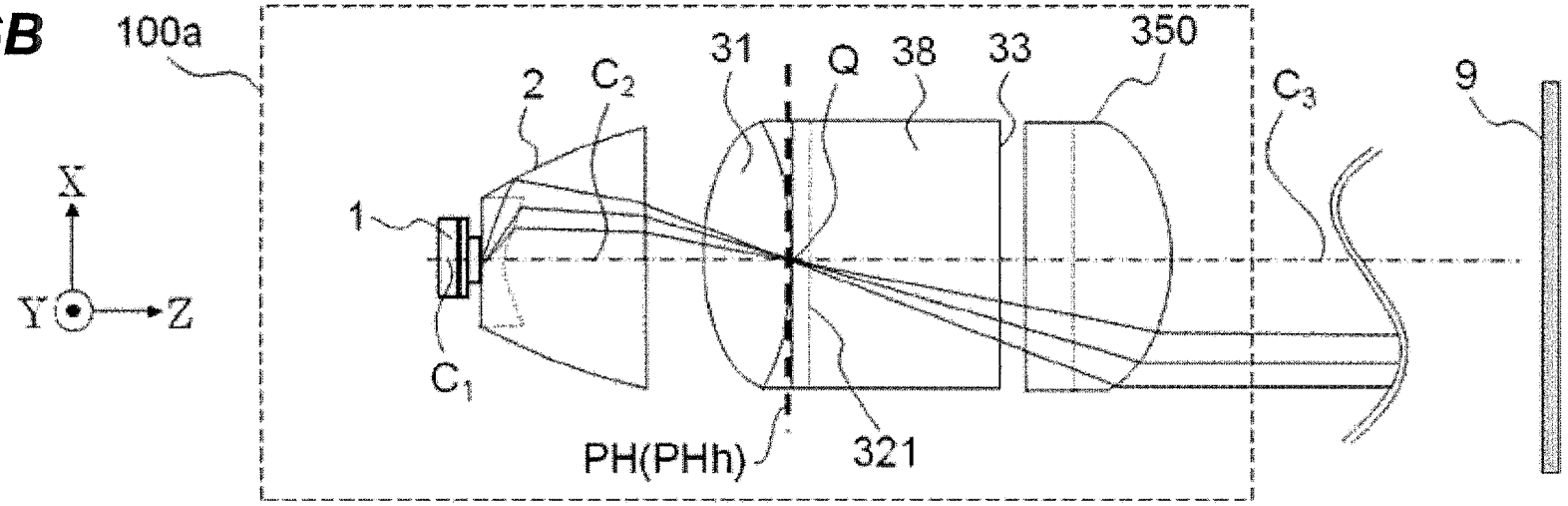

FIGS. 16A and 16B are configuration diagrams illustrating a configuration of a headlight module 100*a* obtained, for example, by forming the emitting surfaces 33 and 36 illustrated in FIGS. 1A and 1B into a flat surface and adding a projection optical element 350, such as a projection lens.

A light guide projection optical element 38 of the headlight module 100*a* is obtained by forming the emitting surfaces 33 and 36 of the light guide projection optical element 3 illustrated in FIGS. 1A and 1B into, for example, a flat surface. The projection optical element 350 is provided with the projecting function of the emitting surfaces 33 and 36 of the light guide projection optical element 3. A portion corresponding to the emitting surface 33 of the projection optical element 350 is an emitting surface 350*a*. A portion corresponding to the emitting surface 36 of the projection optical element 350 is an emitting surface 350*b*.

The projection optical element 350 is located, for example, on the +Z axis side of the emitting surface 33. Light emitted from the emitting surface 33 is incident on the projection optical element 350.

The projection optical element 350 is provided with all or part of the projecting function of the emitting surfaces 33 and 36 of the light guide projection optical element 3. The headlight module 100*a* illustrated in FIGS. 16A and 16B implements the function of the emitting surfaces 33 and 36 of the light guide projection optical element 3 illustrated in FIGS. 1A and 1B by means of the projection optical element 350 and the emitting surfaces 33 and 36. Thus, for the description of the function or the like thereof, the description of the emitting surfaces 33 and 36 in the first embodiment is substituted. The projection optical element 350 projects a light distribution pattern.

In the headlight module 100*a* illustrated in FIGS. 16A and 16B, it is possible to provide the emitting surface 33 with refractive power and implement the function of the emitting surfaces 33 and 36 of the light guide projection optical element 3 illustrated in FIGS. 1A and 1B by means of the combination of the emitting surface 33 and projection optical element 350.

The optical axis $C_3$ is an optical axis of a portion having the projecting function. Thus, when the emitting surface 33 is a flat surface, the optical axis $C_3$ is an optical axis of the emitting surface 350*a* of the projection optical element 350. Likewise, when the emitting surface 33 is a flat surface, the optical axis $C_6$ is an optical axis of the emitting surface 350*b* of the projection optical element 350. When the emitting surface 33 and projection optical element 350 have the projecting function, the optical axis $C_3$ is an optical axis of a combined lens obtained by combining the emitting surface 33 and the emitting surface 350*a* of the projection optical element 350. Likewise, the optical axis $C_6$ is an optical axis of a combined lens obtained by combining the emitting surface 33 and the emitting surface 350*b* of the projection optical element 350. The portion having the projecting function is referred to as a projection optical portion or projection portion.

"Combined lens" refers to a single lens exhibiting the property of the combination of multiple lenses.

The emitting surfaces 350*a* and 350*b* of the projection optical element 350 may be separated into two projection optical elements.

Second Embodiment

FIGS. 13A and 13B are configuration diagrams illustrating a configuration of a headlight module 120 according to the second embodiment of the present invention. Elements that are the same as in FIGS. 1A and 1B will be given the same reference characters, and descriptions thereof will be omitted. The elements that are the same as in FIGS. 1A and 1B are the light source 1 and condensing optical element 2.

As illustrated in FIGS. 13A and 13B, the headlight module 120 according to the second embodiment includes the light source 1 and light guide projection optical element 301. The headlight module 120 may also include the condensing optical element 2. The headlight module 120 differs from the headlight module 100 according to the first embodiment in having the light guide projection element 301 instead of the light guide projection element 3.

The light guide projection element 301 differs in shape from the light guide projection element 3. In the light guide projection element 301, portions having the same functions as those of the light guide projection element 3 will be given the same reference characters, and descriptions thereof will be omitted. Portions having the same functions as those of the light guide projection element 3 are the incident surfaces 31 and 34, the reflecting surfaces 32 and 35, and the emitting surface 33.

In the headlight module 100, part of the light entering through the incident surface 31 of the light guide projection optical element 3 is reflected by the reflecting surface 35 and emitted from the emitting surface 33 or 36. The emitting surface 33 projects a light distribution pattern. The emitting surface 36 projects a light distribution pattern.

However, since the emitting surface is divided into the emitting surfaces 33 and 36, there is a boundary portion between the emitting surfaces 33 and 36. When there is such a boundary portion, it is difficult to manufacture the component as compared to a case where there is no boundary portion. Further, if the accuracy of processing of the component is low, light reaching the boundary portion is not used effectively. That is, light reaching the boundary portion does not contribute to providing illumination ahead of the vehicle.

Further, when a headlight device 10 is viewed from the front side (+Z axis side), the emitting surface of the light guide projection optical element 3 is divided into the two emitting surfaces 33 and 36. Thus, the headlight module 100 may degrade the design of the headlight device 10. Specifically, the emitting surfaces 33 and 36 of the light guide projection optical element 3 is not a single curved surface, but two separate surfaces. Thus, depending on the design of the vehicle or headlight device 10, the two separate emitting surfaces 33 and 36 may be unsuitable in design.

The headlight module 120 according to the second embodiment solves such problems. The headlight module 120 has a small and simple configuration, and has high light use efficiency; the emitting surface of the light guide projection optical element can be formed by a single curved surface.

The headlight module 120 according to the second embodiment can improve the manufacturability and design.

<Light Guide Projection Element 301>

Figure 14:
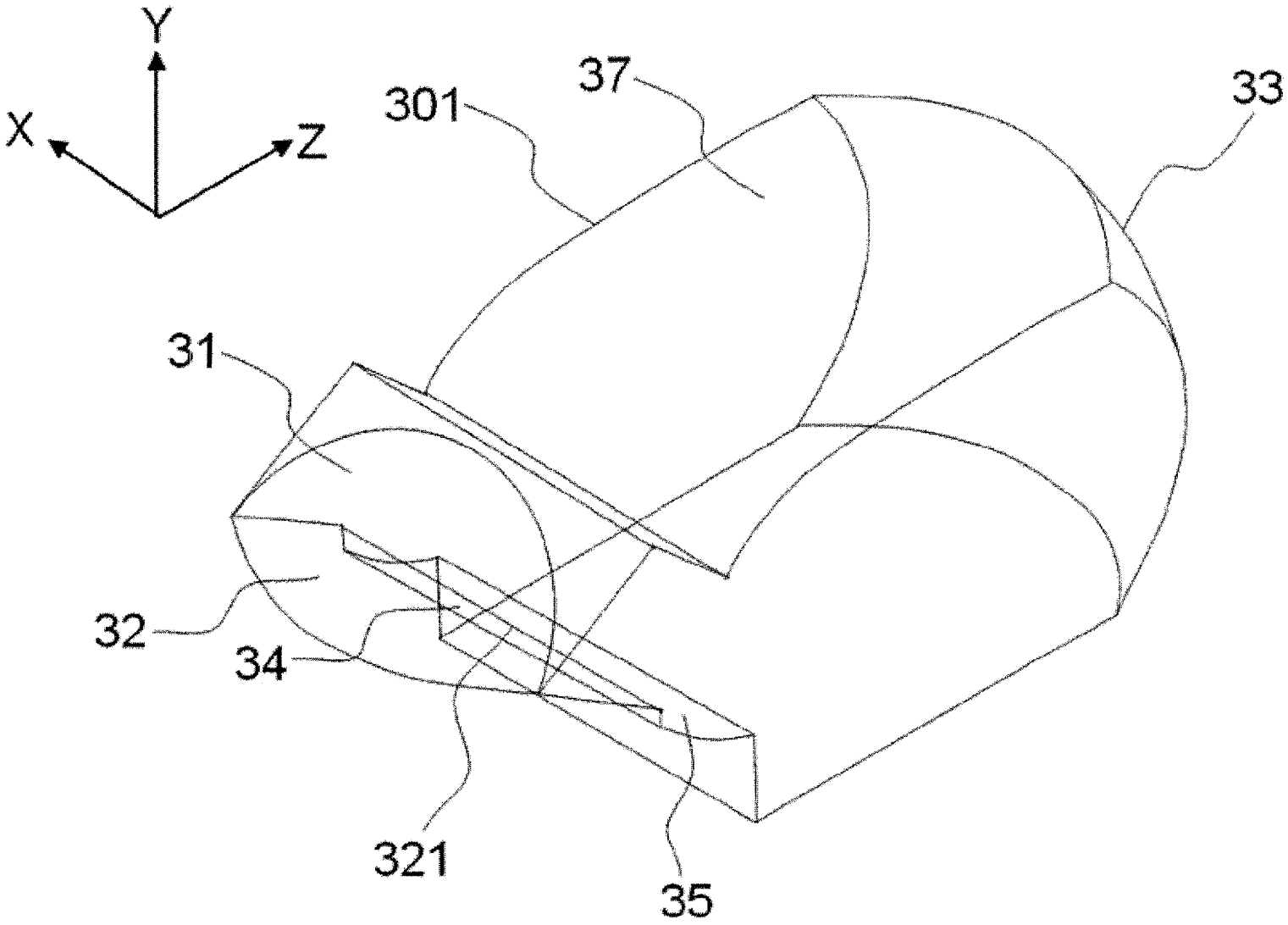
FIG. 14 is a perspective view of a light guide projection optical element 301 of the headlight module 120 according to the second embodiment.

FIG. 14 is a perspective view of the light guide projection optical element 301.

The light guide projection optical element 301 includes the reflecting surface 32, reflecting surface 35, and reflecting surface 37. The light guide projection optical element 301 may include the emitting surface 33. The light guide projection optical element 301 may include the incident surface 31. The light guide projection optical element 301 may also include the incident surface 34.

The light guide projection optical element 301 has a shape obtained by adding the reflecting surface 37 to the shape of the light guide projection optical element 3.

As an example, the incident surface 31 of the light guide projection optical element 301 will be described as a curved surface having positive power in both the X axis direction and Y axis direction.

The light guide projection optical element 301 receives light emitted from the condensing optical element 2. The light guide projection optical element 301 emits the received light in the forward direction (+Z axis direction) from the emitting surface 33. As in the first embodiment, the condensing optical element 2 can be omitted.

The light guide projection optical element 301 is made of transparent resin, glass, silicone, or the like.

The inside of the light guide projection optical element 301 described in the second embodiment is filled with refractive material, for example.

The reflecting surface 37 is formed on the upper surface side of the light guide projection optical element 301. The reflecting surfaces 32 and 35 are formed on the lower surface side of the light guide projection optical element 301. The upper surface is a surface on the +Y axis side. The lower surface is a surface on the −Y axis side.

The reflecting surface 37 is located on the emitting surface 33 side of the reflecting surface 32. Also, the reflecting surface 37 is located on the emitting surface 33 side of the reflecting surface 35. The reflecting surface 37 is located on a traveling direction side of the reflecting surface 32, the traveling direction side being a side toward which light entering the light guide projection optical element 301 travels. The reflecting surface 37 is located on a traveling direction side of the reflecting surface 35, the traveling direction side being a side toward which light entering the light guide projection optical element 301 travels.

In FIGS. 13A and 13B, in the Z axis direction, the reflecting surface 37 overlaps the reflecting surface 35. In the direction of the optical axis $C_3$, the reflecting surface 35 is located between the reflecting surfaces 32 and 37. The reflecting surface 35 is located, for example, on the −Y axis side of the optical axis $C_3$. The reflecting surface 37 is located, for example, on the +Y axis side of the optical axis $C_3$.

The reflecting surface 37 has, for example, a concave shape. The reflecting surface 37 has a convex shape projecting in the +Y axis direction. The reflecting surface 37 has, for example, a concave shape having curvature only in the Y axis direction. The reflecting surface 37 has no curvature in the X axis direction. The reflecting surface 37 is, for example, a cylindrical surface.

The reflecting surface 37 has, for example, a curved surface shape in a plane parallel to a Y-Z plane. Also, the reflecting surface 37 has, for example, a linear shape in a plane parallel to an X-Y plane. The reflecting surface 37 may have, for example, a curved surface shape in a plane parallel to an X-Y plane. The reflecting surface 37 may be a toroidal surface. The curvature of the reflecting surface 37 in the X axis direction is different from that in the Y axis direction, for example.

The reflecting surface 37 is formed so that an optical path becomes wider in the traveling direction of a light ray. Thus, a front surface of the reflecting surface 37 can be seen from the +Z axis side.

As described for the reflecting surface 32, the reflecting surface 37 may be, for example, a mirror surface obtained by mirror deposition. However, it is desirable to cause the reflecting surface 37 to function as a total reflection surface without performing mirror deposition on the reflecting surface 37.

The reflecting surface 37 may be a diffusing surface. The diffusing surface is, for example, an embossed or knurled surface that is finely roughened. It is possible to blur the periphery of a light distribution pattern formed by light reflected by the reflecting surface 37. It is also possible to reduce light distribution unevenness in the light distribution pattern.

<Behavior of Light Rays>

The behavior of light rays reflected by the reflecting surface 32 of the light guide projection optical element 301 is the same as that in the light guide projection optical element 3 of the first embodiment. Also, the behavior of light rays entering the light guide projection optical element 301 and directly emitted from the emitting surface 33 without being reflected by the reflecting surface 32 is the same as that in the light guide projection optical element 3 of the first embodiment. Thus, for the description of the behavior of these light rays, the description of the light guide projection optical element 3 in the first embodiment is substituted.

Thus, the behavior of light rays reaching the reflecting surface 35 will be described here.

As illustrated in FIGS. 13A and 13B, light concentrated by the condensing optical element 2 reaches the incident surface 31 of the light guide optical element 301. For example, in FIGS. 13A and 13B, the incident surface is a refractive surface. Light entering the light guide projection optical element 301 through the incident surface 31 is refracted at the incident surface 31.

In the second embodiment, the incident surface 31 has, for example, a convex shape.

Part of light that has entered through the incident surface 31 and has not been reflected by the reflecting surface 32 reaches the reflecting surface 35. Part of light passing through the +Z axis direction side of the edge portion (ridge line portion 321) on the +Z axis side of the reflecting surface 32 reaches the reflecting surface 35.

The reflecting surface 35 reflects the light guided to the reflecting surface 35 toward the reflecting surface 37.

Light reflected by the reflecting surface 35 and reaching the reflecting surface 37 is reflected by the reflecting surface 37 toward the emitting surface 33. The light reflected by the reflecting surface 37 is emitted from the emitting surface 33 in the forward direction (+Z axis direction).

As illustrated in FIG. 13A, for example, a light ray $R_4$ reflected by the reflecting surface 37 is equivalent to a light ray emitted from a position $P_4$ (intersection $P_4$) on the conjugate plane PC. The position $P_4$ is a position at which a line extended from the light ray $R_4$ reflected by the reflecting surface 35 in the −Z axis direction intersects with the conjugate plane PC.

The intersection $P_4$ of a line segment extended from the light ray $R_4$ of the reflected light toward the reflecting surface 32 side with a plane including a focal point of the emitting surface 33 and being perpendicular to the optical axis $C_3$ of the emitting surface 33 is located on the front surface side of the reflecting surface 32.

Also, the position $P_4$ on the conjugate plane PC is located on the upper side (+Y axis side) of the ridge line portion 321. The light reflected by the reflecting surface 37 is emitted from the emitting surface 33 and reaches the lower side (−Y axis side) of the cutoff line 91 on the irradiated surface 9.

Thus, as in the first embodiment, the light reflected by the reflecting surface 37 and emitted from the emitting surface 33 irradiates the irradiation region of the low beam. The light reflected by the reflecting surface 37 and emitted from the emitting surface 33 is superposed with the light reflected by the reflecting surface 32 and emitted from the emitting surface 33 to form the light distribution pattern of the low beam.

The light reaching the reflecting surface 35 contributes to formation of the light distribution pattern specified by road traffic rules or the like. The light reflected by the reflecting surface 37 and emitted from the emitting surface 33 can be used as effective light radiated to the region of the low beam.

The reflected light $R_4$ emitted from the emitting surface 33 is superposed on the reflected light $R_1$ emitted from the emitting surface 33.

The reflecting surface 37 has been described as having a convex shape having curvature only in the Y axis direction. However, this is not mandatory. For example, by providing the reflecting surface 37 with curvature in the X axis direction, it is possible to adjust the width of the light distribution in the horizontal direction.

The light guide projection optical element 301 includes the reflecting surfaces 35 and 37. The reflecting surface 37 is located between the reflecting surface 32 and the emitting surface 33. The reflecting surface 37 reflects light reflected by the reflecting surface 35.

As described for FIG. 18 of the first embodiment, the reflecting surface 35 may include a reflecting region 35*a* and a reflecting region 35*b*. For example, a light ray $R_{4a}$ reflected by the reflecting region 35*a* is reflected by the reflecting surface 37 and emitted from the emitting surface 33. On the other hand, a light ray $R_{4b}$ reflected by the reflecting region 35*b* is directly emitted from the emitting surface 33.

The light ray $R_{4a}$ corresponds to the light ray $R_{3a}$ illustrated in FIG. 18, for example. The light ray $R_{4b}$ corresponds to the light ray $R_{3b}$ illustrated in FIG. 18, for example.

In this case, the light ray $R_{4a}$ reaches the lower side (−Y axis side) of the cutoff line 91 on the irradiated surface 9. The light ray $R_{4b}$ reaches the upper side (+Y axis side) of the cutoff line 91 on the irradiated surface 9.

As such, the light ray $R_4$ reflected by the reflecting surface 35 can reach the lower side (−Y axis side) of the cutoff line 91 on the irradiated surface 9 or the upper side (+Y axis side) of the cutoff line 91 on the irradiated surface 9. Depending on the setting of the reflecting surface 35, the light ray $R_4$ reflected by the reflecting surface 35 can be used not only as irradiation light for irradiating the lower side of the cutoff line but also for overhead signs.

In the second embodiment, the light guide projection optical element 301 is described as an example of an optical element. The ridge line portion 321 is described as an example of an edge portion of the reflecting surface 32.

Third Modification Example

Figure 17A:
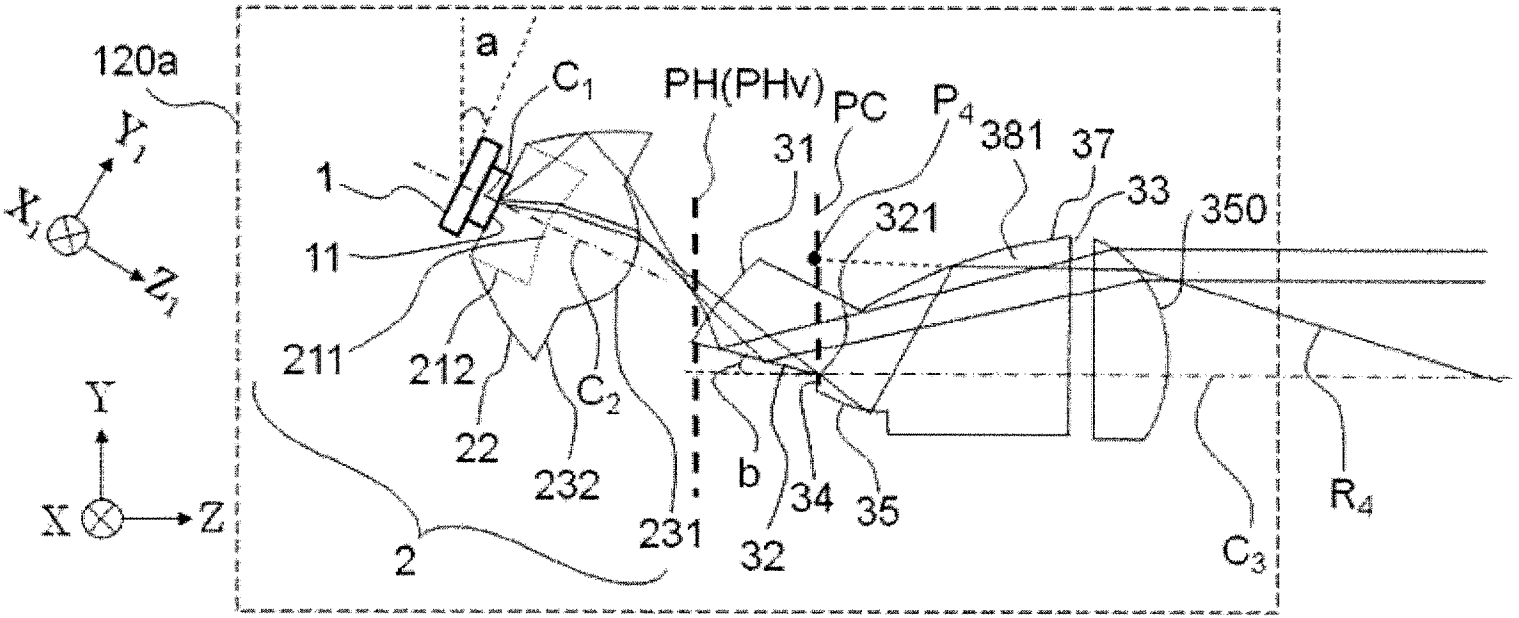
FIGS. 17A and 17B are configuration diagrams illustrating a configuration of a headlight module 120*a* according to the second embodiment.
Figure 17B:
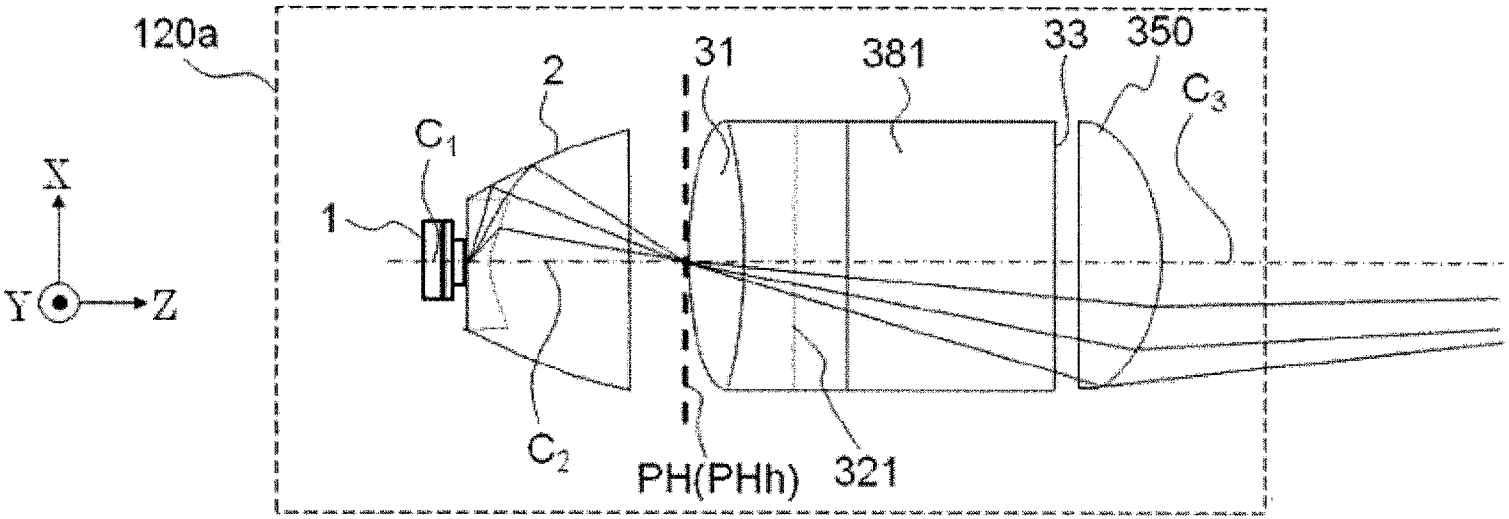

FIGS. 17A and 17B are configuration diagrams illustrating a configuration of a headlight module 120*a* obtained, for example, by forming the emitting surface 33 into a flat surface and adding a projection optical element 350, such as a projection lens.

A light guide projection optical element 381 of the headlight module 120*a* is obtained by forming the emitting surface 33 of the light guide projection optical element 301 illustrated in FIGS. 13A and 13B into, for example, a flat surface. The projection optical element 350 is provided with the projecting function of the emitting surface 33 of the light guide projection optical element 301. The projection optical element 350 projects a light distribution pattern.

The projection optical element 350 is located, for example, on the +Z axis side of the emitting surface 33. Light emitted from the emitting surface 33 is incident on the projection optical element 350.

The projection optical element 350 is provided with all or part of the projecting function of the emitting surface 33 of the light guide projection optical element 301. The headlight module 120*a* illustrated in FIGS. 17A and 17B implements the function of the emitting surface 33 of the light guide projection optical element 301 illustrated in FIGS. 13A and 13B by means of the projection optical element 350 and the emitting surface 33. Thus, for the description of the function or the like thereof, the description of the emitting surface 33 in the second embodiment is substituted.

In the headlight module 120*a* illustrated in FIGS. 17A and 17B, it is possible to provide the emitting surface 33 with refractive power and implement the function of the emitting surface 33 of the light guide projection optical element 301 illustrated in FIGS. 13A and 13B by means of the combination of the emitting surface 33 and projection optical element 350.

The optical axis $C_3$ is an optical axis of a portion having the projecting function. Thus, when the emitting surface 33 is a flat surface, the optical axis $C_3$ is an optical axis of the projection optical element 350. When the emitting surface 33 and projection optical element 350 have the projecting function, the optical axis $C_3$ is an optical axis of a combined lens obtained by combining the emitting surface 33 and the projection optical element 350. The portion having the projecting function is referred to as a projection optical portion or projection portion.

"Combined lens" refers to a single lens exhibiting the property of the combination of multiple lenses.

From the above, the headlight modules 100, 100*a*, 120, and 120*a* described in the first embodiment and second embodiment can be described as follows.

The headlight modules 100, 100*a*, 110, 120, and 120*a* each include the light source 1 for emitting light, the first reflecting surface 32 for reflecting the light, the first projection portion 33 or 350 for projecting the first reflected light $R_1$ reflected by the first reflecting surface 32, and the second reflecting surface 35 for reflecting, as the second reflected light $R_3$, the light emitted by the light source 1 and passing through the first projection portion 33 or 350 side of the edge portion 321 on the first projection portion 33 or 350 side of the first reflecting surface 32.

The first projection portion 33 or 350 has positive refractive power.

The intersection $P_3$ of the line segment extended from the second reflected light $R_3$ toward the first reflecting surface 32 side with the plane PC including the focal point of the first projection portion 33 or 350 and being perpendicular to the optical axis $C_3$ of the first projection portion 33 or 350 is located on the back surface side of the first reflecting surface 32.

The headlight modules 100 and 100*a* may each include the second projection portion 36 or 350*b* for emitting the second reflected light $R_3$.

The headlight modules 120 and 120*a* each include the third reflecting surface 37 for reflecting the second reflected light $R_3$ as the third reflected light $R_4$.

The third reflected light $R_4$ is emitted from the first emitting surface 33 or 350.

The light guide projection optical element 3 of the headlight module 100 illustrated in FIGS. 1A and 1B includes the first reflecting surface 32, second reflecting surface 35, and first projection portion 33. Also, the light guide projection optical element 3 of the headlight module 100 may include the second projection portion 36.

The light guide projection optical element 38 of the headlight module 100*a* illustrated in FIGS. 16A and 16B includes the first reflecting surface 32 and second reflecting surface 35. The projection optical element 350 includes the first projection portion 350*a*. The projection optical element 350 may include the second projection portion 350*b*.

The light guide projection optical elements 301 and 381 of the headlight modules 120 and 120*a* illustrated in FIGS. 13A and 13B and 17A and 17B each include the first reflecting surface 32, second reflecting surface 35, third reflecting surface 37, and first projection portion 33 or 350.

Third Embodiment

Figure 15:
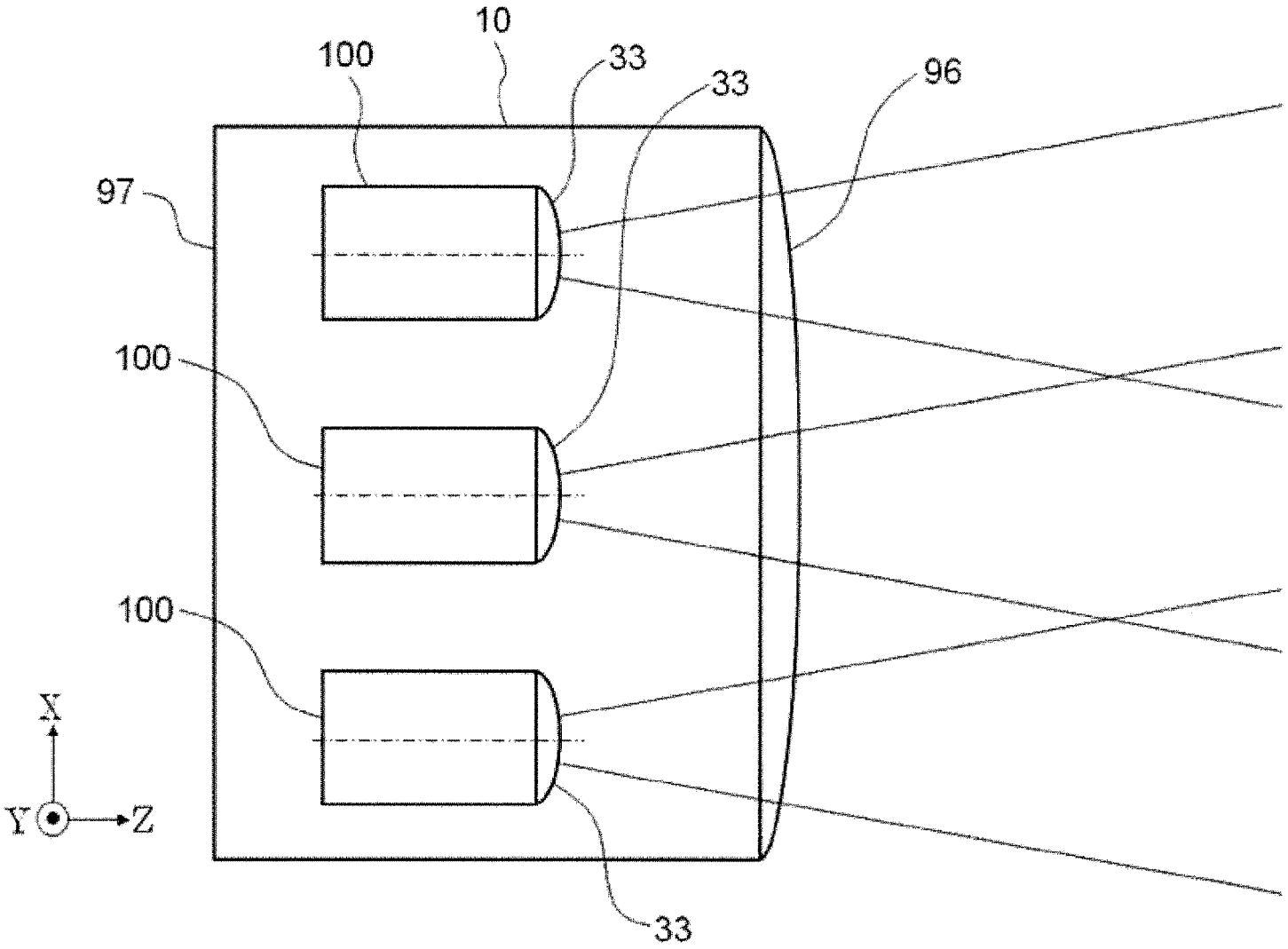
FIG. 15 is a configuration diagram of a headlight device 10 according to a third embodiment in which a plurality of the headlight modules 100 are installed.

FIG. 15 is a configuration diagram of a headlight device 10 including a plurality of the headlight modules 100.

In the above-described embodiments, the embodiments of the headlight modules 100, 100*a*, 110, 120, and 120*a* have been described. FIG. 15 illustrates, as an example, an example in which the headlight modules 100 are installed.

For example, all or a subset of the three headlight modules 100 illustrated in FIG. 15 may be replaced with the headlight module 110 or 120.

The headlight device 10 includes a housing 97. The headlight device 10 may also include a cover 96.

The housing 97 holds the headlight modules 100.

The housing 97 is disposed inside a vehicle body.

The headlight modules 100 are housed inside the housing 97. In FIG. 15, as an example, the three headlight modules 100 are housed. The number of headlight modules 100 is not limited to three. The number of headlight modules 100 may be one or three or more.

The headlight modules 100 are arranged in the X axis direction inside the housing 97. Arrangement of the headlight modules 100 is not limited to the arrangement in the X axis direction. In view of the design, function, or the like, the headlight modules 100 may be displaced from each other in the Y or Z axis direction.

In FIG. 15, the headlight modules 100 are housed inside the housing 97. However, the housing 97 need not have a box shape. The housing 97 may consist of a frame or the like and have a configuration in which the headlight modules 100 are fixed to the frame. This is because in the case of a four-wheeled automobile or the like, the housing 97 is disposed inside the vehicle body. The frame or the like may be a part constituting the vehicle body. In this case, the housing 97 is a housing part that is a part constituting the vehicle body.

In the case of a motorcycle, the housing 97 is disposed near the handlebar. In the case of a four-wheeled automobile, the housing 97 is disposed inside the vehicle body.

The cover 96 transmits light emitted from the headlight modules 100. The light passing through the cover 96 is emitted in front of the vehicle. The cover 96 is made of transparent material.

The cover 96 is disposed at a surface part of the vehicle body and exposed on the outside of the vehicle body.

The cover 96 is disposed on the +Z axis side of the housing 97.

Light emitted from the headlight modules 100 passes through the cover 96 and is emitted in front of the vehicle. In FIG. 15, the light emitted from the cover 96 is superposed with light emitted from the adjacent headlight modules 100 to form a single light distribution pattern.

The cover 96 is provided to protect the headlight modules 100 from weather, dust, or the like. However, if the emitting surfaces 33 of the light guide projection optical elements 3 are configured to protect the components inside the headlight modules 100 from weather, dust, or the like, there is no need to provide the cover 96.

As described above, when the headlight device 10 includes a plurality of the headlight modules 100, 100*a*, 110, 120, or 120*a*, it is an assembly of the headlight modules 100, 100*a*, 110, 120, or 120*a*. When the headlight device 10 has a single headlight module 100, 100*a*, 110, 120, or 120*a*, it is equal to the headlight module 100, 100*a*, 110, 120, or 120*a*. That is, the headlight module 100, 100*a*, 110, 120, or 120*a* is the headlight device 10.

The above-described embodiments use terms, such as "parallel" or "perpendicular", indicating the positional relationships between parts or the shapes of parts. These terms are intended to include ranges taking account of manufacturing tolerances, assembly variations, or the like. Thus, recitations in the claims indicating the positional relationships between parts or the shapes of parts are intended to include ranges taking account of manufacturing tolerances, assembly variations, or the like.

Further, although the embodiments of the present invention have been described as above, the present invention is not limited to these embodiments.

Based on the above embodiments, the content of the invention will be described below as Appendixes (1) and (2). In Appendixes (1) and (2), numbering is made independently. Thus, for example, Appendixes (1) and (2) each include "Appendix 1."

It is possible to combine features in Appendix (1) and features in Appendix (2).

APPENDIX (1)

Appendix 1

A headlight module comprising:

a light source for emitting light; and an optical element including a first reflecting surface for reflecting the light, a first emitting surface for emitting first reflected light reflected by the first reflecting surface, a second reflecting surface for reflecting, as second reflected light, light emitted by the light source and passing through the first emitting surface side of an edge portion on the first emitting surface side of the first reflecting surface, wherein the first emitting surface has positive refractive power; and an intersection of a line segment extended from the second reflected light toward the first reflecting surface side with a plane including a focal point of the first emitting surface and being perpendicular to an optical axis of the first emitting surface is located on a back surface side of the first reflecting surface.

Appendix 2

The headlight module of Appendix 1, wherein the optical element includes a second emitting surface for emitting the second reflected light.

Appendix 3

The headlight module of Appendix 2, wherein the second reflected light emitted from the second emitting surface is superposed with the first reflected light emitted from the first emitting surface.

Appendix 4

The headlight module of any one of Appendixes 1 to 3, wherein the optical element includes a third reflecting surface for reflecting the second reflected light as third reflected light.

Appendix 5

The headlight module of Appendix 4, wherein an intersection of a line segment extended from the third reflected light toward the first reflecting surface side with the plane including the focal point of the first emitting surface and being perpendicular to the optical axis of the first emitting surface is located on a front surface side of the first reflecting surface.

Appendix 6

The headlight module of Appendix 4 or 5, wherein the third reflected light is emitted from the first emitting surface.

Appendix 7

The headlight module of Appendix 6, wherein the third reflected light emitted from the first emitting surface is superposed with the first reflected light emitted from the first emitting surface.

Appendix 8

A headlight device comprising the headlight module of any one of Appendixes 1 to 7.

APPENDIX (2)

Appendix 1

A headlight module for a vehicle for forming a light distribution pattern and projecting the light distribution pattern, the headlight module comprising:

a light source for emitting light; and an optical element including a first reflecting surface for reflecting the light as first reflected light, and a second reflecting surface for reflecting, as second reflected light, light emitted by the light source and passing through a traveling direction side of an edge portion of the first reflecting surface, the traveling direction side being a side toward which the first reflected light travels, wherein the edge portion is an edge portion on the traveling direction side; and the first reflecting surface forms a high luminous intensity region of the light distribution pattern by superposing the first reflected light and light that has not been reflected by the first reflecting surface, and forms a cutoff line of the light distribution pattern.

Appendix 2

The headlight module of Appendix 1, wherein the optical element forms the light distribution pattern.

Appendix 3

The headlight module of Appendix 1 or 2, wherein the cutoff line of the light distribution pattern is formed on a basis of a shape of the first reflecting surface.

Appendix 4

The headlight module of any one of Appendixes 1 to 3, wherein the second reflecting surface is inclined in a direction such that an optical path in the optical element becomes wider.

Appendix 5

The headlight module of any one of Appendixes 1 to 4, wherein the optical element includes an incident surface for receiving the light emitted by the light source; and the incident surface has a positive power in a direction corresponding to a vertical direction of the light distribution pattern.

Appendix 6

The headlight module of Appendix 5, wherein the incident surface has a positive power in a direction corresponding to a horizontal direction of the light distribution pattern; and the power in the vertical direction is different from the power in the horizontal direction.

Appendix 7

The headlight module of Appendix 5, wherein the incident surface has a negative power in a direction corresponding to a horizontal direction of the light distribution pattern.

Appendix 8

The headlight module of any one of Appendixes 1 to 4, further comprising a condensing optical element that receives the light emitted by the light source, wherein the condensing optical element concentrates the light.

Appendix 9

The headlight module of Appendix 8, wherein the optical element includes an incident surface for receiving the light concentrated by the condensing optical element; and in a direction corresponding to a vertical direction of the light distribution pattern, a combined power of the condensing optical element and the incident surface is positive.

Appendix 10

The headlight module of Appendix 9, wherein the combined power has a positive power in a direction corresponding to a horizontal direction of the light distribution pattern; and a power in the vertical direction of the combined power is different from the power in the horizontal direction of the combined power.

Appendix 11

The headlight module of Appendix 9, wherein the combined power has a negative power in a direction corresponding to a horizontal direction of the light distribution pattern.

Appendix 12

The headlight module of any one of Appendixes 1 to 11, wherein the optical element includes a first emitting surface for emitting the first reflected light.

Appendix 13

The headlight module of Appendix 12, wherein the first emitting surface has positive refractive power.

Appendix 14

The headlight module of Appendix 12 or 13, wherein the light distribution pattern includes a first light distribution pattern including the first reflected light; and the first emitting surface projects the first light distribution pattern.

Appendix 15

The headlight module of any one of Appendixes 12 to 14, wherein an intersection of a line segment extended from a light ray of the second reflected light toward the first reflecting surface side with a plane including a focal point of the first emitting surface and being perpendicular to an optical axis of the first emitting surface is located on a back surface side of the first reflecting surface.

Appendix 16

The headlight module of any one of Appendixes 1 to 15, wherein the optical element includes a second emitting surface for emitting the second reflected light.

Appendix 17

The headlight module of Appendix 16, wherein the second emitting surface has positive refractive power.

Appendix 18

The headlight module of Appendix 16 or 17, wherein the light distribution pattern includes a second light distribution pattern including the second reflected light; and the second emitting surface projects the second light distribution pattern.

Appendix 19

The headlight module of any one of Appendixes 16 to 18, wherein an intersection of a line segment extended from a light ray of the second reflected light toward the first reflecting surface side with a plane including a focal point of the second emitting surface and being perpendicular to an optical axis of the second emitting surface is located on the first reflecting surface side of the focal point of the second emitting surface.

Appendix 20

The headlight module of any one of Appendixes 16 to 18, wherein an intersection of a line segment extended from a light ray of the second reflected light toward the first reflecting surface side with a plane including a focal point of the second emitting surface and being perpendicular to an optical axis of the second emitting surface is located on a side opposite the first reflecting surface of the focal point of the second emitting surface.

Appendix 21

The headlight module of any one of Appendixes 16 to 20, wherein the second reflecting surface includes a first reflecting region and a second reflecting region;

light reflected by the first reflecting region is emitted from the first emitting surface; and light reflected by the second reflecting region is emitted from the second emitting surface.

Appendix 22

The headlight module of any one of Appendixes 12 to 15, wherein the optical element includes a third reflecting surface for reflecting the second reflected light as third reflected light.

Appendix 23

The headlight module of Appendix 22, wherein the light distribution pattern includes a third light distribution pattern including the third reflected light; and the first emitting surface projects the third light distribution pattern.

Appendix 24

The headlight module of Appendix 22 or 23, wherein an intersection of a line segment extended from a light ray of the third reflected light toward the first reflecting surface side with a plane including a focal point of the first emitting surface and being perpendicular to an optical axis of the first emitting surface is located on a front surface side of the first reflecting surface.

Appendix 25

The headlight module of any one of Appendixes 22 to 24, wherein the third reflected light emitted from the first emitting surface is superposed with the first reflected light emitted from the first emitting surface.

Appendix 26

The headlight module of any one of Appendixes 22 to 25, wherein the second reflecting surface includes a first reflecting region and a second reflecting region;

light reflected by the first reflecting region is reflected by the third reflecting surface and emitted from the first emitting surface; and light reflected by the second reflecting region is emitted from the first emitting surface.

Appendix 27

The headlight module of Appendix 26, wherein the optical element includes a second emitting surface for emitting the second reflected light;

the second reflecting surface includes a third reflecting region; and light reflected by the third reflecting region is emitted from the second emitting surface.

Appendix 28

The headlight module of any one of Appendixes 1 to 11, further comprising a projection optical element for projecting the light distribution pattern formed by the optical element.

Appendix 29

The headlight module of Appendix 28, wherein the light distribution pattern includes a first light distribution pattern including the first reflected light; and the projection optical element projects the first light distribution pattern.

Appendix 30

The headlight module of Appendix 29, wherein the projection optical element includes a first emitting region for projecting the first light distribution pattern.

Appendix 31

The headlight module of Appendix 30, wherein an intersection of a line segment extended from a light ray of the second reflected light toward the first reflecting surface side with a plane including a focal point of the first emitting surface and being perpendicular to an optical axis of the first emitting surface is located on a back surface side of the first reflecting surface.

Appendix 32

The headlight module of any one of Appendixes 28 to 31, wherein the light distribution pattern includes a second light distribution pattern including the second reflected light; and the projection optical element projects the second light distribution pattern.

Appendix 33

The headlight module of Appendix 32, wherein the projection optical element includes a second emitting region for projecting the second light distribution pattern.

Appendix 34

The headlight module of Appendix 33, wherein an intersection of a line segment extended from a light ray of the second reflected light toward the first reflecting surface side with a plane including a focal point of the second emitting region and being perpendicular to an optical axis of the second emitting region is located on the first reflecting surface side of the focal point of the second emitting region.

Appendix 35

The headlight module of Appendix 33, wherein an intersection of a line segment extended from a light ray of the second reflected light toward the first reflecting surface side with a plane including a focal point of the second emitting region and being perpendicular to an optical axis of the second emitting region is located on a side opposite the first reflecting surface of the focal point of the second emitting region.

Appendix 36

The headlight module of any one of Appendixes 33 to 35, wherein the second reflecting surface includes a first reflecting region and a second reflecting region;

light reflected by the first reflecting region is emitted from the first emitting region; and light reflected by the second reflecting region is emitted from the second emitting region.

Appendix 37

The headlight module of any one of Appendixes 28 to 30, wherein the optical element includes a third reflecting surface for reflecting the second reflected light as third reflected light.

Appendix 38

The headlight module of Appendix 37, wherein the light distribution pattern includes a third light distribution pattern including the third reflected light; and the projection optical element projects the third light distribution pattern.

Appendix 39

The headlight module of Appendix 37 or 38, wherein an intersection of a line segment extended from a light ray of the third reflected light toward the first reflecting surface side with a plane including a focal point of the projection optical element and being perpendicular to an optical axis of the projection optical element is located on a front surface side of the first reflecting surface.

Appendix 40

The headlight module of any one of Appendixes 37 to 39, wherein the third reflected light emitted from the projection optical element is superposed with the first reflected light emitted from the projection optical element.

Appendix 41

The headlight module of any one of Appendixes 37 to 40, wherein the second reflecting surface includes a first reflecting region and a second reflecting region;

light reflected by the first reflecting region is reflected by the third reflecting surface and emitted from the first emitting region; and light reflected by the second reflecting region is emitted from the first emitting region.

Appendix 42

The headlight module of Appendix 41, wherein the projection optical element includes a second emitting region for emitting the second reflected light;

the second reflecting surface includes a third reflecting region; and light reflected by the third reflecting region is emitted from the second emitting region.

Appendix 43

The headlight module of Appendix 28, wherein the optical element includes an emitting surface for emitting light that forms the light distribution pattern.

Appendix 44

The headlight module of Appendix 43, wherein the light distribution pattern includes a first light distribution pattern including the first reflected light; and the projection optical element projects the first light distribution pattern together with the emitting surface.

Appendix 45

The headlight module of Appendix 44, wherein the emitting surface and the projection optical element include a first emitting region for projecting the first light distribution pattern by means of the emitting surface and the projection optical element.

Appendix 46

The headlight module of Appendix 45, wherein an intersection of a line segment extended from a light ray of the second reflected light toward the first reflecting surface side with a plane including a focal point of the first emitting region and being perpendicular to an optical axis of the first emitting region is located on a back surface side of the first reflecting surface.

Appendix 47

The headlight module of any one of Appendixes 43 to 46, wherein the light distribution pattern includes a second light distribution pattern including the second reflected light; and the projection optical element projects the second light distribution pattern together with the emitting surface.

Appendix 48

The headlight module of Appendix 47, wherein the emitting surface and the projection optical element include a second emitting region for projecting the second light distribution pattern by means of the emitting surface and the projection optical element.

Appendix 49

The headlight module of Appendix 48, wherein an intersection of a line segment extended from a light ray of the second reflected light toward the first reflecting surface side with a plane including a focal point of the second emitting region and being perpendicular to an optical axis of the second emitting region is located on the first reflecting surface side of the focal point of the second emitting region.

Appendix 50

The headlight module of Appendix 48, wherein an intersection of a line segment extended from a light ray of the second reflected light toward the first reflecting surface side with a plane including a focal point of the second emitting region and being perpendicular to an optical axis of the second emitting region is located on a side opposite the first reflecting surface of the focal point of the second emitting region.

Appendix 51

The headlight module of any one of Appendixes 48 to 50, wherein the second reflecting surface includes a first reflecting region and a second reflecting region;

light reflected by the first reflecting region is emitted from the first emitting region; and light reflected by the second reflecting region is emitted from the second emitting region.

Appendix 52

The headlight module of Appendix 43 or 44, wherein the optical element includes a third reflecting surface for reflecting the second reflected light as third reflected light.

Appendix 53

The headlight module of Appendix 52, wherein the light distribution pattern includes a third light distribution pattern including the third reflected light; and the projection optical element projects the third light distribution pattern together with the emitting surface.

Appendix 54

The headlight module of Appendix 52 or 53, wherein an intersection of a line segment extended from a light ray of the third reflected light toward the first reflecting surface side with a plane including a focal point of a projection optical portion formed by the emitting surface and the projection optical element and being perpendicular to an optical axis of the projection optical portion is located on a front surface side of the first reflecting surface.

Appendix 55

The headlight module of any one of Appendixes 52 to 54, wherein the third reflected light emitted from the projection optical element is superposed with the first reflected light emitted from the projection optical element.

Appendix 56

The headlight module of any one of Appendixes 52 to 55, wherein the emitting surface and the projection optical element include a first emitting region for emitting the first reflected light;

the second reflecting surface includes a first reflecting region and a second reflecting region;

light reflected by the first reflecting region is reflected by the third reflecting surface and emitted from the first emitting region; and light reflected by the second reflecting region is emitted from the first emitting region.

Appendix 57

The headlight module of Appendix 56, wherein the emitting surface and the projection optical element include a second emitting region for emitting the second reflected light;

the second reflecting surface includes a third reflecting region; and light reflected by the third reflecting region is emitted from the second emitting region.

Appendix 58

The headlight module of any one of Appendixes 22 to 27, 37 to 42, and 52 to 57, wherein the third reflecting surface is inclined in a direction such that an optical path in the optical element becomes wider.

Appendix 59

The headlight module of any one of Appendixes 22 to 27, 37 to 42, and 52 to 58, wherein the third reflecting surface is located on a side of the first reflecting surface, the side being a side toward which light entering the optical element travels.

Appendix 60

The headlight module of any one of Appendixes 22 to 27, 37 to 42, and 52 to 59, wherein the third reflecting surface is located on a side of the second reflecting surface, the side being a side toward which light entering the optical element travels.

Appendix 61

The headlight module of any one of Appendixes 22 to 27, 37 to 42, and 52 to 60, wherein the second reflecting surface is located between the first reflecting surface and the third reflecting surface, in a direction in which light entering the optical element travels.

Appendix 62

The headlight module of any one of Appendixes 22 to 27, 37 to 42, and 52 to 61, wherein the third reflecting surface is a total reflection surface.

Appendix 63

The headlight module of any one of Appendixes 22 to 27, 37 to 42, and 52 to 61, wherein the third reflecting surface is a mirror surface.

Appendix 64

The headlight module of any one of Appendixes 22 to 27, 37 to 42, and 52 to 61, wherein the third reflecting surface is a diffusing surface.

Appendix 65

The headlight module of any one of Appendixes 1 to 64, wherein the first reflecting surface is a total reflection surface.

Appendix 66

The headlight module of any one of Appendixes 1 to 64, wherein the first reflecting surface is a mirror surface.

Appendix 67

The headlight module of any one of Appendixes 1 to 66, wherein the second reflecting surface is a total reflection surface.

Appendix 68

The headlight module of any one of Appendixes 1 to 66, wherein the second reflecting surface is a mirror surface.

Appendix 69

The headlight module of any one of Appendixes 1 to 66, wherein the second reflecting surface is a diffusing surface.

Appendix 70

A headlight device comprising the headlight module of any one of Appendixes 1 to 69.

REFERENCE SIGNS LIST

10 headlight device, 100, 100*a*, 110, 120, 120*a* headlight module, 1, 1*a*, 1*b*, 1*c* light source, 11 light emitting surface, 15, 15*a*, 15*b*, 15*c* light source module, 2, 2*a*, 2*b*, 2*c* condensing optical element, 211, 212 incident surface, 22 reflecting surface, 231, 232 emitting surface, 3, 38, 301, 381 light guide projection optical element, 31, 34 incident surface, 32, 35, 37 reflecting surface, 321, $\mathbf{321}_a$, $\mathbf{321}_b$ ridge line portion, 33, 36 emitting surface, 350 projection optical element, 9 irradiated surface, 91 cutoff line, 92 region on the lower side of the cutoff line, 93 brightest region, 96 cover, 97 housing, a, b, f angle, $C_1$, $C_2$, $C_3$, $C_4$, $C_5$, $C_6$ optical axis, $L_a$, $L_b$, $L_c$ light, $m_1$, $m_2$, $m_3$, $m_4$ perpendicular line, PH light concentration position, PC conjugate plane, PF plane, Fp focal point, $R_1$, $R_2$, $R_3$, $R_4$ light ray, $P_3$, $P_4$, $P_5$ position, Q point, $S_1$, $S_3$, $S_4$, $S_6$ incident angle, $S_2$, $S_5$, reflection angle, $S_{out}$, $S_{out1}$, $S_{out2}$ emission angle.

The invention claimed is:

1. A headlight module for a vehicle for forming a light distribution pattern and projecting the light distribution pattern, the headlight module comprising:

a light source for emitting light; and an optical element including a first reflecting surface for reflecting the light as first reflected light, a second reflecting surface for reflecting, as second reflected light, light passing through a traveling direction side of an edge portion of the first reflecting surface, a first emitting surface for emitting the first reflected light, and a second emitting surface for emitting the second reflected light, the traveling direction side being a side toward which the first reflected light travels, wherein the edge portion is an edge portion on the traveling direction side;

the first emitting surface has positive refractive power and has a first optical axis;

the second emitting surface has positive refractive power and has a second optical axis different from the first optical axis;

a direction in which a front surface of the first reflecting surface faces is a first direction, and a direction in which a back surface of the first reflecting surface faces is a second direction;

the second reflecting surface is located on the first emitting surface side of the edge portion and located in the second direction from the first reflecting surface;

the second emitting surface is located in the second direction from the first emitting surface;

the first reflecting surface forms a high luminous intensity region of the light distribution pattern by superposing the first reflected light and light that has not been reflected by the first reflecting surface, and forms a cutoff line of the light distribution pattern; and the edge portion forms a shape of the cutoff line of the light distribution pattern.

2. The headlight module of claim 1, further comprising a projection optical element for projecting the light distribution pattern formed by the optical element.

3. The headlight module of claim 1, wherein an intersection of a line segment extended from a light ray of the second reflected light toward the first reflecting surface side with a plane including a focal point of the second emitting surface and being perpendicular to the second optical axis of the second emitting surface is located on the first reflecting surface side of the focal point of the second emitting surface.

4. The headlight module of claim 1, wherein an intersection of a line segment extended from a light ray of the second reflected light toward the first reflecting surface side with a plane including a focal point of the second emitting surface and being perpendicular to the second optical axis of the second emitting surface is located on a side opposite the first reflecting surface of the focal point of the second emitting surface.

5. The headlight module of claim 1, wherein the second reflecting surface includes a first reflecting region and a second reflecting region;

light reflected by the first reflecting region is emitted from the first emitting surface; and light reflected by the second reflecting region is emitted from the second emitting surface.

6. A headlight device comprising the headlight module of claim 1.

7. A headlight module for a vehicle for forming a light distribution pattern and projecting the light distribution pattern, the headlight module comprising:

a light source for emitting light; and an optical element including a first reflecting surface for reflecting the light as first reflected light, a second reflecting surface for reflecting, as second reflected light, light passing through a traveling direction side of an edge portion of the first reflecting surface, a third reflecting surface for reflecting the second reflected light as third reflected light, and a first emitting surface, the traveling direction side being a side toward which the first reflected light travels, wherein the edge portion is an edge portion on the traveling direction side;

the first emitting surface emits the first reflected light and the third reflected light;

a direction in which a front surface of the first reflecting surface faces is a first direction, and a direction in which a back surface of the first reflecting surface faces is a second direction;

the second reflecting surface is located on the first emitting surface side of the edge portion and located in the second direction from the first reflecting surface;

the third reflecting surface is located in the first direction from an optical axis of the first emitting surface, located on the first emitting surface side of the first reflecting surface, and located on the first emitting surface side of the second reflecting surface;

the first reflecting surface forms a high luminous intensity region of the light distribution pattern by superposing the first reflected light and light that has not been reflected by the first reflecting surface, and forms a cutoff line of the light distribution pattern; and the edge portion forms a shape of the cutoff line of the light distribution pattern.

8. The headlight module of claim 7, wherein the first emitting surface has positive refractive power.

9. The headlight module of claim 8, wherein an intersection of a line segment extended from a light ray of the third reflected light toward the first reflecting surface side with a plane including a focal point of the first emitting surface and being perpendicular to an optical axis of the first emitting surface is located on the front surface side of the first reflecting surface.

10. The headlight module of claim 7, further comprising a projection optical element for projecting the light distribution pattern formed by the optical element.

11. The headlight module of claim 7, wherein the second reflecting surface includes a first reflecting region and a second reflecting region;

light reflected by the first reflecting region is reflected by the third reflecting surface and emitted from the first emitting surface; and light reflected by the second reflecting region is emitted from the first emitting surface.

12. The headlight module of claim 11, wherein the optical element includes a second emitting surface for emitting the second reflected light;

the second reflecting surface includes a third reflecting region; and light reflected by the third reflecting region is emitted from the second emitting surface.

13. A headlight device comprising the headlight module of claim 7.

* * * * *